US011181351B2

(12) United States Patent
Mahnke

(10) Patent No.: US 11,181,351 B2
(45) Date of Patent: Nov. 23, 2021

(54) PROJECTILE WITH ENHANCED BALLISTICS

(71) Applicant: G9 Holdings, LLC, Lakewood, CO (US)

(72) Inventor: Joshua Mahnke, Post Falls, ID (US)

(73) Assignee: G9 Holdings, LLC, Lakewood, CO (US)

( * ) Notice: Subject to any disclaimer, the term of this patent is extended or adjusted under 35 U.S.C. 154(b) by 0 days.

(21) Appl. No.: 16/806,860

(22) Filed: Mar. 2, 2020

(65) Prior Publication Data

US 2020/0217632 A1 Jul. 9, 2020

Related U.S. Application Data

(62) Division of application No. 15/651,997, filed on Jul. 17, 2017, now Pat. No. 10,578,410, which is a (Continued)

(51) Int. Cl.
*F42B 12/02* (2006.01)
*F42B 12/74* (2006.01)
(Continued)

(52) U.S. Cl.
CPC ..... *F42B 12/02* (2013.01); *F42B 10/22* (2013.01); *F42B 10/24* (2013.01); *F42B 10/26* (2013.01);
(Continued)

(58) Field of Classification Search
CPC .. F42B 12/00; F42B 12/02; F42B 6/08; F42B 6/10; F42B 30/00; F42B 30/02;
(Continued)

(56) References Cited

U.S. PATENT DOCUMENTS 760,338 A 5/1904 Kwiatkowski
1,169,704 A 1/1916 Wesner
(Continued)

FOREIGN PATENT DOCUMENTS

CA 577406 6/1959
DE 2641021 3/1978
(Continued)

OTHER PUBLICATIONS

U.S. Appl. No. 15/407,102, filed Jan. 16, 2017, Mahnke.
(Continued)

*Primary Examiner* — Jonathan C Weber
(74) *Attorney, Agent, or Firm* — Sheridan Ross P.C.

(57) ABSTRACT

The present invention provides a projectile device and a method of manufacture of a projectile device and in particular, to a pistol bullet and a rifle bullet and method of manufacture of same. In one embodiment, the projectile apparatus has a cylindrical body portion having a diameter, a front nose section tapering from a most proximal point of the projectile to the cylindrical body portion, and a rear tail section connected to the body portion and extending to the most distal point of the projectile, in which the front nose portion comprises a plurality of twisting depressions forming troughs.

17 Claims, 41 Drawing Sheets

Related U.S. Application Data division of application No. 14/701,519, filed on Apr. 30, 2015, now Pat. No. 9,709,368.

(60) Provisional application No. 62/145,814, filed on Apr. 10, 2015, provisional application No. 61/986,296, filed on Apr. 30, 2014.

(51) Int. Cl.

| | |
|---|---|
| ***F42B 10/22*** | (2006.01) |
| ***F42B 10/24*** | (2006.01) |
| ***F42B 10/26*** | (2006.01) |
| ***F42B 10/46*** | (2006.01) |
| ***F42B 12/06*** | (2006.01) |
| ***F42B 30/02*** | (2006.01) |

(52) U.S. Cl.

CPC ..... *F42B 10/46* (2013.01); *F42B 12/06* (2013.01); *F42B 12/74* (2013.01); *F42B 30/02* (2013.01)

(58) Field of Classification Search

CPC ..... F42B 14/00; F42B 14/02; F42B 14/06; F42B 14/062; F42B 12/04; F42B 12/06; F42B 12/08; F42B 12/34; F42B 10/22; F42B 10/24; F42B 10/26; F42B 10/46

USPC ..... 102/506–508, 510, 519–523

See application file for complete search history.

(56) References Cited

U.S. PATENT DOCUMENTS

| | | | |
|---|---|---|---|
| 1,596,180 | A | 8/1926 | Henderson |
| 2,342,006 | A | 2/1944 | Moore |
| 2,612,108 | A | 9/1952 | Schmidt |
| 2,941,469 | A | 6/1960 | Barnhart |
| 3,557,702 | A | 1/1971 | Benson |
| 3,580,179 | A | 5/1971 | Gawlick et al. |
| 3,901,158 | A | 8/1975 | Ferb |
| 3,949,677 | A | 4/1976 | Voss |
| D244,448 | S | 5/1977 | Bonine et al. |
| 4,301,733 | A | 11/1981 | Blanco |
| 4,643,435 | A | 2/1987 | Musacchia, Sr. |
| 4,644,866 | A | 2/1987 | Sullivan |
| 4,700,630 | A | 10/1987 | Sullivan |
| 4,829,904 | A | 5/1989 | Sullivan |
| 4,829,906 | A | 5/1989 | Kaswer |
| 4,867,065 | A | 9/1989 | Kaltmann et al. |
| H770 | H | 4/1990 | Kline et al. |
| D310,553 | S | 9/1990 | Kania et al. |
| 4,958,572 | A | 9/1990 | Martel |
| D314,416 | S | 2/1991 | Rezmer |
| 5,020,438 | A | 6/1991 | Brown |
| 5,069,139 | A | 12/1991 | Denis |
| 5,094,464 | A | 3/1992 | Musacchia, Sr. |
| 5,116,224 | A | 5/1992 | Kelsey, Jr. |
| 5,133,261 | A | 7/1992 | Kelsey, Jr. |
| 5,198,616 | A | 3/1993 | Anderson |
| D343,439 | S | 1/1994 | Kuczewski |
| D363,335 | S | 10/1995 | Dixon |
| 5,493,975 | A | 2/1996 | Franzini et al. |
| 5,496,043 | A | 3/1996 | Ester |
| 5,641,937 | A | 6/1997 | Carter |
| 5,841,058 | A | 11/1998 | Manis |
| 5,907,121 | A | 5/1999 | Fritze |
| 5,932,836 | A | 8/1999 | White |
| 6,070,532 | A | 6/2000 | Halverson |
| 6,074,454 | A | 6/2000 | Abrams et al. |
| D435,886 | S | 1/2001 | Benini |
| 6,182,574 | B1 | 2/2001 | Giannoni |
| 6,263,798 | B1 | 7/2001 | Benini |
| D447,208 | S | 8/2001 | Benini |
| 6,306,053 | B1 | 10/2001 | Liechty, II |
| 6,439,123 | B1 | 8/2002 | Dionne et al. |
| 6,439,125 | B1 | 8/2002 | Carter |
| 6,536,352 | B1 | 3/2003 | Nadkarni et al. |
| 6,581,522 | B1 | 6/2003 | Julien et al. |
| 6,772,695 | B2 | 8/2004 | Kellner |
| 6,776,818 | B1 | 8/2004 | Nilsson |
| 6,971,315 | B2 | 12/2005 | Knappworst et al. |
| 7,204,191 | B2 | 4/2007 | Wiley et al. |
| 7,207,276 | B1 | 4/2007 | Dindl |
| 7,213,519 | B2 | 5/2007 | Wiley et al. |
| D563,100 | S | 3/2008 | Epling et al. |
| D566,805 | S | 4/2008 | Earl |
| 7,380,502 | B2 | 6/2008 | Emary |
| D583,897 | S | 12/2008 | Ward |
| 7,484,459 | B2 | 2/2009 | Fichot et al. |
| D621,468 | S | 8/2010 | Nilsson |
| D625,380 | S | 10/2010 | Walter et al. |
| D626,619 | S | 11/2010 | Gogol et al. |
| D632,357 | S | 2/2011 | Dixon |
| D652,472 | S | 1/2012 | Klement |
| 8,161,885 | B1 | 4/2012 | Emary |
| 8,186,277 | B1 | 5/2012 | King |
| 8,365,672 | B2 | 2/2013 | Calero Martinez et al. |
| 8,393,273 | B2 | 3/2013 | Weeks et al. |
| D689,975 | S | 9/2013 | Carlson et al. |
| D707,785 | S | 6/2014 | Seecamp |
| 8,763,535 | B2 | 7/2014 | Padgett |
| D710,962 | S | 8/2014 | Pedersen |
| D713,919 | S | 9/2014 | Rager |
| D717,909 | S | 11/2014 | Thrift et al. |
| D722,126 | S | 2/2015 | Bray |
| D723,653 | S | 3/2015 | Peterson |
| D724,690 | S | 3/2015 | Carson et al. |
| D726,281 | S | 4/2015 | Powers, Jr. |
| 9,003,974 | B2 | 4/2015 | Muskat et al. |
| D733,252 | S | 6/2015 | Burczynski et al. |
| D733,834 | S | 7/2015 | Burczynski et al. |
| D733,835 | S | 7/2015 | Burczynski et al. |
| D733,836 | S | 7/2015 | Burczynski et al. |
| D733,837 | S | 7/2015 | Burczynski et al. |
| D734,419 | S | 7/2015 | Burczynski et al. |
| D735,289 | S | 7/2015 | Burczynski et al. |
| 9,121,677 | B2 | 9/2015 | Emary |
| 9,146,086 | B2 * | 9/2015 | Peterson ..... F41A 3/58 |
| D743,500 | S | 11/2015 | Pedersen |
| D747,781 | S | 1/2016 | Alculumbre |
| D748,220 | S | 1/2016 | Fricke |
| D750,723 | S | 3/2016 | Rager |
| D751,166 | S | 3/2016 | Seecamp |
| D751,167 | S | 3/2016 | Chua et al. |
| D752,702 | S | 3/2016 | Arnedo Vera et al. |
| D752,703 | S | 3/2016 | Arnedo Vera et al. |
| D753,258 | S | 4/2016 | Arnedo Vera et al. |
| D754,222 | S | 4/2016 | Pederson et al. |
| D754,223 | S | 4/2016 | Pederson et al. |
| 9,316,468 | B2 | 4/2016 | Rall et al. |
| D759,189 | S | 6/2016 | Pederson et al. |
| D764,624 | S | 8/2016 | Masinelli |
| D768,798 | S | 10/2016 | Loa |
| D768,802 | S | 10/2016 | Bowers |
| D770,005 | S | 10/2016 | Christiansen et al. |
| D774,159 | S | 12/2016 | Holtmeyer et al. |
| D775,305 | S | 12/2016 | Fiocchi et al. |
| D780,876 | S | 3/2017 | Boatright |
| D781,980 | S | 3/2017 | Wallace |
| 9,709,368 | B2 | 7/2017 | Mahnke |
| 9,863,746 | B2 | 1/2018 | Peterson |
| D821,536 | S | 6/2018 | Christiansen et al. |
| D863,492 | S | 10/2019 | Mahnke |
| D868,199 | S | 11/2019 | Mahnke |
| 10,502,536 | B2 | 12/2019 | Mahnke |
| 10,578,410 | B2 | 3/2020 | Mahnke |
| 2002/0055404 | A1 | 5/2002 | Liechty, II |
| 2005/0005807 | A1 | 1/2005 | Wiley et al. |
| 2005/0241523 | A1 | 11/2005 | Schikora et al. |
| 2006/0027128 | A1 | 2/2006 | Hober |
| 2006/0030438 | A1 | 2/2006 | Hajek |
| 2006/0096491 | A1 | 5/2006 | Fichot |
| 2006/0124022 | A1 | 6/2006 | Eberhart et al. |
| 2009/0308275 | A1 | 12/2009 | Nilsson |

(56) References Cited

U.S. PATENT DOCUMENTS

| | | | | |
|---|---|---|---|---|
| 2010/0224093 | A1 | 9/2010 | Wilhelm et al. | |
| 2013/0263754 | A1 | 10/2013 | Neme | |
| 2014/0130699 | A1* | 5/2014 | Peterson | F41C 7/00 102/520 |
| 2015/0075400 | A1 | 3/2015 | Lemke et al. | |
| 2015/0204639 | A1 | 7/2015 | Riley | |
| 2015/0268020 | A1 | 9/2015 | Emary | |
| 2015/0308800 | A1 | 10/2015 | Schnabel | |
| 2016/0047638 | A1 | 2/2016 | Golloher et al. | |
| 2016/0091289 | A1* | 3/2016 | Peterson | F42B 5/02 102/501 |
| 2016/0097619 | A1 | 4/2016 | Emary | |
| 2016/0169645 | A1 | 6/2016 | Emary et al. | |
| 2016/0223307 | A1 | 8/2016 | Bray | |
| 2016/0231093 | A1 | 8/2016 | Lemke et al. | |
| 2017/0205215 | A1 | 7/2017 | Sloff et al. | |
| 2017/0219325 | A1 | 8/2017 | Smith | |
| 2017/0248396 | A1 | 8/2017 | Riess | |
| 2017/0336186 | A1 | 11/2017 | Smith | |
| 2018/0135950 | A1 | 5/2018 | Agazim | |
| 2020/0116462 | A1 | 4/2020 | Mahnke | |

FOREIGN PATENT DOCUMENTS

| | | |
|---|---|---|
| DE | 10042719 | 3/2001 |
| EP | 0015574 | 9/1980 |
| EP | 0502221 | 9/1992 |
| EP | 2498046 | 9/2012 |
| GB | 451031 | 7/1936 |
| WO | WO 86/06827 | 11/1986 |
| WO | WO 99/37971 | 7/1999 |
| WO | WO 2008/048224 | 4/2008 |
| WO | WO 2013/086544 | 6/2013 |
| WO | WO 2013/096848 | 6/2013 |
| WO | WO 2015/048102 | 4/2015 |

OTHER PUBLICATIONS

U.S. Appl. No. 29/709,402, filed Oct. 14, 2019, Mahnke.
U.S. Appl. No. 29/714,930, filed Nov. 26, 2019, Mahnke.
"ELD® Match," Hornady Manufacturing Company, 2016, retrieved from http://www.hornady.com/store/BELD-Match-New, 3 pages.
"ELD-X®," Hornady Manufacturing Company, 2016, retrieved from http://www.hornady.com/store/ELD-X-New, 2 pages.
"Hornady® Black™," Hornady Manufacturing Company, 2016, retrieved from http://www.hornady.com/store/Black-new, 3 pages.
"Inceptor ARX Product Sheet," PolyCase Ammunition, Jan. 2015, 1 page.
"Inceptor Preferred Defense," Polycase Ammunition, retrieved from http://www.polycaseammo.com/project/inceptor-arx, retrieved on Nov. 2016, 2 pages.
"Inceptor Preferred Hunting®," Polycase Ammunition, retrieved from http://www.polycaseammo.com/project/inceptor-preferred-hunting, retrieved on Nov. 2016, 2 pages.
"Match™," Hornady Manufacturing Company, 2016, retrieved from http://www.hornady.com/store/Match-newammo, 3 pages.
"Polycase Ammo Shows Off New Ammo at SHOT Show 2014," Matt Alpert, 2014, retrieved from https://www.youtube.com/watch?v=Y9Pp9gRNqal, retrieved on May 2, 2016, 1 page (screen shot of YouTube video web page).
"PolyCase ARX + RNP Product Sheet," PolyCase Ammunition, Jan. 2015, 1 page.
"Ruger® Ammunition," Sturm, Ruger & Co., Inc., retrieved from http://www.ruger.com/micros/ammo/index.html?r=y, retrieved on Nov. 2016, 3 pages.
ES P201331387 (priority document for WO 2015/048102), filed Sep. 24, 2013, 21 pages, English translation unavailable.
Horman, "Tested: The Polycase ARX Bullet," American Rifleman, 2015, 6 pages.
International Search Report and Written Opinion for International (PCT) Patent Application No. PCT/US15/28661, dated Jan. 7, 2016, 11 pages.
International Preliminary Report on Patentability for International (PCT) Patent Application No. PCT/US15/28661, dated Oct. 12, 2016, 9 pages.
Official Action for Australia Patent Application No. 2015288295, dated Mar. 6, 2019 6 pages.
Notice of Acceptance for Australia Patent Application No. 2015288295, dated Sep. 12, 2019 4 pages.
Extended European Search Report for European Patent Application No. 15819768.1, dated Dec. 1, 2017, 11 pages.
Official Action for Israel Patent Application No. 248588, dated Feb. 7, 2018 7 pages.
Notice of Allowance for Israel Patent Application No. 248588, dated Jun. 16, 2019 3 pages.
Official Action for U.S. Appl. No. 14/701,519, dated Apr. 5, 2016, 7 pages, Restriction Requirement.
Official Action for U.S. Appl. No. 14/701,519, dated Aug. 26, 2016, 9 pages.
Notice of Allowance for U.S. Appl. No. 14/701,519, dated Mar. 24, 2017, 8 pages.
Restriction Requirement for U.S. Appl. No. 15/406,781, dated Feb. 28, 2018, 7 pages.
Official Action for U.S. Appl. No. 15/406,781, dated Sep. 5, 2018 6 pages Restriction Requirement.
Official Action for U.S. Appl. No. 15/406,781, dated Feb. 1, 2019 7 pages.
Notice of Allowance for U.S. Appl. No. 15/406,781, dated Jul. 25, 2019 8 pages.
Official Action for U.S. Appl. No. 29/612,522, dated Mar. 8, 2019 6 pages Restriction Requirement.
Notice of Allowance for U.S. Appl. No. 29/612,522, dated Jul. 11, 2019 6 pages.
Official Action for U.S. Appl. No. 29/590,952, dated Jul. 12, 2018 7 pages Restriction Requirement.
Official Action for U.S. Appl. No. 29/590,952, dated Dec. 14, 2018 7 pages.
Notice of Allowance for U.S. Appl. No. 29/590,952, dated May 22, 2019 5 pages.
Official Action for U.S. Appl. No. 15/651,997, dated May 14, 2018 7 pages Restriction Requirement.
Official Action for U.S. Appl. No. 15/651,997, dated Feb. 14, 2019 11 pages.
Notice of Allowance for U.S. Appl. No. 15/651,997, dated Jul. 29, 2019 8 pages.
"HELOSR High Expansion Lawman Ordnance Monolithic Hollow Point," National Police Ammunition, 2018, 5 pages.
Official Action for European Patent Application No. 19182441.6, dated Oct. 21, 2019 5 pages.
Extended Search Report for European Patent Application No. 19182441.6, dated Mar. 2, 2020 10 pages.
Official Action with English Translation for Israel Patent Application No. 269160, dated Nov. 28, 2019 6 pages.
Official Action for U.S. Appl. No. 16/707,820, dated Jul. 9, 2020 12 pages.
Official Action for Canada Patent Application No. 2,982,305, dated Mar. 29, 2021 3 pages.
Notice of Acceptance for Australia Patent Application No. 2019283920, dated Jan. 12, 2021 4 pages.
Notice of Allowance for U.S. Appl. No. 16/707,820, dated Feb. 19, 2021 9 pages.

* cited by examiner

Caliber: 0.308

Twist: 10

Angle: 5.526794

TABLE 1

Twist (1/x inches)

| Caliber (diameter in inches) | 6 | 7 | 8 | 9 | 10 | 11 | 12 | 13 | 14 | 15 | 16 |
|---|---|---|---|---|---|---|---|---|---|---|---|
| 0.224 | 6.68944 | 5.74071 | 5.02706 | 4.47090 | 4.02536 | 3.66047 | 3.35616 | | | | |
| 0.243 | 7.25104 | 6.22397 | 5.45099 | 4.84839 | 4.36553 | 3.97000 | 3.64009 | | | | |
| 0.257 | 7.66396 | 6.57950 | 5.76299 | 5.12628 | 4.61599 | 4.19793 | 3.84920 | | | | |
| 0.264 | 7.87013 | 6.75707 | 5.91886 | 5.26513 | 4.74115 | 4.31184 | 3.95371 | | | | |
| 0.277 | 8.25246 | 7.08650 | 6.20809 | 5.52283 | 4.97347 | 4.52331 | 4.14774 | | | | |
| 0.284 | 8.45802 | 7.26369 | 6.36370 | 5.66150 | 5.09850 | 4.63712 | 4.25218 | | | | |
| 0.308 | | | 6.89850 | 6.13643 | 5.52679 | 5.02706 | 4.61003 | 4.25677 | 3.95371 | | |
| 0.323 | | | 7.22890 | 6.43283 | 5.79417 | 5.27054 | 4.83350 | 4.46326 | 4.14561 | | |
| 0.338 | | | 7.56080 | 6.72889 | 6.06129 | 5.51382 | 5.05683 | 4.66963 | 4.33741 | | |
| 0.355 | | | 7.93635 | 7.06399 | 6.36370 | 5.78931 | 5.30975 | 4.90338 | 4.55467 | | |
| 0.336 | | | 7.51216 | 6.68549 | 6.02213 | 5.47815 | 5.02408 | 4.63937 | 4.30928 | | |
| 0.375 | | | 8.37729 | 7.45760 | 6.71903 | 6.11206 | 5.60703 | 5.17816 | 4.81010 | 4.49078 | 4.21119 |
| 0.400 | | | | | 7.16246 | 6.51720 | 5.97921 | 5.52131 | 5.12911 | 4.79882 | 4.49078 |
| 0.416 | | | | | 7.44580 | 6.77551 | 6.21550 | 5.74071 | 5.33312 | 4.97943 | 4.66963 |
| 0.423 | | | | | 7.56965 | 6.88844 | 6.31925 | 5.83665 | 5.42232 | 5.06278 | 4.74785 |
| 0.458 | | | | | 8.18780 | 7.45224 | 6.83736 | 6.31583 | 5.86797 | 5.47924 | 5.13868 |
| 0.477 | | | | | 8.52258 | 7.75770 | 7.11815 | 6.57559 | 6.10959 | 5.70507 | 5.35064 |
| 0.510 | | | | | | | | | | | 5.71844 |

PROJECTILE WITH ENHANCED BALLISTICS

CROSS REFERENCE TO RELATED APPLICATIONS

This application is a Divisional application of U.S. patent application Ser. No. 15/651,997 filed on Jul. 17, 2017, entitled "Projectile with Enhanced Ballistics," which is a Divisional application of U.S. patent application Ser. No. 14/701,519 filed on Apr. 30, 2015, now U.S. Pat. No. 9,709,368, entitled "Projectile with Enhanced Ballistics," which claims the benefit of priority from U.S. Provisional Patent Application Ser. No. 61/986,296, filed Apr. 30, 2014, entitled "Projectile with Enhanced Ballistics," and U.S. Provisional Patent Application Ser. No. 62/145,814, filed Apr. 10, 2015, entitled "Projectile with Enhanced Ballistics," the entire disclosures of which are hereby expressly incorporated by reference in their entireties.

FIELD OF THE INVENTION

Embodiments of the present invention are generally related to a projectile device and a method of manufacture of the same and in particular to a pistol bullet and a rifle bullet and method of manufacture of the same.

BACKGROUND OF THE INVENTION

Conventional projectiles, such as bullets, typically comprise a smooth uniform shank or body portion and an axially-symmetrical front or nose portion. Bullet performance is traditionally assessed with respect to parameters including velocity, ballistic coefficient (BC), trajectory, accuracy, and target penetration. Conventional bullets, after leaving the barrel and once under unpowered free-flight, substantially degrade in flight characteristics. For example, conventional bullets begin to wobble during flight, thereby losing accuracy and velocity. Upon striking a target, such reduced velocity and wobbling limits target penetration.

Various efforts have been made to improve projectile performance and/or enable additional projectile features. For example, U.S. Pat. No. 4,829,904 to Sullivan ("Sullivan") issued May 16, 1989, discloses a substantially full bore diameter bullet that has a plurality of elongated grooves either helically formed or parallel with the longitudinal axis of the bullet and a sabot, which has a body and fingers that engage with the grooves and seal the bullet in a casing. The sabot is configured with a slightly larger diameter than the bullet such that the sabot is engraved by the rifling slots in the barrel through which the round is fired, imparting a rotation to the bullet. In alternative embodiments the grooves contain elongated elements or a plurality of spherical elements to prevent the conically tapered slug or bullet from tilting or cocking in the barrel after firing. However, Sullivan fails to teach several novel features of the present invention, including a projectile design that retains if not enhances the spin of a projectile in flight, so as to achieve flatter and faster external ballistics and further yield improved target penetration. Sullivan is incorporated herein by reference in its entirety.

U.S. Pat. No. 6,439,125 to Carter ("Carter") issued Aug. 27, 2002, relates to a bullet having a tapered nose and a cylindrical base. The base is provided with an annular groove having a diameter less than the bore diameter of the barrel of the gun to reduce the force required to move the bullet through the barrel, thereby increasing the muzzle velocity and kinetic energy of the bullet. However, Carter fails to teach several novel features of the present invention, including a projectile design that retains if not enhances the spin of a projectile in flight, to achieve flatter and faster external ballistics and further yield improved target penetration. Carter is incorporated herein by reference in its entirety.

U.S. Pat. No. 6,581,522 to Julien et al., ("Julien") issued Jun. 24, 2003, discloses a projectile comprising a cylindrical body of Type 55 Nitinol material that has a soft martensitic state that is readily deformed by rifling in the bore of a gun barrel to form grooves which ride on the rifling to spin the projectile. The Nitinol material has a low coefficient of friction with the steel barrel and is sufficiently strong to prevent shedding projectile material in the bore. On impact with the target, the Nitinol material undergoes a strain-induced shift to an ultra-high strength state in which the projectile is capable of remaining intact and concentrating its full energy on the small area of contact for maximal penetration and damage to the target. In contrast, a conventional bullet typically mushrooms widely and spreads its energy over a side area. Projectiles in the form of bullets, shotgun slugs, penetrating warheads, caseless ammunition, and artillery shells are described. However, Julien fails to teach several novel features of the present invention, including a projectile design that retains if not enhances the spin of a projectile in flight, to achieve flatter and faster external ballistics and further yield improved target penetration. Julien is incorporated herein by reference in its entirety.

U.S. Patent Application Publication No. 2006/0027128 to Hober ("Hober") published Feb. 9, 2006, discloses a projectile for small munitions comprising a bullet with an integral housing formed from a resilient, shape-retaining material. The projectile comprises a bullet having a tapered front section, a cylindrical middle section and a tapered end section. The middle section includes a recessed retaining portion over which the resilient housing is securely positioned or formed. The maximum diameter of the bullet is less than the primary bore diameter of the firearm barrel, and the outer diameter of the housing when positioned around the bullet is slightly greater than the primary bore diameter. Thus, rifling in the barrel scores the housing and not the bullet, and imparts spin to the housing during firing and hence to the bullet, which is integral therewith, achieving enhanced gas checking efficiency, accuracy and velocity. The integral housing remains on the bullet after firing and downrange to its ultimate destination. However, Hober fails to teach several novel features of the present invention, including a projectile design that retains if not enhances the spin of a projectile in flight, so as to achieve flatter and faster external ballistics and further yield improved target penetration. Hober is incorporated herein by reference in its entirety.

U.S. Pat. No. 5,116,224 to Kelsey, Jr. ("Kelsey I") issued on May 26, 1992 and U.S. Pat. No. 5,133,261 to Kelsey, Jr. ("Kelsey II") issued on Jul. 28, 1992 and disclose a small arms bullet having a truncated conical nose with radial rearwardly extending ribs. The ribs have a flat edge and form grooves between the ribs. The Kelsey I ribs are formed along a radial, whereas the Kelsey II ribs are curved. In both Kelsey I and Kelsey II, the ribs are engineered to form a flat planar structure defining a rib thickness. However, each of Kelsey I and Kelsey II fail to teach several novel features of the present invention, including a projectile design that retains if not enhances the spin of a projectile in flight, to achieve flatter and faster external ballistics and further yield improved target penetration. Both Kelsey I and Kelsey II are incorporated herein by reference in entirety.

U.S. Statutory Invention Registration No. H770 to Kline et al., ("Kline") discloses a tracer training bullet which can be assembled into a conventional cartridge case and fired in a conventional M2 machine gun. The bullet consists of a main body of relatively low strength material which is segmented so that, if not restrained, it will bend under the centrifugal rotational force imparted to the segments by the spinning action of the projectile when fired. The bending of the projectile segments away from their central axis is ordinarily prevented by a retainer in the form of a spider. The spider is made of a relatively low temperature melting material, preferably aluminum, having a given thermal mass. The burn of the tracer material during the flight of the bullet toward a target weakens the retainer to the point of rupture after the bullet has travelled a given distance toward a target position. After the target position is passed, the securement member is destroyed by the high temperature burning action and the segments of the projectile bend or flex apart. This destroys the aerodynamic characteristics of the bullet and reduces its maximum range beyond the target distance. However, Kline fails to teach several novel features of the present invention, including a projectile design that retains if not enhances the spin of a projectile in flight, so as to achieve flatter and faster external ballistics and further yield improved target penetration. Kline is incorporated herein by reference in its entirety.

Thus, there is a long-felt need for a projectile design, and method of making the same, that retains, enhances, or counters the spin of a projectile in flight, to achieve flatter and faster external ballistics and further yield improved target penetration, as provided in embodiments of the present invention. The projectile design of the present invention may be configured to create several embodiments, for example to include rifle embodiments and pistol embodiments.

SUMMARY OF THE INVENTION

What is needed is a projectile that does not substantially degrade in flight characteristics once leaving the gun barrel, so as to achieve flatter and faster external ballistics and further yield improved target penetration. The present invention solves these needs by providing a projectile that retains if not enhances the spin of a bullet in flight and, in some embodiments, provides a cutting edge to promote and enhance target penetration and/or expansion in soft targets.

It is one aspect of the present invention to provide a projectile device and a method of manufacture of a projectile device. In particular, a pistol bullet and a rifle bullet are provided, along with methods of manufacture of the same.

Another aspect of the present invention is to provide a projectile with improved accuracy and performance.

In general, a projectile with a non-congruent twist penetrates less into the target and the larger end mill cut penetrates less into the target. These projectiles create a cavitation and slow down in soft tissue. The advantages generally include the ease of manufacturing and the non-expanding bullet (i.e., no housing and cavities). Further, the projectile does not deflect in auto glass, it shoots through sheet metal and body armor using its cutting edges, and it creates a cavitation in tissue to help it slow down in the soft tissue. A congruent twist will increase the depth of the projectile's penetration in soft media. The shorter the distance the projectile travels in the target, the more energy is released in that short distance. Thus, a wider tissue area is affected in order to absorb the energy.

In one embodiment of the invention, a projectile with enhanced performance characteristics adapted for use with a firearm is disclosed, the projectile comprising: a cylindrical body portion having a predetermined diameter; a front nose section tapering from a forward most point of the projectile to the cylindrical body portion; and a rear tail section connected to the body opposite the front nose portion; and wherein the front nose portion comprises at least one twisting depression forming a trough at a predetermined angle oriented with respect to a longitudinal centerline of the projectile.

In one embodiment, a projectile device is disclosed comprising: a cylindrical body with a longitudinal axis and a first end and a second end which defines a first length therebetween; a nose integrally interconnected to the second end of said cylindrical portion and having a second length, said nose further comprising: a) a plurality of cutout portions originating proximate to an apex of said nose and having a predetermined angle with respect to the longitudinal axis of the cylindrical body; b) a non-distorted nose portion positioned between each of the cutout portions, and wherein the intersection of the plurality of cutout portions and each of the non-distorted nose portions form a distinct edge which extends proximate to the apex of the nose portion.

In another embodiment, a projectile with enhanced performance characteristics for use with a firearm is disclosed, the projectile comprising: a first end having a tip; a second end having a base, the second end opposite the first end; a cylindrical portion having a predetermined diameter, the cylindrical portion positioned between the first end and the second end; a nose portion tapering from the tip to the cylindrical portion, wherein the nose portion is integrally interconnected to the cylindrical portion at a first junction; a first depression forming a first trough extending from a portion of the projectile proximate the first junction proximate to the tip of the projectile, wherein a first centerline of the first depression is positioned at a first angle relative to a longitudinal centerline of the projectile, and wherein the first trough has a first radius of curvature; a second depression forming a second trough extending from the portion of the projectile proximate the first junction proximate to the tip of the projectile, wherein a second centerline of the second depression is positioned at a second angle relative to the longitudinal centerline of the projectile, and wherein the second trough has a second radius of curvature; a first remaining nose portion positioned between the first depression and the second depression, the first remaining nose portion having a substantially triangular shape and forming a first cutting edge proximate the tip; a third depression forming a third trough extending from the portion of the projectile proximate the first junction proximate to the tip of the projectile, wherein a third centerline of the third depression is positioned at a third angle relative to the longitudinal centerline of the projectile, and wherein the third trough has a third radius of curvature; a second remaining nose portion positioned between the second depression and the third depression, the second remaining nose portion having a substantially triangular shape and forming a second cutting edge proximate the tip; and a third remaining nose portion positioned between the first depression and the third depression, the third remaining nose portion having a substantially triangular shape and forming a third cutting edge proximate the tip.

In yet another embodiment, a projectile device is disclosed comprising: a cylindrical body with a longitudinal axis defined therethrough; a nose integrally interconnected to a forward end of the cylindrical body; an alternating pattern of arcuate shaped cutout portions extending from approximately the tip of the nose to the cylindrical body and non-distorted nose portions having a substantially triangular shape, the intersection defining a cutting edge which is oriented at a specific angle with respect to the longitudinal axis of the cylindrical body.

In some embodiments, further features comprise: wherein the non-distorted nose portion has a substantially triangular shape; wherein the plurality of cutout portions has a length of approximately the nose second length; three distinct cutting edges formed at the intersection of the cutout portions; wherein the cutout portions have either a right or a left twist with respect to the longitudinal axis of the projectile; wherein the metallic projectile comprises three twisting cutout portions and three non-distorted nose portions; wherein the first length of the cylindrical portion is greater than the second length of the nose; wherein the projectile is made of a metallic material; wherein the metallic projectile has a caliber of at least one of .380 inch, 9 mm, .40 inch, and .45 inch and is adapted for use with a handgun; wherein the projectile is comprised of at least one of lead, copper, steel, magnesium, titanium, and other alloy; a second cutting edge formed at the intersection of the first depression and second depression and the second depression and third depression, and positioned above the first cutting edge; a second cutting edge defined by the intersection if each cutout portion above the non-distorted nose portion and extending upwardly to the apex of the nose; and wherein there are three distinct cutout portions and three distinct non-distorted nose portions.

The term "projectile" and variations thereof, as used herein, refers to any object projected into space by the exertion of a force, to include bullets, bombs, and rockets.

The term "ballistics" and variations thereof, as used herein, refers to the physics of projecting a projectile into space, to include the range and accuracy of projectiles and the effects of projectiles upon impact with an object.

The term "ballistics coefficient (BC)" and variations thereof, as used herein, refers to the ability of a projectile to overcome air resistance in flight; a high number indicates a greater ability to overcome air resistance.

The term "internal ballistics" and variations thereof, as used herein, refers to the behavior and effects of a projectile from propellant ignition to exit from a gun barrel.

The term "external ballistics" and variations thereof, as used herein, refers to the behavior and effects of a projectile from leaving a gun barrel until striking a target.

The term "terminal ballistics" and variations thereof, as used herein, refers to the behavior and effects of a projectile when it hits a target.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claims set forth herein, taken in conjunction with this Summary of the Invention, define the invention.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1A:
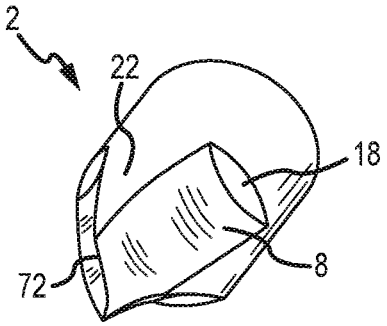
FIGS. 1A-E show a projectile according to a first embodiment of the invention.

To assist in the understanding of the embodiments of the present invention, the following list of components and associated numbering found in the drawings is provided herein.

NO. COMPONENT

2 Projectile
4 Tip or Apex
6 Nose Portion (or Front Portion)
8 Nose Depression (or Cutout or Trough)
10 Centerline of Nose Depression
12 Ogive
14 Secant Ogive
16 Tangent Ogive
18 Shoulder
20 Cylindrical Portion (i.e., Shank)
22 Nose Remaining Portion (or Non-Distorted Portion or Uncut Portion; i.e., portion between nose depressions)
24 Cavity
26 Driving Band
26A Angled Driving Band
28 Relief Cut
28A Angled (or Curved) Relief Cut
30 Base
32 Linear Portion
34 Tail Depression
36 Centerline of Tail Depression
38 Boat Tail
40 Housing
42 Insert
42A First Insert
42B Second Insert
42C Third Insert
44 Longitudinal Axis (of Projectile, Insert, or Housing)
46 Tail Remaining Portion (or Non-Distorted Portion or Uncut Portion; i.e., portion between tail depressions)
48 Arrowhead (of Insert)
50 Stem (of Insert)
52 Lower Portion or Underside (of Arrowhead)
54 Lower Portion or Underside (of Stem)
56 Front (of Housing)
58 Receiving Portion (of Housing)
60 Rifling Marks
62 Pealed Portion (of Housing)
64 Rolled Portion (of Housing)
66 First Nose Portion (or Front Nose Portion)
68 Second Nose Portion (or Rear Nose Portion)
70 Rear Edge (of Housing)
72 Cutter Edge
92 Edge (of Nose Depression)
$\alpha$ Alpha Angle, Angle of Nose Depression
$\beta$ Beta Angle
$\Delta$ Delta Angle, Tail Depression Angle
$\theta$ Theta Angle, Boat Tail Angle
$\gamma$ Gamma Angle, Angle between Angled Driving Band and Angled Relief Cut
$\sigma$ a Sigma Angle, Angle between Drive Band and Relief Cut
D1 Cylindrical Portion Diameter (i.e., Caliber)
D2 Diameter of Relief Cut
D3 Diameter of Drive Band
D4 Diameter of Insert Stem
D5 Diameter of Arrowhead of Insert
L1 Length of Projectile
L2 Length of Nose Portion
L3 Length of Cylindrical Portion
L4 Length of Boat Tail
L5 Length of Housing
L6 Length of Insert
L6A Length of First Insert
L6B Length of Second Insert
L6C Length of Third Insert
L7 Length of Broach-type Cut
L8 Length of First Nose Portion/Length of Nose (of Insert)
L9 Length of Linear Portion
L10 Length of Second Nose Portion
W1 Width of Broach-type Cut
R1 Radius of Curvature of Ogive
R2 Radius of Curvature of Tangent Ogive
R3 Radius of Curvature of Secant Ogive
R4 Radius of Curvature of Nose Depression
R5 Radius of Curvature of Tail Depression
R6 Radius of Curvature of Relief Cut
R7 Radius of Curvature of Tip
R8 Radius of Curvature between Boat Tail and Base It should be understood that the drawings are not necessarily to scale, and various dimensions may be altered. However, drawings that are to scale, are so marked or otherwise indicated. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The accompanying drawings, which are incorporated in and constitute a part of the specification, illustrate embodiments of the invention and together with the general description of the invention given above, and the detailed description of the drawings given below, serve to explain the principals of this invention.

The attached drawings are generally to scale, although there may be certain exceptions. In certain instances, details that are not necessary for an understanding of the invention or that render other details difficult to perceive may have been omitted. It should be understood, of course, that the invention is not necessarily limited to the particular embodiments illustrated herein or specific dimensions.

Embodiments of pistol and rifle projectiles are provided herein. Some embodiments comprise three or more angled cuts or depressions and are manufactured with a circular or a flat cutter. The depressions or cuts are in part defined by multiple angles. The first angle of the depressions or cuts is the alpha angle, which can, in some embodiments, determine the sharpness of the tip and cutter edges and is best viewed from a side elevation view. The alpha angle can also control the depth of penetration of the projectile in its target and the amount of media the projectile will cast off during penetration. A steeper alpha angle will result in deeper penetration and a blunter alpha angle will create a wider wound path. In a preferred embodiment, the alpha angle is between 2 degrees and about 45 degrees; in a more preferred embodiment the alpha angle range is between about 5 and 30 degrees. In some embodiments, this angle is not constant.

Projectiles have been tested with increasing bluntness (i.e., a curve) and resulted in massive terminal ballistics trajectories. The beginning angle was nearly 0 degrees and the end angle was nearly 45 degrees off of centerline. This embodiment was manufactured by running a ball end mill at an angle (which can be the alpha angle) relative to the centerline of the projectile. The size of the cutter varies by caliber, projectile weight, and desired performance characteristics. In some embodiments, the radius of the cutter is roughly one caliber; a cutter smaller than one caliber will result in deeper troughs and sharper ridges.

The beta angle is the amount that the cut is off from a radius line as viewed from the front of the projectile. The beta angle and the alpha angle will determine the spin or rate of twist of the projectile during penetration. Typically, pistol barrel twist rates vary more than rifle barrel twist rates by manufacturer or brand. A barrel twist rate is expressed as one turn per a number of inches of barrel; a 1:10 or "1 in 10 inches" barrel twist means a bullet makes one rotation or twist while traveling 10 inches in a gun barrel. To obtain the greatest penetration possible, the alpha angle matches or exceeds the barrel rate of twist and is in the same direction. This allows the projectile to corkscrew or drill into the media. For most embodiments, the alpha angle is between about 7 to 15 degrees in a right-hand twist and alternating 4-25 degrees. In another embodiment, if a design objective is to have a pistol bullet that penetrates armor and then stops in tissue, the alpha angle will be in the opposite direction of the barrel twist (this condition is also referred to as a "reversed angle to twist rate" or "reversing the barrel twist rate"). From testing, the congruency of barrel twist rate has little effect on penetrating sheet metal, Kevlar, glass, and other hard surfaces. When the barrel twist rate is in the opposite direction as the alpha angle, it has a substantial effect on the depth of penetration in soft media. A reversed angle to barrel twist rate results in permanent wound channels with secondary wounds. A secondary wound is where an object, such as a bone, in the terminal media is cast off the projectile and creates a new wound path.

There are two basic embodiments of pistol projectiles: a two-piece projectile (which may be called a jacketed projectile) and non-jacketed projectile. The non-jacketed embodiment is not intended to change shape during terminal ballistics and has the deepest and straightest penetration. Reversing the barrel twist rate (i.e., an alpha angle in the opposite direction to the barrel twist rate) results in less penetration and greater destruction but not to the same degree as the two-piece projectile. However, typically only pistol projectiles have reversed twist rates because rifle projectiles tend to be unstable with a reversed twist rate. But, one embodiment includes a rifle projectile with a reversed twist rate. Some embodiments have a zero alpha angle and the projectile still displays the characteristics of penetrating hard surfaces and woven material well. FIGS. 1-2, 12, 20-23, and 25-31 present non-jacketed pistol projectile embodiments.

FIGS. 3-11, 13-19, 24, and 32-40 present rifle projectile embodiments.

FIGS. 3-11, 13-19, 24, and 32-40 are scaled drawings of projectile embodiments. Intended users include big game hunters and long range target shooters. Among other things, these embodiments provide deep, straight penetration with transfer of energy. These embodiments may be manufactured of materials comprising brass, copper, lead, tungsten-carbide, and alloys associated therewith.

The fronts of various embodiments of projectiles are made up of several cuts that form troughs and ridges. The number of ridges may be equal to the number of lands and grooves in a barrel. Generally, the number of ridges should equal the number of lands and grooves in the barrel or be a multiple thereof.

In the rifle projectiles, the twist rate of the ridges will likely correlate to or be greater than the rate of twist in the barrel although by no more than 1-2 degrees. In one preferred embodiment, the twist rate on the front of the projectile varies from 2-16 degrees; in a more preferred embodiment the twist rate on the front of the projectile varies between 4-12 degrees, depending on the rifle barrel's twist rate.

The barrel degree of twist may be referenced as a rate of twist such as 1 revolution in X amount of inches (e.g., 1 in 8" twist rate). The fins at the back of the rifle projectile correspond to—but are not necessarily in line with—the twist rate of the ridges at the front of the projectile. The design of the rifle projectile affects the flight of the projectile (external ballistics) and further affects the time in the barrel (internal ballistics). The depth and length of the twisting depressions, in some embodiments, is not as critical as the rate of twist. The twisting elements cannot extend through the center section or shaft of the projectile. Deeper twisting elements will create sharper ridges between the twisting depressions. The diameter of the trough will change with the caliber of the projectile. These twisting depressions will not only twist around the projectile, but will follow the convex shape of the front of the projectile. In some embodiments, the twist rate is approximately a 7 degree right-hand twist rate, corresponding to a 1-in-8 rate of twist.

When looking at a rifle projectile from a side elevation view, the curve from the tip to the elongated side wall of the cartridge is called the ogive, divided generally into three parts: the tip, the secant ogive and tangent ogive. As bullets are scalable, one refers to the sizes in calibers. Caliber is the diameter of the shaft. The entire ogive of the projectile may be greater in length than the length of two calibers and in other embodiments may be greater than the length of three calibers. This length will be determined by the maximum case length subtracted from the case overall length ("COL"). The COL is typically determined by the internal length of the magazine, but is sometimes limited by the throat of the chamber where the lands and the grooves disappear into the chamber.

As mentioned, the ogive is broken into three distinct parts. The tip is made of a cone with a non-curved profile and extends back for approximately the length of a half caliber or less. The tip is blended into a secant ogive that comprises the majority of the entire ogive. The secant ogive is based on a circle with a radius of approximately 8 times the caliber. There are grooves that run the length of the secant ogive and these grooves match identically the pitch and number of the lands and grooves of the rifling in the barrel. Typically, the secant ogive will be approximately two calibers in length depending on the intended rifle and chambering. These grooves that cut at a 7 to 8 degree angle through the secant ogive in many embodiments, are congruent with the rifling and are produced with a ball end mill and have smooth entrance and exit points. In the center of the secant ogive, the ball cut is at its deepest and forms a ridge with the cuts on either side running parallel to one another. The diameter of the cutter is approximately one third of a caliber. This sharp ridge runs the majority of the secant ogive and is intended to maintain the spin of the projectile in flight and aid in penetration during terminal ballistics. The last portion of the ogive, approximately half of a caliber in length, is comprised of a tangent ogive. The tangent ogive is the curve of a circle with a radius of approximately four calibers. The grooves cut in the secant ogive dissipate before the secant ogive's junction with the tangent ogive, thus ensuring that the grooves will never interact with the rifling, which would create a variable with the free bore portion of the projectile path during firing.

The shaft of the projectile will now be described. The shaft is the cylindrical center section that interfaces with the barrel and the case neck. The proportional length varies with desired weight and is composed of driving bands (i.e., ridges) and relief cuts (i.e., troughs). The junction of these surfaces is angular and smoothed to minimize interaction with the atmosphere during exterior ballistics. The depth of the relief cut is just beyond the inner dimension of the lands. There is a minimal number of driving bands, located at the front and back of the shaft with at least one more in the center section near the end of the case neck near the junction of the case's shoulder and neck. The relief cuts will lower the total friction in the barrel during internal ballistics.

The tail section of the bullet may include many geometric shapes, including a boat tail. The boat tail reduces diameter from the shaft in a cone shape at a 7.5 degree angle. In one embodiment, the boat tail is about .7 of a caliber in length. The boat tail can also extend, at the 7.5 degree reduction, to a point making it over two times a given caliber in length. This section may be grooved with a mill. These tail twisting depressions also run congruent with the pitch of the rifling. In a preferred embodiment, the tail twisting depressions are cut to between a 2-15 degree right-hand twist. In a more preferred embodiment, the tail twisting depressions are cut to between a 4-10 degree right-hand twist. In a most preferred embodiment, the tail twisting depressions are cut at a 7 to 8 degree right-hand twist. In one embodiment, the tail twisting depressions are cut at either a 7 or an 8 degree right-hand twist. In another embodiment, the tail twisting depressions are cut with a left-hand twist. These tail twisting depressions line up with the twisting depressions on the secant ogive, if extended. At the back of the boat tail, the tail twisting depressions come together and form sharp ridges that direct the atmosphere and maintain the projectile's flight. The tail twisting depressions end abruptly, shortly before the junction with the shaft.

The aforementioned tail twisting depressions provide interaction with the rapidly expanding propellant and help to twist the projectile through the rifling, thus greatly reducing friction with the barrel. These reductions in friction produce significantly higher than normal muzzle velocities and allow the barrel to heat at a significantly lower rate. The boat tails that extend all the way to a point may eliminate or reduce the audible supersonic crack of the bullet in flight. The twisting depressions at the front in combination with the tail twisting depressions at the back may reduce the rotational friction with the atmosphere and eliminate the whistle associated with the flight of a bullet. The twisting depressions (front and back) may also maintain the rate of twist during external ballistics, which may reduce the long range deterioration of accuracy.

The two-piece projectile embodiments are comprised of two parts: the housing and the insert. The housing is a cup that holds the insert and forms the bearing surface with the barrel. The housings may be formed by a lathe or swaging process and out of a material suitable for interaction with a barrel (brass or copper, for example). In some embodiments, the leading edge of the housing will intersect with the trailing edge of the ridge on the insert. In various embodiments, the troughs of the insert protrude below the mouth of the housing and into the cavity of the housing. This is an important feature because these troughs are the mechanism that transfer the media into the housing and initiate the deformation or opening of the housing. This process will increase the wound channel and limit the penetration depth. When the barrel twist rate is the opposite (or "reverse") of the alpha angle, the process just described becomes exponentially more rapid and therefore the wound channel increases laterally but penetration is limited and controlled. The housing is in contact with the insert at the housing mouth and the portion at the back designed to hold the insert. The insert can be chemically bonded to the housing at the back or lower surface of the insert in some embodiments. In other embodiments, the insert is compression fit into the housing. There is generally a void or receiving portion through the center section of the housing. This void aids in the uniform deformation of the housing and aids the housing to open unilaterally. The material for the insert is made from, but not limited to, steel, aluminum, brass, and polymers. FIGS. 2, 10, 12-16, 18, 20, 24-31, 33-36, and 38 are embodiments of two-piece projectiles.

Referring to FIGS. 1A-2C, which are pistol projectile embodiments that, among other things, provide deep straight penetration. These projectiles 2 are different from the prior art because they can pierce armor and stop in soft tissue. The sharp tip 4 and sharp cutter edges 72 allow these projectiles 2 to cut through armor, including Kevlar. Additionally, the shoulders 18 of the projectile 2 enable the projectile 2 to stop in soft tissue because the shoulders slow the projectile 2 down once it hits soft tissue. Further, these projectiles 2 create a lot of cavitation in soft tissue, thus making a wound larger than it would be with a projectile of the prior art. Intended users of these projectiles comprise military and law enforcement.

The construction of these projectiles may be accomplished using a press or mill and lathe. One unique and innovative feature is the shape of the front of the projectile 2, which has a slight radius coming off the bearing surface (the cylindrical portion 20 or the shaft) but is largely formed by angled or slightly twisting depressions 8 pointed to the front. The depressions 8 form troughs and ridges (and remaining portions 22 between the depressions) that possess an angle or a slight radius off the centerline 44 (longitudinal axis) of the projectile 2. In some embodiments, the twist angle of the depressions 8 corresponds to (i.e., is equal to) or is greater than the barrel twist rate (i.e., the twist rate of the rifling in the barrel) and turns in the same direction as the barrel's rifling. In other embodiments, the twist angle of the depressions 8 is equal to or greater than the barrel twist rate and turns in the opposite direction as the barrel's rifling. These depressions 8 do not affect the projectile during internal ballistics but they greatly enhance the performance during external and/or terminal ballistics. In some embodiments, at the center of the tip 4 or a portion of the nose 6 proximate the tip 4, the ridges 8 meet to form a cutting surface or cutting edge 72. These edges 72 initiate a cut in the target, greatly reducing resistance through media such as sheet metal, fabrics, and soft armor. The twisting troughs 8 move media away from the projectile 2 further reducing resistance and promoting and maintaining the spin to ensure the projectile 2 penetrates deep and straight. The troughs 8 may rapidly move liquids and soft tissue away from the path of the projectile and therefore increase the wound channel.

In one embodiment of the pistol projectile, terminal ballistics traits are emphasized. The tip 4 of the projectile 2 is formed such that the trough 8 is at an angle (alpha or a) relative to the longitudinal axis 44 of the projectile. Due to magazine and chamber constraints, projectiles have a maximum length. The density of the material will determine this alpha angle because a steeper alpha angle cuts better, but has a lower weight. The steeper alpha angle will also transfer media at a greater rate into the housing for a faster opening and expansion upon impact with the terminal media for the two-piece projectiles. In some embodiments, the twist rate of the ridges can equal to or exceeds, by up to double, the twist rate of the barrel. In one embodiment, the projectile would increase the rate of twist once it struck the terminal media. In one embodiment, an insert with a counter twist to (i.e., in the opposite direction of) the rifling is provided, therefore limiting penetration once the projectile cuts through the outer layer of its target. The twist rate in the insert may also be reversed (i.e., in the opposite direction to the barrel twist). Twist rates in most handguns, run from 4-7 degrees, but could be between 2-10 degrees.

Figure 1B:
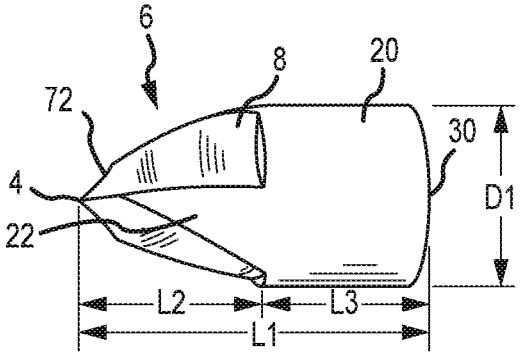
Figure 1C:
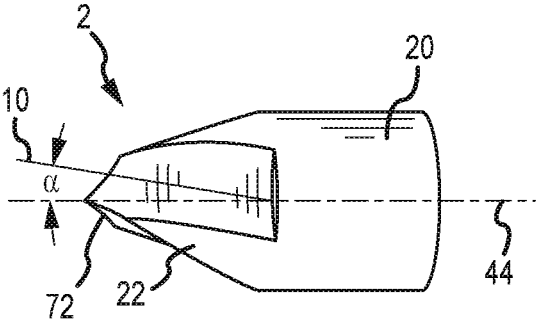
Figure 1D:
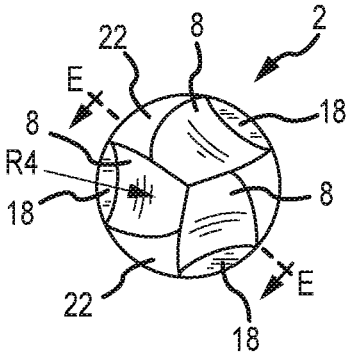
Figure 1E:
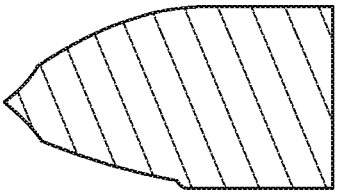

FIGS. 1A-E show a projectile 2 according to a first embodiment. FIG. 1A is a perspective view of the projectile 2. FIG. 1B is a side elevation view of the projectile 2. FIG. 1C is another side elevation view of the projectile 2. FIG. 1D is a top plan view of the projectile 2. FIG. 1E is a cross-sectional view of the projectile 2 taken along cut E-E of FIG. 1D. Note that FIGS. 1A-C are to scale.

The projectile 2 is for pistols and comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and nose remaining portions 22 (also called non-distorted portions or uncut portions) between two nose depressions 8. The remaining portions 22 are the uncut portions having the projectile's original ogive. The remaining portions 22 have a generally triangular shape with the tip of the triangle positioned proximate to the tip 4 of the projectile and the base of the triangle positioned proximate to the rear of the nose 6 and the forward portion of the cylindrical portion 20. A first edge is formed between a nose depression 8 and a remaining portion 22 and a second edge proximate the tip 4 is formed between two nose depressions 8. The first edge and/or the second edge may be referred to as a cutter edge 72 in some embodiments. The nose depressions 8 terminate in a substantially flat shoulder 18 proximate to the junction between the nose portion 6 and the cylindrical portion 20. The nose depressions 8 have a curved shape meaning that the trough or bottom surface of the nose depression 8 is curved and has a radius of curvature R4. In one embodiment, the nose depressions are cut using a ⅜ inch flat end mill.

The longitudinal axis 44 of the projectile 2 is shown in FIG. 1C. Accordingly, the angle α of the nose depressions 8 can be measured relative to the longitudinal axis 44 and the centerline 10 of the nose depression 8. In some embodiments, the angle α is measured relative to the original ogive of the projectile nose portion 6. Alternatively, the orientation of the depressions 8 or cutout portions can be oriented or measured with respect to the ogive of the remaining portion. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. Further, when looking at the projectile from a top plan view (FIG. 1D), the nose depressions 8 appear to turn in a counter-clockwise direction. In one embodiment, the projectile 2 has at least three nose depressions 8. However, the projectile 2 can have more or fewer nose depressions 8.

In one embodiment, the radius of curvature R4 of the nose depressions 8 is between about 1/16 inches and about 0.750 inches. In a preferred embodiment, the radius of curvature R4 of the nose depressions 8 is between about 3/32 inches and about ⅜ inches. In a more preferred embodiment, the radius of curvature R4 of the nose depressions 8 is about 0.1875 inches. In one embodiment, the length L1 of the projectile 2 is between about 0.400 inches and about 0.900 inches. In a preferred embodiment, the length L1 of the projectile 2 is between about 0.550 inches and about 0.750 inches. In a more preferred embodiment, the length L1 of the projectile 2 is about 0.643 inches. In one embodiment, the length L2 of the nose portion 6 is between about 0.150 inches and about 0.500 inches. In a preferred embodiment, the length L2 of the nose portion 6 is between about 0.250 inches and about 0.400 inches. In a more preferred embodiment, the length L2 of the nose portion 6 is about 0.343 inches. In one embodiment, the length L3 of the cylindrical portion 20 is between about 0.100 inches and about 0.500 inches. In a preferred embodiment, the length L3 of the cylindrical portion 20 is between about 0.200 inches and about 0.400 inches. In a more preferred embodiment, the length L3 of the cylindrical portion 20 is about 0.300 inches. The diameter D1 of the projectile 2 (also called the caliber) varies according to the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 35 degrees. In a preferred embodiment, the angle α of the nose depressions 8 is between about 15 degrees and about 25 degrees. In a more preferred embodiment, the angle α of the nose depressions 8 is about 20 degrees.

Figure 2A:
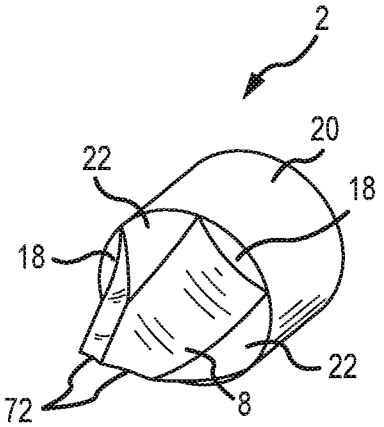
FIGS. 2A-C show a projectile according to a second embodiment of the invention.
Figure 2B:
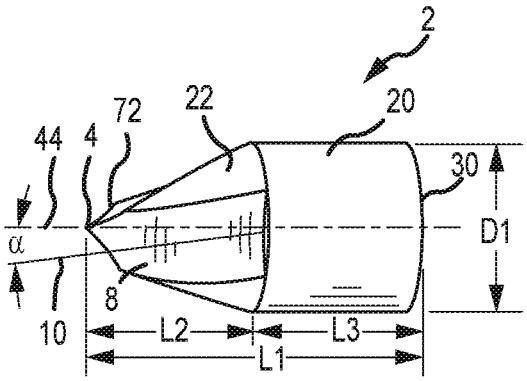
Figure 2C:
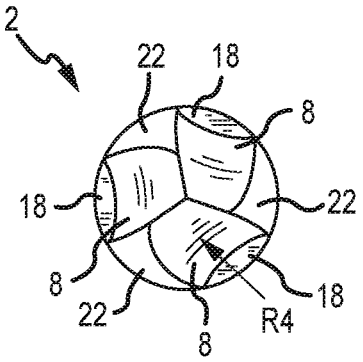

FIGS. 2A-C show a projectile according to a second embodiment of the invention. This projectile is similar to the projectile of FIG. 1, except that this projectile 2 is two pieces: a nose portion 6 insert that is compression fit into a cylindrical portion 20 housing. Each piece may be a different material in one embodiment. For example, the nose portion 6 insert is made of steel and the cylindrical portion 20 housing is made of brass. However, the projectile 2 can be made of any projectile or bullet material, such as any metal alloy, brass, steel, tungsten, polymers, ceramics, aluminum, Inconel, or any other material known in the art. FIG. 2A is a perspective view of the projectile 2. FIG. 2B is a side elevation view of the projectile 2. FIG. 2C is a top plan view of the projectile 2. Note that FIGS. 2A-C are to scale.

The projectile 2 comprises a tip 4 on one end opposite a base 30 on the other end. The projectile 2 comprises a nose portion 6 and a cylindrical portion 20. The nose portion 6 includes nose depressions 8 and nose remaining portions 22 between the nose depressions 8. The remaining portions 22 are the uncut portions having the projectile's original ogive. The remaining portions 22 have a generally triangular shape with the tip of the triangle positioned proximate to the tip 4 of the projectile 2 and the base of the triangle positioned proximate to the rear of the nose 6 and the forward portion of the cylindrical portion 20. A first edge is formed between a nose depression 8 and a remaining portion 22 and a second edge proximate the tip 4 is formed between two nose depressions 8. The first edge and/or the second edge may be referred to as a cutter edge 72 in some embodiments. The nose depressions 8 terminate in a substantially flat shoulder 18. The nose depressions 8 have a curved shape meaning that the trough or bottom of the nose depression 8 is curved and has a radius of curvature R4. In one embodiment, the nose depressions are cut using a ⅜ inch flat end mill.

The longitudinal axis 44 of the projectile 2 is shown in FIG. 2B. Accordingly, the angle α of the nose depressions 8 can be measured relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are left-hand nose depressions 8 because the angle α is positioned to the left of the longitudinal axis 44. Further, when looking at the projectile from a top plan view (FIG. 2C), the nose depressions 8 appear to turn in a clockwise direction. In one embodiment, the projectile 2 has at least three nose depressions 8. However, the projectile 2 can have more or fewer nose depressions 8.

In one embodiment, the radius of curvature R4 of the nose depressions 8 is between about 1/16 inches and about 0.750 inches. In a preferred embodiment, the radius of curvature R4 of the nose depressions 8 is between about 3/32 inches and about ⅜ inches. In a more preferred embodiment, the radius of curvature R4 of the nose depressions 8 is about 0.1875 inches. In one embodiment, the length L1 of the projectile 2 is between about 0.400 inches and about 0.900 inches. In a preferred embodiment, the length L1 of the projectile 2 is between about 0.550 inches and about 0.750 inches. In a more preferred embodiment, the length L1 of the projectile 2 is about 0.643 inches. In one embodiment, the length L2 of the nose portion 6 is between about 0.150 inches and about 0.500 inches. In a preferred embodiment, the length L2 of the nose portion 6 is between about 0.250 inches and about 0.400 inches. In a more preferred embodiment, the length L2 of the nose portion 6 is about 0.343 inches. In one embodiment, the length L3 of the cylindrical portion 20 is between about 0.100 inches and about 0.500 inches. In a preferred embodiment, the length L3 of the cylindrical portion 20 is between about 0.200 inches and about 0.400 inches. In a more preferred embodiment, the length L3 of the cylindrical portion 20 is about 0.300 inches. The diameter D1 of the projectile 2 (also called the caliber) varies according to the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 35 degrees. In a preferred embodiment, the angle α of the nose depressions 8 is between about 15 degrees and about 25 degrees. In a more preferred embodiment, the angle α of the nose depressions 8 is about 20 degrees.

FIGS. 3A-11F are projectiles with unique and novel tail geometries. Some embodiments of the present invention include tail depressions 34 cut into the boat tail 38 of the projectile 2. The tail design is almost entirely for the internal ballistics of the projectile, i.e., while the projectile is in the gun barrel. The tail depressions 34 act like a propeller to make the projectile 2 rotate. If the projectile 2 is rotating at the same twist rate or a similar twist rate to the barrel's twist rate, then the projectile 2 will barely slow down when it hits the lands and grooves in the barrel. This reduces the pressure exerted on the barrel of the gun and reduces the wear on the barrel. Typically, if a gun barrel has four lands and grooves, then the projectile will have four tail depressions 34. The same is true for fewer or more lands and grooves, i.e., the number of lands and grooves typically equals the number of tail depressions 34. Additionally, the tail depressions 34 are defined by a delta angle Δ. In one embodiment, the delta angle Δ is congruent to or greater than the twist rate. Nominal twist rates will be between about 3.5 and 9.0 degrees. The delta angle Δ of the tail depressions 34 may exceed the twist rate by about 10.0 degrees. An optimal delta angle will be no more than about 1.5 degrees beyond the rate of twist angle. FIG. 9 has a boat tail 38 with depressions 34 that also help the projectile 2 perform better during terminal ballistics because the boat tail 38 with depressions 34 keeps the projectile 2 flying straight after it enters the soft tissue of an animal.

Figure 3A:
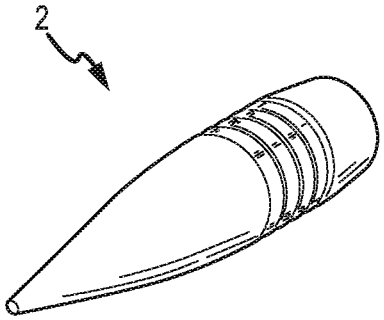
FIGS. 3A-E show a projectile according to a third embodiment of the invention.
Figure 3B:
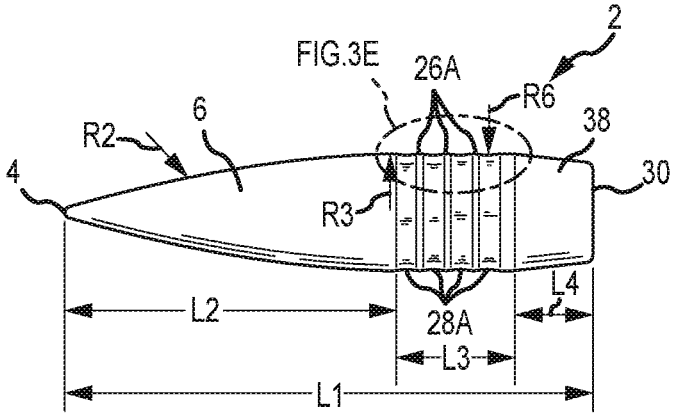
Figure 3C:
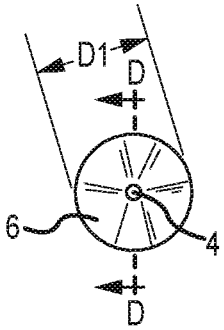
Figure 3D:
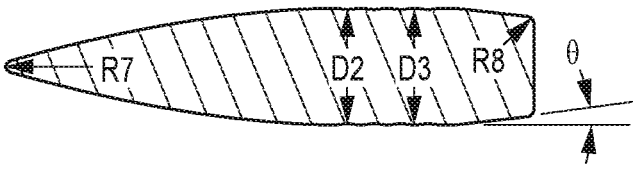
Figure 3E:
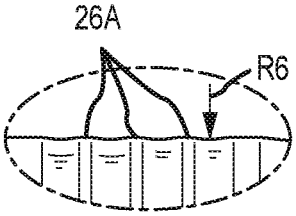

FIGS. 3A-E show a projectile 2 according to a third embodiment of the invention. FIG. 3A is a perspective view of the projectile 2. FIG. 3B is a side elevation view of the projectile 2. FIG. 3C is a top plan view of the projectile 2. FIG. 3D is a cross section of the projectile 2 taken along cut D-D in FIG. 3C. FIG. 3E is an enlarged view of a portion of the projectile 2 shown in FIG. 3B. Note that FIGS. 3A-3D are to scale.

The projectile 2 comprises a tip 4 on one end opposite a base 30 on the other end. The projectile 2 comprises a nose portion 6 proximate the tip 4 on one end and interconnected to a cylindrical portion 20 on the other end. The cylindrical portion 20 is interconnected to a boat tail 38 on the end opposite the nose. The boat tail 38 terminates in the base 30 with a radius of curvature R8 between the boat tail 38 and the base 30. In alternate embodiments, the driving bands 26A vary in number, comprising one driving band 26A, a plurality of driving bands 26A, two driving bands 26A, three driving bands 26A, and four or more driving bands 26A.

The cylindrical portion 20 can comprise multiple angled relief bands 28A and angled driving bands 26A. The driving bands 26A alternate with the relief bands 28A. The angles between the driving bands 26A and relief cuts 28A (relative to the horizontal) are between about 7 degrees and about 10 degrees. In one embodiment, angles between the driving bands 26A and relief cuts 28A (relative to the horizontal) are about 7.5 degrees. In another embodiment, angles between the driving bands 26A and relief cuts 28A (relative to the horizontal) are about 8.5 degrees. In one embodiment, the weight of the projectile is about 154 grams.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R7 of the tip 4 is between about 0.030 inches and about 0.005 inches. In a preferred embodiment, the radius of curvature R7 of the tip 4 is between about 0.020 inches and about 0.010 inches. In a more preferred embodiment, the radius of curvature R7 of the tip 4 is about 0.015 inches. In one embodiment, the radius of curvature R8 between the boat tail 38 and the base 30 is between about 0.035 inches and about 0.010 inches. In a preferred embodiment, the radius of curvature R8 between the boat tail 38 and the base 30 is between about 0.025 inches and about 0.015 inches. In a more preferred embodiment, the radius of curvature R8 between the boat tail 38 and the base 30 is about 0.020 inches.

In one embodiment, the length L1 of the projectile 2 is between about 1.25 inches and about 1.75 inches. In a preferred embodiment, the length L1 of the projectile 2 is between about 1.4 inches and about 1.5 inches. In a more preferred embodiment, the length L1 of the projectile 2 is about 1.435 inches. In one embodiment, the length L2 of the nose portion 6 is between about 0.50 inches and about 1.10 inches. In a preferred embodiment, the length L2 of the nose portion 6 is between about 0.75 inches and about 1.00 inch. In a more preferred embodiment, the length L2 of the nose portion 6 is about 0.8633 inches. In one embodiment, the length L3 of the cylindrical portion 20 is between about 0.25 inches and about 0.50 inches. In a preferred embodiment, the length L3 of the cylindrical portion 20 is between about 0.30 inches and about 0.40 inches. In a more preferred embodiment, the length L3 of the cylindrical portion 20 is about 0.322 inches. In one embodiment, the length L4 of the boat tail 38 is between about 0.10 inches and about 0.35 inches. In a preferred embodiment, the length L4 of the boat tail 38 is between about 0.15 inches and about 0.25 inches. In a more preferred embodiment, the length L4 of the boat tail 38 is about 0.215 inches. The diameter D1 of the projectile 2 (also called the caliber) varies according to the various embodiments. In one embodiment, the diameter D1 of the projectile 2 is between about 0.220 inches and about 0.450 inches. In a preferred embodiment, the diameter D1 of the projectile 2 is between about 0.290 inches and about 0.350 inches. In the embodiment shown, the diameter D1 of the projectile 2 is about 0.3080 inches. In one embodiment, the diameter D2 of the angled relief cut 28A is between about 0.20 inches and about 0.40 inches. In a preferred embodiment, the diameter D2 of the angled relief cut 28A is between about 0.25 inches and about 0.31 inches. In the embodiment shown, the diameter D2 of the angled relief cut 28A is about 0.298 inches. In one embodiment, the diameter D3 of the angled driving band 26A is between about 0.25 inches and about 0.32 inches. In a preferred embodiment, the diameter D3 of the angled driving band 26A is between about 0.30 inches and about 0.31 inches. In the embodiment shown, the diameter D3 of the angled driving band 26A is about 0.307 inches. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7 degrees.

In alternate embodiments, the projectile 2 can have nose depressions and/or tail depressions. This projectile 2 is different from the prior art because it can pierce armor and fly for an extended range. This projectile 2 is also capable of flying supersonic. The projectile 2 is extremely accurate even at long distances.

Figure 4A:
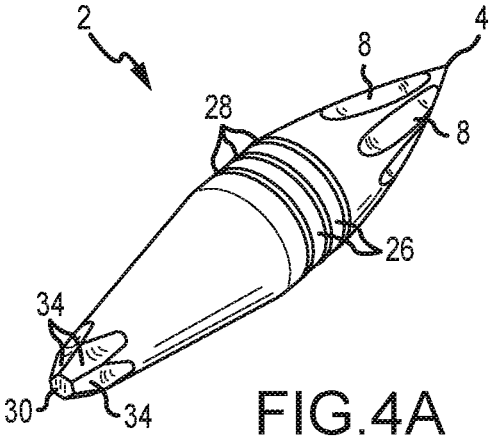
FIGS. 4A-C show a projectile according to a fourth embodiment of the invention.
Figure 4B:
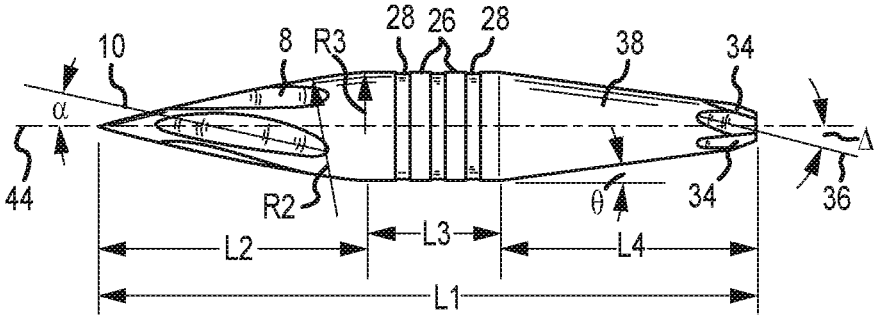
Figure 4C:
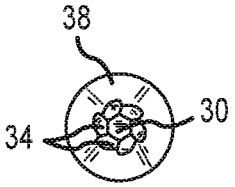

FIGS. 4A-C show a projectile according to a fourth embodiment of the invention. FIG. 4A is a bottom perspective view of the projectile 2. FIG. 4B is a side elevation view of the projectile 2. FIG. 4C is a bottom plan view of the projectile 2. Note that FIGS. 4A-C are to scale.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8. The remaining portions 22 are the uncut portions having the projectile's original ogive. The nose depressions 8 run from the tip 4 to a portion of the projectile 2 proximate the central portion 20. The nose depressions 8 have a curved shape meaning that the trough or bottom of the nose depression 8 is curved and has a radius of curvature R4. The boat tail 34 includes tail depressions 34 and tail remaining portions between the tail depressions 34. The remaining portions are the uncut portions. The tail depressions 34 run from the base 30 to a portion of the boat tail 38. The tail depressions 34 have a curved shape meaning that the trough or bottom of the tail depression 34 is curved and has a radius of curvature. In one embodiment, the nose depressions 8 are cut using a 3/16 inch to a 3/8 inch ball end mill and the tail depressions 34 are cut using a 1/8 inch ball end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same.

The longitudinal axis 44 of the projectile 2 is shown in FIG. 4B. Accordingly, the angle α of the nose depressions 8 can be measured relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. Accordingly, the angle Δ of the tail depressions 34 can be measured by measuring the angle of the tail depression centerline 36 relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles A. In the embodiment shown, the tail depressions 34 are right-hand tail depressions 34 because the angle Δ is positioned to the right of the longitudinal axis 44. Further, when looking at the projectile 2 from a bottom plan view (FIG. 4C), the tail depressions 34 appear to turn in a counterclockwise direction. In one embodiment, the projectile 2 has at least 6 tail depressions 34. However, the projectile 2 can have more or fewer tail depressions 34.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R4 of the nose depressions 8 is between about 0.05 inches and about 0.15 inches. In a preferred embodiment, the radius of curvature R4 of the nose depressions 8 is between about 0.75 inches and about 0.1 inches. In a more preferred embodiment, the radius of curvature R4 of the nose depressions 8 is about 0.09375 inches. In one embodiment, the radius of curvature of the tail depression 34 is between about 0.040 inches and about 0.080 inches. In a preferred embodiment, the radius of curvature of the tail depression 34 is between about 0.030 inches and about 0.050 inches. In a more preferred embodiment, the radius of curvature of the tail depression 34 is about 0.0625 inches. In one embodiment, the length L1 of the projectile 2 is between about 1.50 inches and about 2.75 inches. In a preferred embodiment, the length L1 of the projectile 2 is between about 2.0 inches and about 2.3 inches. In a more preferred embodiment, the length L1 of the projectile 2 is about 2.150 inches. In one embodiment, the length L2 of the nose portion 6 is between about 0.600 inches and about 1.00 inch. In a preferred embodiment, the length L2 of the nose portion 6 is between about 0.700 inches and about 0.900 inches. In a more preferred embodiment, the length L2 of the nose portion 6 is about 0.800 inches. In one embodiment, the length L3 of the cylindrical portion 20 is between about 0.20 inches and about 0.60 inches. In a preferred embodiment, the length L3 of the cylindrical portion 20 is between about 0.30 inches and about 0.50 inches. In a more preferred embodiment, the length L3 of the cylindrical portion 20 is about 0.400 inches. In one embodiment, the length L4 of the boat tail 38 is between about 0.50 inches and about 1.50 inches. In a preferred embodiment, the length L4 of the boat tail 38 is between about 0.75 inches and about 1.25 inches. In a more preferred embodiment, the length L4 of the boat tail 38 is about 0.950 inches. The diameter D1 of the projectile 2 (also called the caliber) varies according the various embodiments. In one embodiment, the diameter D1 of the projectile 2 is between about 0.220 inches and about 0.45 inches. In a preferred embodiment, the diameter D1 of the projectile 2 is between about 0.29 inches and about 0.32 inches. In the embodiment shown, the diameter D1 of the projectile 2 is about 0.308 inches. In one embodiment, the angle α of the nose depressions 8 is between about 2 degrees and about 10 degrees. In a preferred embodiment, the angle α of the nose depressions 8 is between about 4 degrees and about 7 degrees. In a more preferred embodiment, the angle α of the nose depressions 8 is about 5.5 degrees. In one embodiment, the angle Δ of the boat tail 38 is between about 5 degrees and about 10 degrees. In a preferred embodiment, the angle Δ of the boat tail 38 is between about 6 degrees and about 9 degrees. In a more preferred embodiment the angle Δ of the boat tail 38 is about 7.5 degrees.

This projectile 2 is different from the prior art because it can pierce armor and stop in soft tissue. The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 5A:
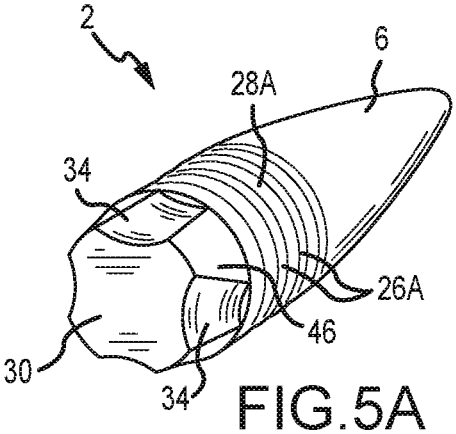
FIGS. 5A-C show a projectile according to a fifth embodiment of the invention.
Figure 5B:
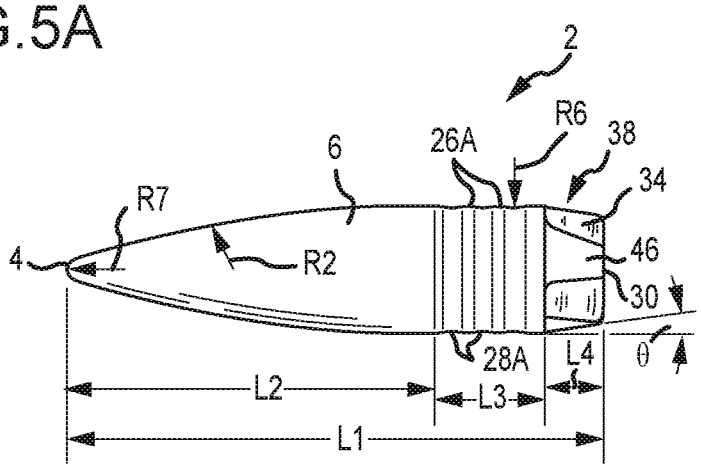
Figure 5C:
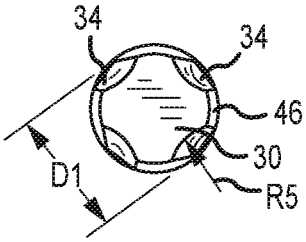

FIGS. 5A-C show a projectile according to a fifth embodiment of the invention. FIG. 5A is a bottom perspective view of the projectile 2. FIG. 5B is a side elevation view of the projectile 2. FIG. 5C is a bottom plan view of the projectile 2. Note that FIGS. 5A-C are to scale.

The projectile 2 comprises a tip 4 on one end opposite a base 30 on the other end. The projectile 2 comprises a nose portion 6, a cylindrical portion 20, and a boat tail 38. The boat tail 38 includes tail depressions 34 and tail remaining portions 46 between the tail depressions 34. The remaining portions 46 are the uncut portions. The tail depressions 34 run from the base 30 to a portion of the boat tail 38. The tail depressions 34 have a curved shape meaning that the trough or bottom of the tail depression 34 is curved and has a radius of curvature R5. In one embodiment, the tail depressions 34 are cut using a ⅜ inch flat end mill. The cylindrical portion 20 of the projectile can also comprise angled driving bands 26A and angled relief cuts 28A. Some embodiments have one or more angled driving bands 26A and angled relief cuts 28A. The widths of the angled driving bands 26A and angled relief cuts 28A can vary or they can all be the same. The angled driving bands 26A alternate with the angled relief cuts 28A. The angles between the driving bands 26A and relief cuts 28A (relative to the horizontal) are between about 7 degrees and about 10 degrees. In one embodiment, angles between the driving bands 26A and relief cuts 28A (relative to the horizontal) are about 7.5 degrees. In another embodiment, the angles between the driving bands 26A and relief cuts 28A (relative to the horizontal) are about 8.5 degrees.

The angle Δ of the centerline 36 of the tail depressions 34 can be measured relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles A. In the embodiment shown, the tail depressions 34 are right-hand tail depressions 34 because the angle Δ is positioned to the right of the longitudinal axis 44. Further, when looking at the projectile from a bottom plan view (FIG. 5C), the tail depressions 34 appear to turn in a counter-clockwise direction. In one embodiment, the projectile 2 has at least six tail depressions 34. In the embodiment shown, the projectile 2 has four tail depressions 34. However, the projectile 2 can have more or fewer tail depressions 34.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R7 of the tip 4 is between about 0.030 inches and about 0.005 inches. In a preferred embodiment, the radius of curvature R7 of the tip 4 is between about 0.020 inches and about 0.010 inches. In a more preferred embodiment, the radius of curvature R7 of the tip 4 is about 0.015 inches.

In one embodiment, the length L1 of the projectile 2 is between about 1.0 inch and about 1.6 inches. In a preferred embodiment, the length L1 of the projectile 2 is between about 1.15 inches and about 1.45 inches. In a more preferred embodiment, the length L1 of the projectile 2 is about 1.30 inches. In one embodiment, the length L2 of the nose portion 6 is between about 0.75 inches and about 1.25 inches. In a preferred embodiment, the length L2 of the nose portion 6 is between about 0.80 inches and about 1.0 inch. In a more preferred embodiment, the length L2 of the nose portion 6 is about 0.900 inches. In one embodiment, the length L3 of the cylindrical portion 20 is between about 0.10 inches and about 0.40 inches. In a preferred embodiment, the length L3 of the cylindrical portion 20 is between about 0.20 inches and about 0.30 inches. In a more preferred embodiment, the length L3 of the cylindrical portion 20 is about 0.225 inches. In one embodiment, the length L4 of the boat tail 38 is between about 0.10 inches and about 0.30 inches. In a preferred embodiment, the length L4 of the boat tail 38 is between about 0.15 inches and about 0.20 inches. In a more preferred embodiment, the length L4 of the boat tail 38 is about 0.175 inches. The diameter D1 of the projectile 2 varies according the various embodiments. In one embodiment, the diameter D1 of the projectile 2 is between about 0.20 inches and about 0.40 inches. In a preferred embodiment, the diameter D1 of the projectile 2 is between about 0.25 inches and about 0.35 inches. In the embodiment shown, the diameter D1 of the projectile 2 is about 0.300 inches. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees. In one embodiment, the angle Δ of the tail depressions is between about 5 degrees and about 10 degrees. In a preferred embodiment, the angle Δ of the tail depressions is between about 7.0 degrees and about 8.0 degrees. In a more preferred embodiment the angle Δ of the tail depressions 34 is about 7.8 degrees. In one embodiment, angles between the driving bands 26A and relief cuts 28A (relative to the horizontal) are about 7.5 degrees. In another embodiment, angles between the driving bands 26A and relief cuts 28A (relative to the horizontal) are about 8.5 degrees.

In alternate embodiments, the projectile 2 can have nose depressions and/or tail depressions. This projectile 2 is different from the prior art because it can pierce armor fly an extended range. This projectile is also capable of flying supersonic. It is also extremely accurate even at long distances.

Figure 6A:
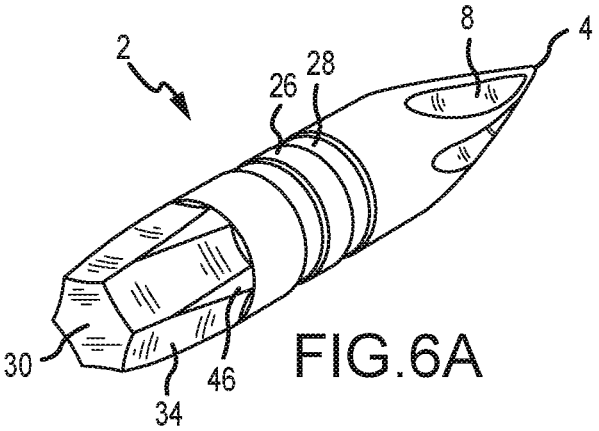
FIGS. 6A-C show a projectile according to a sixth embodiment of the invention.
Figure 6B:
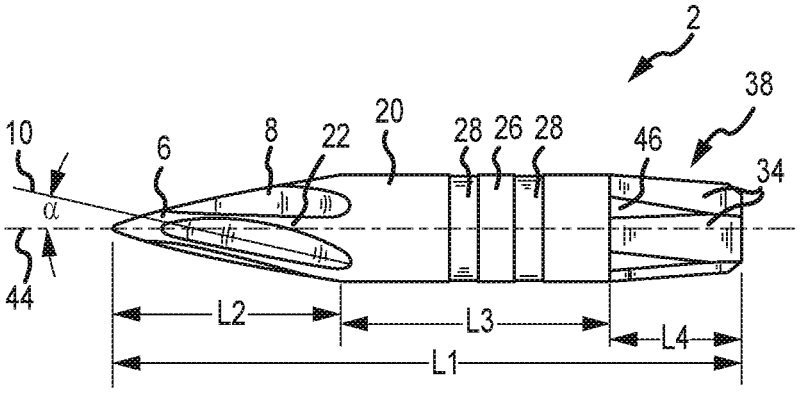
Figure 6C:
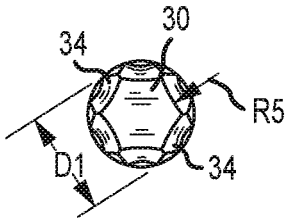

FIGS. 6A-C show a projectile according to a sixth embodiment of the invention. FIG. 6A is a bottom perspective view of the projectile 2. FIG. 6B is a side elevation view of the projectile 2. FIG. 6C is a bottom plan view of the projectile 2. Note that FIGS. 6A-C are to scale.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between two nose depressions 8. The remaining portions 22 are the uncut portions having the projectile's original ogive. The nose depressions 8 run from the tip 4 to a portion of the projectile proximate the central portion 20. The nose depressions 8 have a curved shape meaning that the trough or bottom of the nose depression 8 is curved and has a radius of curvature. The boat tail 34 includes tail depressions 34 and tail remaining portions 46 between the tail depressions 34. The remaining portions 46 are the uncut portions. The tail depressions 34 run from the base 30 to a portion of the boat tail 38. The tail depressions 34 have a curved shape meaning that the trough or bottom of the tail depression 34 is curved and has a radius of curvature R5. In one embodiment, the nose depressions 8 are cut using a 3/16 inch to a 3/8 inch ball end mill and the tail depressions 34 are cut using a 3/8 inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same.

The longitudinal axis 44 of the projectile 2 is shown in FIG. 6B. Accordingly, the angle α of the nose depressions 8 can be measured relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. The angle of the tail depressions 34 can also be measured relative to the longitudinal axis 44. In some embodiments, all tail depressions 34 have the same angle. In other embodiments, each tail depression 34 has a different angle. In still other embodiments, some tail depressions 34 have the same angle while other tail depressions 34 have different angles. In the embodiment shown, the tail depressions 34 are right-hand tail depressions 34 because the angle is positioned to the right of the longitudinal axis 44. Further, when looking at the projectile from a bottom plan view (FIG. 6C), the tail depressions 34 appear to turn in a counterclockwise direction. In one embodiment, the projectile 2 has at least six tail depressions 34. However, the projectile 2 can have more or fewer tail depressions 34.

In one embodiment, the radius of curvature of the nose depression 8 is between about 0.20 inches and about 0.05 inches. In a preferred embodiment, the radius of curvature of the nose depression 8 is between about 0.15 inches and about 0.07 inches. In a more preferred embodiment, the radius of curvature of the nose depression 8 is about 0.09375 inches. In one embodiment, the radius of curvature R5 of the tail depressions 34 is between about 0.10 inches and about 0.30 inches. In a preferred embodiment, the radius of curvature R5 of the tail depressions 34 is between about 0.15 inches and about 0.20 inches. In a more preferred embodiment, the radius of curvature R5 of the tail depressions 34 is about 0.1875 inches. In one embodiment, the length L1 of the projectile 2 is between about 1.0 inch and about 2.5 inches. In a preferred embodiment, the length L1 of the projectile 2 is between about 1.5 inches and about 2.0 inches. In a more preferred embodiment, the length L1 of the projectile 2 is about 1.80 inches. In one embodiment, the length L2 of the nose portion 6 is between about 0.50 inches and about 1.0 inch. In a preferred embodiment, the length L2 of the nose portion 6 is between about 0.70 inches and about 0.80 inches. In a more preferred embodiment, the length L2 of the nose portion 6 is about 0.750 inches. In one embodiment, the length L3 of the cylindrical portion 20 is between about 0.40 inches and about 0.90 inches. In a preferred embodiment, the length L3 of the cylindrical portion 20 is between about 0.55 inches and about 0.75 inches. In a more preferred embodiment, the length L3 of the cylindrical portion 20 is about 0.65 inches. In one embodiment, the length L4 of the boat tail 38 is between about 0.20 inches and about 0.60 inches. In a preferred embodiment, the length L4 of the boat tail 38 is between about 0.30 inches and about 0.50 inches. In a more preferred embodiment, the length L4 of the boat tail 38 is about 0.400 inches. The diameter D1 of the projectile 2 (also called the caliber) varies according the various embodiments. In one embodiment, the diameter D1 of the projectile 2 is between about 0.22 inches and about 0.50 inches. In a preferred embodiment, the diameter D1 of the projectile 2 is between about 0.30 inches and about 0.40 inches. In the embodiment shown, the diameter D1 of the projectile 2 is about 0.338 inches. In one embodiment, the angle $\alpha$ of the nose depressions 8 is between about 5 degrees and about 10 degrees. In a preferred embodiment, the angle $\alpha$ of the nose depressions 8 is between about 6 degrees and about 9 degrees. In a more preferred embodiment, the angle $\alpha$ of the nose depressions 8 is about 7.5 degrees. In one embodiment, the angle $\theta$ of the boat tail 38 is between about 5 degrees and about 10 degrees. In a preferred embodiment, the angle of the boat tail 38 is between about 6.5 degrees and about 8.0 degrees. In a more preferred embodiment, the angle of the boat tail 38 is about 7.5 degrees. In one embodiment, the angle $\Delta$ of the tail depressions 34 is between about 4.0 degrees and about 10.0 degrees. In a preferred embodiment, the angle $\Delta$ of the tail depressions 34 is between about 5.0 degrees and about 7.0 degrees. In a more preferred embodiment the angle $\Delta$ of the tail depressions 34 is about 6.0 degrees. The angle $\Delta$ of the tail depression 34 is measured from the centerline 36 of the tail depression 34 relative to the longitudinal axis 44.

This projectile 2 is different from the prior art because it can pierce armor and stop in soft tissue. The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 7A:
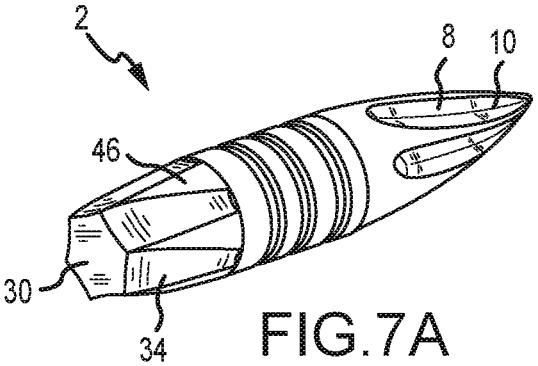
FIGS. 7A-C show a projectile according to a seventh embodiment of the invention.
Figure 7B:
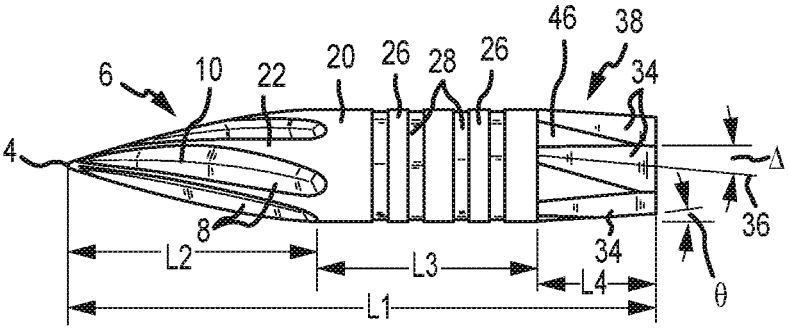
Figure 7C:
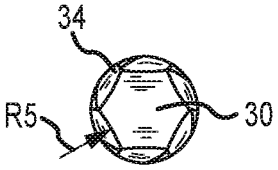

FIGS. 7A-C show a projectile according to a seventh embodiment of the invention. FIG. 7A is a bottom perspective view of the projectile 2. FIG. 7B is a side elevation view of the projectile 2. FIG. 7C is a bottom plan view of the projectile 2. Note that FIGS. 7A-C are to scale.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8, where each nose remaining portion 22 is positioned between two nose depressions 8.

The nose remaining portions 22 are the uncut portions having the projectile's original ogive. The nose depressions 8 run from the tip 4 to a portion of the projectile proximate the cylindrical portion 20. The nose depressions 8 have a curved shape meaning that the trough or bottom of the nose depression 8 is curved and has a radius of curvature R4. The boat tail 38 includes tail depressions 34 and tail remaining portions 46 between the tail depressions 34, where each tail remaining portion 46 is positioned between two tail depressions 34. The tail remaining portions 46 are the uncut portions. The tail depressions 34 run from the base 30 to a portion of the boat tail 38 proximate the cylindrical portion 20. The tail depressions 34 can have a curved shape meaning that the trough or bottom of the tail depression 34 is curved and has a radius of curvature R5. In one embodiment, the nose depressions 8 are cut using a 120 degree cutter and the tail depressions 34 are cut using a ⅜ inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same.

The longitudinal axis 44 of the projectile 2 is shown in FIG. 7B. Accordingly, the angle $\alpha$ of the nose depressions 8 can be measured relative to the longitudinal axis 44. In some embodiments, the angle $\alpha$ is measured from the centerline 10 of the nose depressions 8 relative to the original ogive of the projectile nose portion 6. In some embodiments, all nose depressions 8 have the same angle $\alpha$. In other embodiments, each nose depression 8 has a different angle $\alpha$. In still other embodiments, some nose depressions 8 have the same angle $\alpha$ while other nose depressions 8 have different angles $\alpha$. In the embodiment shown, the nose depressions 8 are right-hand nose depressions 8 because the angle $\alpha$ is positioned to the right of the longitudinal axis 44. In one embodiment, the projectile 2 has at least three nose depressions 8. However, the projectile 2 can have more or fewer nose depressions 8. The angle $\Delta$ of the tail depressions 34 can be measured from the centerline 36 of the tail depression 34 relative to the longitudinal axis 44. In some embodiments, all tail depressions 34 have the same angle $\Delta$. In other embodiments, each tail depression 34 has a different angle $\Delta$. In still other embodiments, some tail depressions 34 have the same angle $\Delta$ while other tail depressions 34 have different angles A. In the embodiment shown, the tail depressions 34 are right-hand tail depressions 34 because the angle $\Delta$ is positioned to the right of the longitudinal axis 44. Further, when looking at the projectile from a bottom plan view (FIG. 7C), the tail depressions 34 appear to turn in a counterclockwise direction. In one embodiment, the projectile 2 has at least 6 tail depressions 34. However, the projectile 2 can have more or fewer tail depressions 34.

In one embodiment, the radius of curvature R5 of the tail depressions 34 is between about 0.10 inches and about 0.30 inches. In a preferred embodiment, the radius of curvature R5 of the tail depressions 34 is between about 0.15 inches and about 0.20 inches. In a more preferred embodiment, the radius of curvature R5 of the tail depressions 34 is about 0.1875 inches. In one embodiment, the length L1 of the projectile 2 is between about 1.0 inch and about 2.5 inches. In a preferred embodiment, the length L1 of the projectile 2 is between about 1.5 inches and about 2.0 inches. In a more preferred embodiment, the length L1 of the projectile 2 is about 1.80 inches. In one embodiment, the length L2 of the nose portion 6 is between about 0.50 inches and about 1.0 inch. In a preferred embodiment, the length L2 of the nose portion 6 is between about 0.70 inches and about 0.80 inches. In a more preferred embodiment, the length L2 of the nose portion 6 is about 0.750 inches. In one embodiment, the length L3 of the cylindrical portion 20 is between about 0.40 inches and about 0.90 inches. In a preferred embodiment, the length L3 of the cylindrical portion 20 is between about 0.55 inches and about 0.75 inches. In a more preferred embodiment, the length L3 of the cylindrical portion 20 is about 0.65 inches. In one embodiment, the length L4 of the boat tail 38 is between about 0.20 inches and about 0.60 inches. In a preferred embodiment, the length L4 of the boat tail 38 is between about 0.30 inches and about 0.50 inches. In a more preferred embodiment, the length L4 of the boat tail 38 is about 0.400 inches. The diameter of the projectile 2 varies according the various embodiments. In one embodiment, the diameter of the projectile 2 is between about 0.22 inches and about 0.45 inches. In a preferred embodiment, the diameter of the projectile 2 is between about 0.29 inches and about 0.31 inches. In the embodiment shown, the diameter of the projectile 2 is about 0.308 inches. In one embodiment, the angle $\alpha$ of the nose depressions 8 is between about 2 degrees and about 10 degrees. In a preferred embodiment, the angle $\alpha$ of the nose depressions 8 is between about 4 degrees and about 7 degrees. In a more preferred embodiment, the angle $\alpha$ of the nose depressions 8 is about 5.5 degrees. In one embodiment, the angle $\theta$ of the boat tail 38 is between about 5 degrees and about 10 degrees. In a preferred embodiment, the angle $\theta$ of the boat tail 38 is between about 6.5 degrees and about 8.0 degrees. In a more preferred embodiment, the angle $\theta$ of the boat tail 38 is about 7.5 degrees. In one embodiment, the angle $\Delta$ of the tail depressions 34 is between about 6 degrees and about 9 degrees. In a preferred embodiment, the angle $\Delta$ of the tail depressions 34 is between about 7.0 degrees and about 8.5 degrees. In a more preferred embodiment the angle $\Delta$ of the tail depressions 34 is about 7.8 degrees.

This projectile 2 is different from the prior art because it can pierce armor and stop in soft tissue. The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 8A:
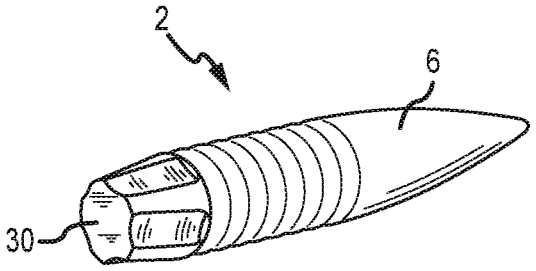
FIGS. 8A-C show a projectile according to an eighth embodiment of the invention.
Figure 8B:
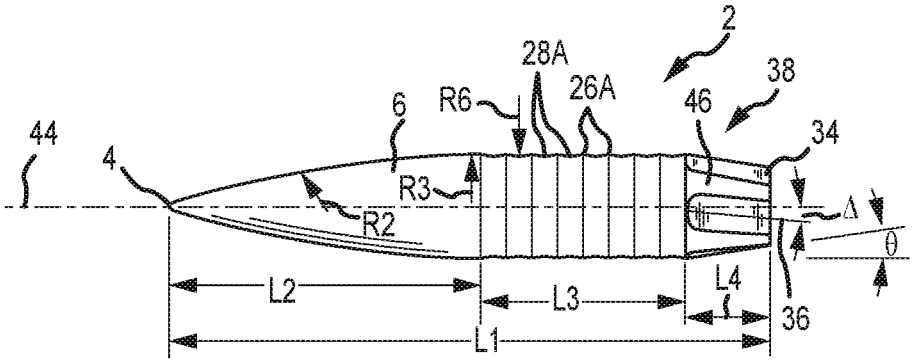
Figure 8C:
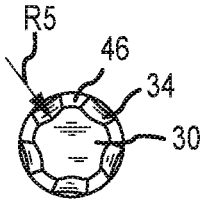

FIGS. 8A-C show a projectile according to an eighth embodiment of the invention. FIG. 8A is a bottom perspective view of the projectile 2. FIG. 8B is a side elevation view of the projectile 2. FIG. 8C is a bottom plan view of the projectile 2. Note that FIGS. 8A-C are to scale.

The projectile 2 comprises a tip 4 on one end opposite a base 30 on the other end. The projectile 2 comprises a nose portion 6, a cylindrical portion 20, and a boat tail 38. The boat tail 34 includes tail depressions 34 and tail remaining portions 46 between the tail depressions 34 where each tail remaining portion 46 is positioned between two tail depressions 34. The remaining portions 46 are the uncut portions. The tail depressions 34 run from the base 30 to a portion of the boat tail 38 proximate the cylindrical portion 20. The tail depressions 34 can have a curved shape, meaning that the trough or bottom of the tail depression 34 is curved and has a radius of curvature R5. In one embodiment, the tail depressions 34 are cut using a ⅜ inch flat end mill. The cylindrical portion 20 of the projectile can also comprise angled driving bands 26A and angled relief cuts 28A. Some embodiments have one or more angled driving bands 26A and angled relief cuts 28A. The widths of the angled driving bands 26A and angled relief cuts 28A can vary or they can all be the same. The driving bands 28A alternate with the relief bands 26A. The angles between the driving bands 26A and angled relief cuts 28A (relative to the horizontal) are between about 7 degrees and about 10 degrees. In one embodiment, angles between the driving bands 26A and, angled relief cuts 28A (relative to the horizontal) are about 7.5 degrees. In another embodiment, angles between the driving bands 26A and relief cuts 28A (relative to the horizontal) are about 8.5 degrees.

The angle $\Delta$ of the tail depressions 34 can be measured from the centerline 36 of the tail depression 34 relative to the longitudinal axis 44. In some embodiments, all tail depressions 34 have the same angle $\Delta$. In other embodiments, each tail depression 34 has a different angle $\Delta$. In still other embodiments, some tail depressions 34 have the same angle $\Delta$ while other tail depressions 34 have different angles A. In the embodiment shown, the tail depressions 34 are right-hand tail depressions 34 because the angle $\Delta$ is positioned to the right of the longitudinal axis 44. Further, when looking at the projectile 2 from a bottom plan view (FIG. 8C), the tail depressions 34 appear to turn in a counterclockwise direction. In one embodiment, the projectile 2 has at least six tail depressions 34. However, the projectile 2 can have more or fewer tail depressions 34.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch.

In one embodiment, the length L1 of the projectile 2 is between about 1.5 inches and about 2.5 inches. In a preferred embodiment, the length L1 of the projectile 2 is between about 1.75 inches and about 2.25 inches. In a more preferred embodiment, the length L1 of the projectile 2 is about 2.1 inches. In one embodiment, the length L2 of the nose portion 6 is between about 0.50 inches and about 1.10 inches. In a preferred embodiment, the length L2 of the nose portion 6 is between about 0.75 inches and about 1.00 inch. In a more preferred embodiment, the length L2 of the nose portion 6 is about 0.8633 inches. In one embodiment, the length L3 of the cylindrical portion 20 is between about 0.25 inches and about 0.50 inches. In a preferred embodiment, the length L3 of the cylindrical portion 20 is between about 0.30 inches and about 0.40 inches. In a more preferred embodiment, the length L3 of the cylindrical portion 20 is about 0.322 inches. In one embodiment, the length L4 of the boat tail 38 is between about 0.10 inches and about 0.45 inches. In a preferred embodiment, the length L4 of the boat tail 38 is between about 0.15 inches and about 0.30 inches. In a more preferred embodiment, the length L4 of the boat tail 38 is about 0.275 inches. The diameter of the projectile 2 (also called the caliber) varies according the various embodiments. In one embodiment, the diameter of the projectile 2 is between about 0.220 inches and about 0.450 inches. In a preferred embodiment, the diameter of the projectile 2 is between about 0.290 inches and about 0.350 inches. In the embodiment shown, the diameter of the projectile 2 is about 0.3080 inches. In one embodiment, the diameter of the angled relief cut 28A is between about 0.20 inches and about 0.40 inches. In a preferred embodiment, the diameter of the angled relief cut 28A is between about 0.25 inches and about 0.31 inches. In the embodiment shown, the diameter of the angled relief cut 28A is about 0.298 inches. In one embodiment, the diameter of the angled driving band 26A is between about 0.25 inches and about 0.32 inches. In a preferred embodiment, the diameter of the angled driving band 26A is between about 0.30 inches and about 0.31 inches. In the embodiment shown, the diameter of the angled driving band 26A is about 0.307 inches. In one embodiment, the angle θ of the boat tail 38 is between about 5 degrees and about 10 degrees. In a preferred embodiment, the angle θ of the boat tail 38 is between about 7.0 degrees and about 8.0 degrees. In a more preferred embodiment, the angle θ of the boat tail 38 is about 7.5 degrees. In one embodiment, the angle Δ of the tail depressions 34 is between about 5 degrees and about 10 degrees. In a preferred embodiment, the angle Δ of the tail depressions 34 is between about 7.0 degrees and about 8.0 degrees. In a more preferred embodiment the angle Δ of the tail depressions 34 is about 7.8 degrees.

In alternate embodiments, the projectile 2 can have nose depressions and/or tail depressions. This projectile 2 is different from the prior art because it can pierce armor fly an extended range. This projectile is also capable of flying supersonic. It is extremely accurate even at long distances.

Figure 9A:
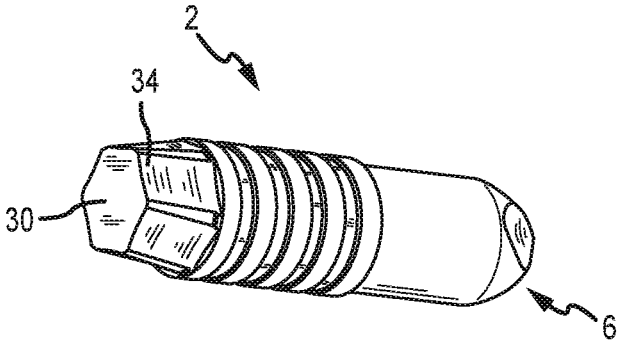
FIGS. 9A-D show a projectile according to a ninth embodiment of the invention.
Figure 9B:
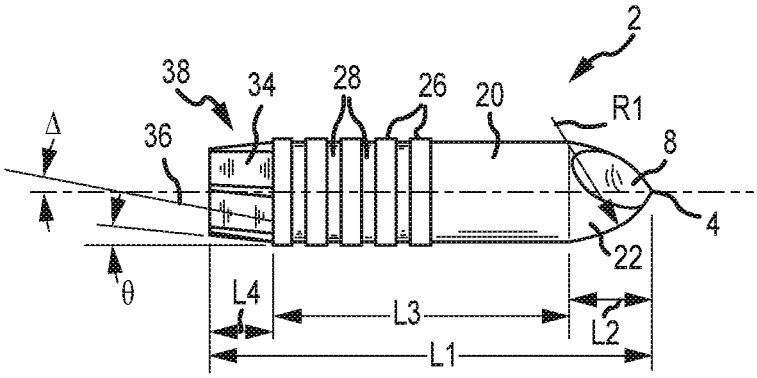
Figure 9C:
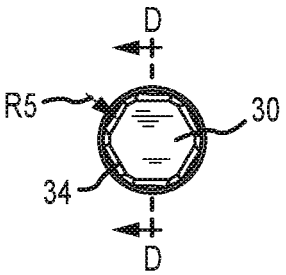
Figure 9D:
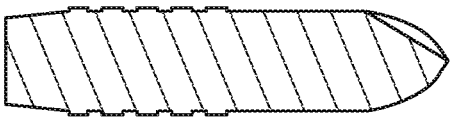

FIGS. 9A-D show a projectile according to a ninth embodiment of the invention. FIG. 9A is a bottom perspective view of the projectile 2. FIG. 9B is a side elevation view of the projectile 2. FIG. 9C is a bottom plan view of the projectile 2. FIG. 9D is a cross sectional view taken at cut D-D of FIG. 9C. Note that FIGS. 9A-D are to scale. The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive. The nose depressions 8 run from the tip 4 to a portion of the projectile proximate the cylindrical portion 20. The nose depressions 8 have a curved shape meaning that the trough or bottom of the nose depression 8 is curved and has a radius of curvature. The boat tail 34 includes tail depressions 34 and tail remaining portions 46 between the tail depressions 34 where each tail remaining portion 46 is positioned between two tail depressions 34. The remaining portions 46 are the uncut portions. The tail depressions 34 run from the base 30 to a portion of the boat tail 38 proximate the cylindrical portion 20. The tail depressions 34 have a curved shape meaning that the trough or bottom of the tail depression 34 is curved and has a radius of curvature R5. In one embodiment, the nose depressions 8 are cut using a 3/16 inch to a 3/8 inch ball end mill and the tail depressions 34 are cut using a 3/8 inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same.

The angle Δ of the tail depressions 34 can be measured from the centerline 36 of the tail depression 34 relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles A. In the embodiment shown, the tail depressions 34 are right-hand tail depressions 34 because the angle Δ is positioned to the right of the longitudinal axis 44. Further, when looking at the projectile from a bottom plan view (FIG. 9C), the tail depressions 34 appear to turn in a counterclockwise direction. In one embodiment, the projectile 2 has at least six tail depressions 34. However, the projectile 2 can have more or fewer tail depressions 34.

In one embodiment, the radius of curvature R4 (not shown in FIGS. 9A-9D, but shown in other FIGS.) of the nose depressions 8 is between about 0.10 inches and about 0.40 inches. In a preferred embodiment, the radius of curvature of the nose depressions 8 is between about 0.20 inches and about 0.30 inches. In a more preferred embodiment, the radius of curvature of the nose depressions 8 is about 0.25 inches. In one embodiment, the radius of curvature R5 of the tail depressions 34 is between about 0.10 inches and about 0.30 inches. In a preferred embodiment, the radius of curvature R5 of the tail depressions 34 is between about 0.15 inches and about 0.20 inches. In a more preferred embodiment, the radius of curvature R5 of the tail depressions 34 is about 0.1875 inches. In one embodiment, the length L1 of the projectile 2 is between about 1.0 inch and about 2.0 inches. In a preferred embodiment, the length L1 of the projectile 2 is between about 1.25 inches and about 1.75 inches. In a more preferred embodiment, the length L1 of the projectile 2 is about 1.492 inches. In one embodiment, the length L2 of the nose portion 6 is between about 0.10 inches and about 0.40 inches. In a preferred embodiment, the length L2 of the nose portion 6 is between about 0.20 inches and about 0.35 inches. In a more preferred embodiment, the length L2 of the nose portion 6 is about 0.29 inches. In one embodiment, the length L3 of the cylindrical portion 20 is between about 0.75 inches and about 1.25 inches. In a preferred embodiment, the length L3 of the cylindrical portion 20 is between about 0.90 inches and about 1.1 inches. In a more preferred embodiment, the length L3 of the cylindrical portion 20 is about 1.01 inches.

In one embodiment, the length L4 of the boat tail 38 is between about 0.10 inches and about 0.30 inches. In a preferred embodiment, the length L4 of the boat tail 38 is between about 0.15 inches and about 0.25 inches. In a more preferred embodiment, the length L4 of the boat tail 38 is about 0.19 inches. The diameter of the projectile 2 varies according the various embodiments. In one embodiment, the diameter of the projectile 2 is between about 0.20 inches and about 0.50 inches. In a preferred embodiment, the diameter of the projectile 2 is between about 0.30 inches and about 0.45 inches. In the embodiment shown, the diameter of the projectile 2 is about 0.375 inches. In one embodiment, the angle α of the nose depressions 8 is between about 3 degrees and about 8 degrees. In a preferred embodiment, the angle α of the nose depressions 8 is between about 5 degrees and about 6 degrees. In a more preferred embodiment, the angle α of the nose depressions 8 is about 5.6 degrees. In one embodiment, the angle θ of the boat tail 38 is between about 1 degree and about 5 degrees. In a preferred embodiment, the angle θ of the boat tail 38 is between about 2.0 degrees and about 4.0 degrees. In a more preferred embodiment, the angle θ of the of the boat tail 38 is about 3.0 degrees. In one embodiment, the angle Δ of the tail depressions 34 is between about 4.0 degrees and about 8.0 degrees. In a preferred embodiment, the angle Δ of the tail depressions 34 is between about 5.0 degrees and about 6.0 degrees. In a more preferred embodiment the angle Δ of the tail depressions 34 is about 5.6 degrees.

This projectile 2 is designed to shoot into a large animal, e.g., an elephant, and not yaw once it inserts the body. The boat tail 38 of the projectile 2 allows the projectile 2 to perform like this in the soft tissue of an animal. The intended users of the projectile 2 are African big game hunters. The attributes of this projectile 2 are deep straight penetration with transfer of energy. The projectile is comprised of brass, copper, bronze, tungsten-carbide, alloys of these metals, or any material known in the art, including plastics and ceramics. Note that the nose portion 6 of this projectile 2 can be the same or similar to the nose portions shown in FIGS. 21-23.

Figure 10A:
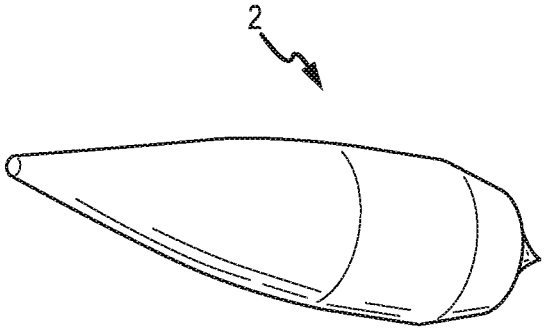
FIGS. 10A-C show a projectile according to a tenth embodiment of the invention.
Figure 10B:
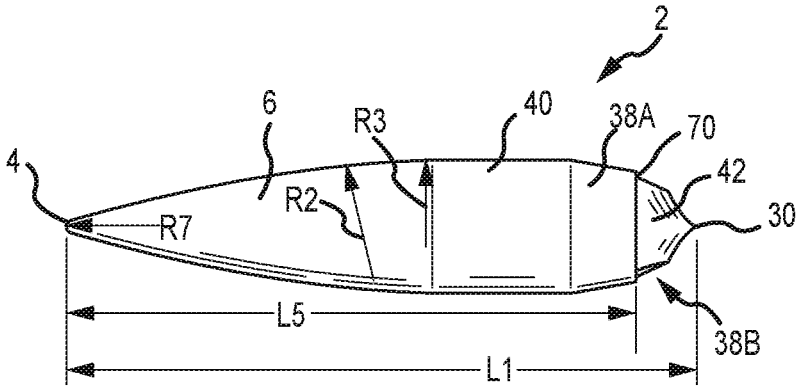
Figure 10C:
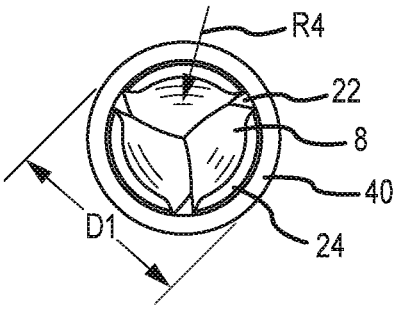

FIGS. 10A-C show a projectile according to a tenth embodiment of the invention. FIG. 10A is a top perspective view of the projectile 2. FIG. 10B is a side elevation view of the projectile 2. FIG. 10C is a bottom plan view of the projectile 2.

The projectile 2 comprises a housing 40 with a tip 4 on one end and rear edge 70 on the opposite end. The projectile 2 also includes an insert 42 with a base 30 opposite the tip 4. The housing 40 comprises a nose portion 6 extending from the tip 4 on to a cylindrical portion 20. The cylindrical portion 20 extends from the nose portion 6 to the boat tail 38A. The housing 40 includes a portion of the boat tail 38A. The insert 42 comprises the rest of the boat tail 38B. In one embodiment, the insert 42 is the same insert shown and described in FIGS. 25 and 27. In additional embodiments, the cylindrical portion 20 can comprise multiple angled relief bands and angled driving bands. The driving bands alternate with the relief bands. The angles between the driving bands and relief cuts are between about 7 degrees and about 10 degrees.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R7 of the tip 4 is between about 0.030 inches and about 0.005 inches. In a preferred embodiment, the radius of curvature R7 of the tip 4 is between about 0.020 inches and about 0.010 inches. In a more preferred embodiment, the radius of curvature R7 of the tip 4 is about 0.015 inches.

In one embodiment, the length L1 of the projectile 2 is between about 1.25 inches and about 2.25 inches. In a preferred embodiment, the length L1 of the projectile 2 is between about 1.4 inches and about 2.0 inches. In a more preferred embodiment, the length L1 of the projectile 2 is about 1.75 inches. In one embodiment, the length L2 of the nose portion 6 is between about 0.50 inches and about 1.10 inches. In a preferred embodiment, the length L2 of the nose portion 6 is between about 0.75 inches and about 1.00 inch. In a more preferred embodiment, the length L2 of the nose portion 6 is about 0.863 inches. The diameter D1 of the projectile 2 (also called the caliber) varies according the various embodiments. In one embodiment, the diameter D1 of the projectile 2 is between about 0.220 inches and about 0.450 inches. In a preferred embodiment, the diameter D1 of the projectile 2 is between about 0.290 inches and about 0.350 inches. In the embodiment shown, the diameter D1 of the projectile 2 is about 0.3080 inches. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7 degrees. In one embodiment, the length L5 of the housing 40 is between about 1.0 inch and about 2.0 inches. In a preferred embodiment, the length L5 of the housing 40 is between about 1.1 inches and about 1.6 inches. In a more preferred embodiment, the length L5 of the housing 40 is about 1.3 inches.

In this embodiment, the insert 42 acts like a propeller in the gun barrel. Thus, the insert 42 relieves pressure on the gun barrel and increases the speed of the bullet. Relieving pressure reduces the wear on the gun barrel because the projectile is already twisting when it hits the barrel's rifling. Thus, there is not a pressure jump where the rifling begins. Further, the shape of the tail formed by the insert 42 is the ideal shape to interact with the gun powder. The depressions on the tail or insert 42 have a 15 degree twist in one embodiment. The tail shape only enhances performance during internal ballistics because the tail is riding in the slip screen of the projectile during external ballistics.

Figure 11A:
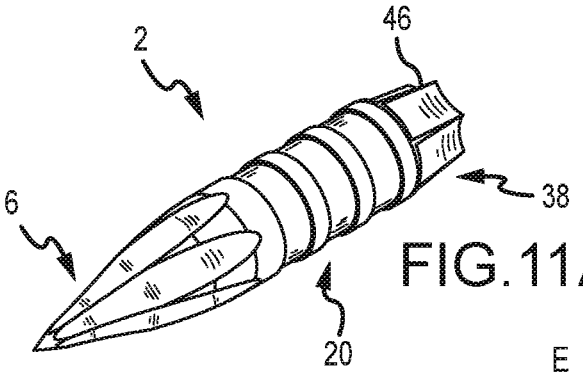
FIGS. 11A-F show a projectile according to an eleventh embodiment of the invention.
Figure 11B:
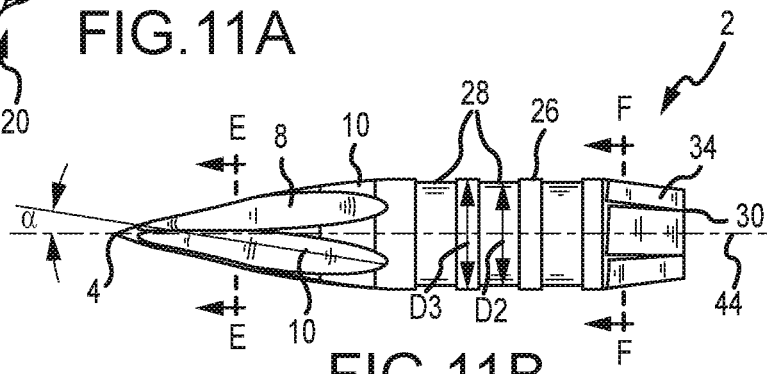
Figure 11C:
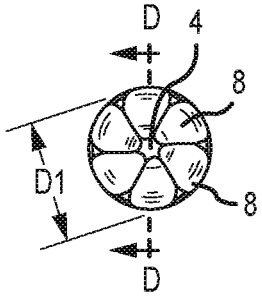
Figure 11D:
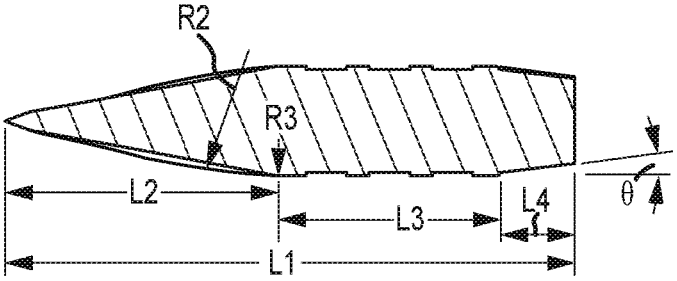
Figure 11E:
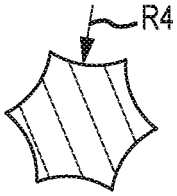
Figure 11F:
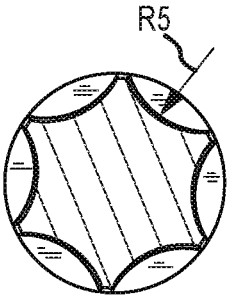

FIGS. 11A-F show a projectile according to an eleventh embodiment of the invention. FIG. 11A is a perspective view of the projectile 2. FIG. 11B is a side elevation view of the projectile 2. FIG. 11C is a top plan view of the projectile 2. FIG. 11D is a cross section taken at cut D-D of FIG. 11C. FIG. 11E is a cross section taken at cut E-E of FIG. 11B. FIG. 11F is a cross section taken at cut F-F of FIG. 11B. Note that FIGS. 11A-D are to scale. FIGS. 11E and 11F are enlarged as compared to FIGS. 11A-D.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8, where each nose remaining portion 22 is positioned between two nose depressions 8. The nose remaining portions 22 are the uncut portions having the projectile's original ogive. The nose depressions 8 run from the tip 4 to a portion of the projectile proximate the cylindrical portion 20. The nose depressions 8 have a curved shape meaning that the trough or bottom of the nose depression 8 is curved and has a radius of curvature R4. The boat tail 34 includes tail depressions 34 and tail remaining portions 46 between the tail depressions 34 where each tail remaining portion 46 is positioned between two tail depressions 34. The tail remaining portions 46 are the uncut portions. The tail depressions 34 run from the base 30 to a portion of the boat tail 38 proximate the cylindrical portion 20. The tail depressions 34 have a curved shape meaning that the trough or bottom of the tail depression 34 is curved and has a radius of curvature R5. In one embodiment, the nose depressions 8 are cut using a 0.25 inch ball end mill and the tail depressions 34 are cut using a 0.25 inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same.

The longitudinal axis 44 of the projectile 2 is shown in FIG. 11B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. The angle Δ of the tail depressions 34 can be measured from the centerline 36 of the tail depression 34 relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles A. In one embodiment, the projectile 2 has at least six tail depressions 34. However, the projectile 2 can have more or fewer tail depressions 34.

In one embodiment, the radius of curvature R2 of the tangent ogive is between about 1.0 inch and about 4.0 inches. In a preferred embodiment, the radius of curvature R2 of the tangent ogive is between about 2.0 inches and about 3.5 inches. In a more preferred embodiment, the radius of curvature R2 of the tangent ogive is about 2.71 inches. In one embodiment, the radius of curvature R3 of the secant ogive is between about 0.5 inches and about 2.5 inches. In a preferred embodiment, the radius of curvature R3 of the secant ogive is between about 1.0 inch and about 1.5 inches. In a more preferred embodiment, the radius of curvature R3 of the secant ogive is about 1.35 inches. In one embodiment, the radius of curvature R4 of the nose depressions 8 is between about 0.05 inches and about 0.20 inches. In a preferred embodiment, the radius of curvature R4 of the nose depressions 8 is between about 0.10 inches and about 0.15 inches. In a more preferred embodiment, the radius of curvature R4 of the nose depressions 8 is about 0.125 inches. In one embodiment, the radius of curvature R5 of the tail depressions 34 is between about 0.05 inches and about 0.20 inches. In a preferred embodiment, the radius of curvature R5 of the tail depressions 34 is between about 0.10 inches and about 0.15 inches. In a more preferred embodiment, the radius of curvature R5 of the tail depressions 34 is about 0.125 inches. In one embodiment, the length L1 of the projectile 2 is between about 1.0 inch and about 2.5 inches. In a preferred embodiment, the length L1 of the projectile 2 is between about 1.5 inches and about 2.0 inches. In a more preferred embodiment, the length L1 of the projectile 2 is about 1.75 inches. In one embodiment, the length of the nose portion 6 is between about 0.050 inches and about 1.5 inches. In a preferred embodiment, the length of the nose portion 6 is between about 0.60 inches and about 1.0 inch. In a more preferred embodiment, the length of the nose portion 6 is about 0.80 inches. In one embodiment, the length L3 of the cylindrical portion 20 is between about 0.25 inches and about 1.5 inches. In a preferred embodiment, the length L3 of the cylindrical portion 20 is between about 0.50 inches and about 1.0 inch. In a more preferred embodiment, the length L3 of the cylindrical portion 20 is about 0.70 inches. In one embodiment, the length L4 of the boat tail 38 is between about 0.10 inches and about 0.50 inches. In a preferred embodiment, the length L4 of the boat tail 38 is between about 0.20 inches and about 0.30 inches. In a more preferred embodiment, the length L4 of the boat tail 38 is about 0.25 inches. The diameter D1 of the projectile 2 varies according the various embodiments. In one embodiment, the diameter D1 of the projectile 2 is between about 0.22 inches and about 0.50 inches. In a preferred embodiment, the diameter D1 of the projectile 2 is between about 0.30 inches and about 0.35 inches. In the embodiment shown, the diameter D1 of the projectile 2 is about 0.338 inches. In the embodiment shown, the diameter D2 of the relief cut 28 is about 0.32 inches. In the embodiment shown, the diameter D3 of the driving band is about 0.338 inches. In one embodiment, the angle α of the nose depressions 8 is between about 5 degrees and about 10 degrees. In a preferred embodiment, the angle α of the nose depressions 8 is between about 6 degrees and about 8 degrees. In a more preferred embodiment, the angle α of the nose depressions 8 is about 7.5 degrees. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees. In one embodiment, the angle Δ of the tail depressions 34 is between about 5 degrees and about 10 degrees. In a preferred embodiment, the angle Δ of the tail depressions 34 is between about 7.0 degrees and about 8.0 degrees. In a more preferred embodiment the angle Δ of the tail depressions 34 is about 7.5 degrees.

This projectile 2 is different from the prior art because it can pierce armor and stop in soft tissue. The intended users of the projectile 2 are African big game hunters. The attributes of this projectile 2 are deep straight penetration with transfer of energy. The projectile 2 is comprised of brass, copper, bronze, tungsten-carbide, alloys of these metals, or any material known in the art, including plastics and ceramics.

Referring to FIGS. 12-16 and 18, these projectiles comprise a housing and an insert. Upon impact, the housing will peel back toward the base of the projectile and away from the tip of the projectile when it hits soft tissue. The housing expands rapidly to peel backward The projectile will remain in its original shape when the projectile hits hard tissue. The tip or point keeps the projectile moving in the correct direction after the projectile initially hits soft tissue and the housing peels back toward the base. However, the insert may separate from the housing in soft tissue and the two pieces may go in separate directions. The cavities of these projectiles fill with material when the projectile hits soft tissue. However, material does not go into cavities when the projectile hits hard material. These projectiles are designed mostly for civilian use.

Figure 12A:
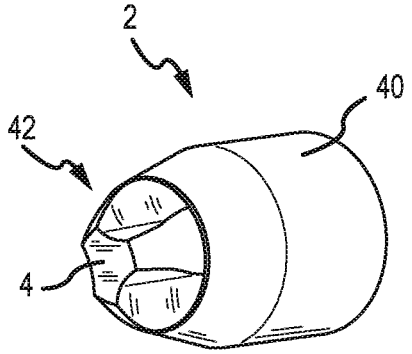
FIGS. 12A-D show a projectile according to a twelfth embodiment of the invention.
Figure 12B:
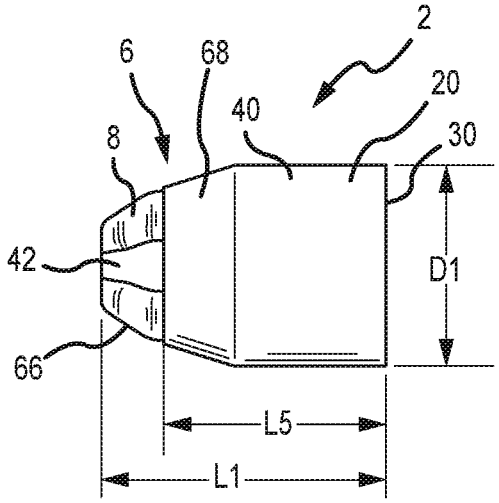
Figure 12C:
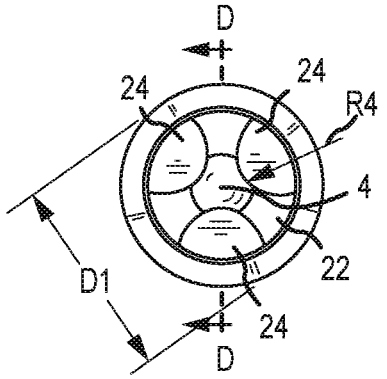
Figure 12D:
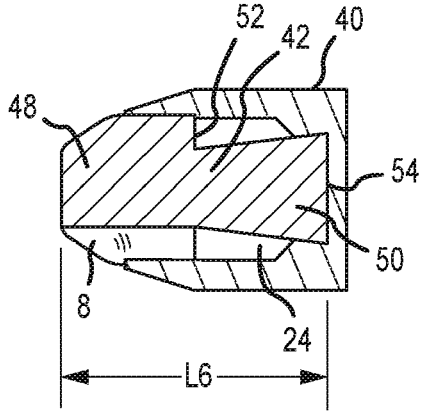

FIGS. 12A-D show a projectile according to a twelfth embodiment of the invention. FIG. 12A is a perspective view of the projectile 2. FIG. 12B is a side elevation view of the projectile 2. FIG. 12C is a top plan view of the projectile 2. FIG. 12D is a cross section taken at cut D-D of FIG. 12C. Note that FIGS. 12A-D are to scale.

The projectile 2 comprises a tip 4 on one end opposite a base 30 on the other end. The projectile 2 comprises a nose portion 6 and a cylindrical portion 20. The projectile 2 is two-pieces and includes a housing 40 and an insert 42. The tip 4 is substantially flat and is a part of the insert 42. The insert 42 has an arrowhead portion 48 that is wider than its stem 50, which extends from the lower portion 52 of the arrowhead 48 to the underside 54 of the stem 50. The base 30 of the projectile is substantially flat and is part of the housing 40. The housing has a cavity 24 extending down from the opening of the housing 40. The lower surface of the cavity 24 is substantially flat and has side portions that extend into the center of the cavity 24 to receive the lower portion or underside 54 of the stem 50 of the insert 42. In some embodiments, the stem 50 has a constant diameter. In other embodiments, the stem 50 gets wider near the bottom 54 of the stem 50. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the insert such that they extend into the cavity 24 of the housing 40 creating cavities 24 for tissue and other material to collect when the projectile hits its target. In one embodiment, the nose depressions are cut using a ⅜-inch ball end mill.

In one embodiment, the projectile 2 has at least three nose depressions 8. However, the projectile 2 can have more or fewer nose depressions 8. In one embodiment, the radius of curvature R4 of the nose depressions 8 is between about 0.10 inches and about 0.30 inches. In a preferred embodiment, the radius of curvature R4 of the nose depressions 8 is between about 0.15 inches and about 0.25 inches. In a more preferred embodiment, the radius of curvature R4 of the nose depressions 8 is about 3/16 inches. In one embodiment, the length L1 of the projectile 2 is between about 0.50 inches and about 1.0 inch. In a preferred embodiment, the length L1 of the projectile 2 is between about 0.55 inches and about 0.75 inches. In a more preferred embodiment, the length L1 of the projectile 2 is about 0.625 inches. In one embodiment, the length L5 of the housing 40 is between about 0.30 inches and about 0.70 inches. In a preferred embodiment, the length L5 of the housing is between about 0.45 inches and about 0.50 inches. In a more preferred embodiment, the length L5 of the housing 40 is about 0.485 inches. The diameter D1 of the projectile 2 (also called the caliber) varies according the various embodiments. In one embodiment, the diameter D1 of the projectile 2 is between about 0.25 inches and about 0.60 inches. In a preferred embodiment, the diameter D1 of the projectile 2 is between about 0.35 inches and about 0.55 inches. In the embodiment shown, the diameter D1 of the projectile 2 is about 0.45 inches. In one embodiment, the angle α of the nose depression 8 is about 0 degrees. The width of the opening of the housing 40 is about 0.330 inches.

Figure 13A:
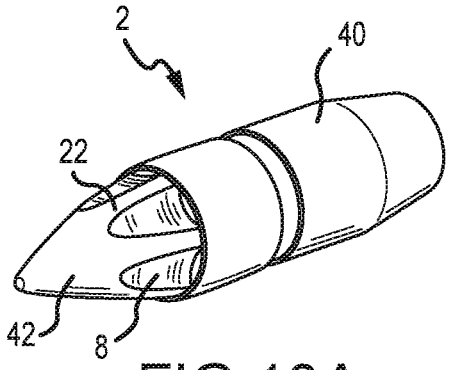
FIGS. 13A-D show a projectile according to a thirteenth embodiment of the invention.
Figure 13B:
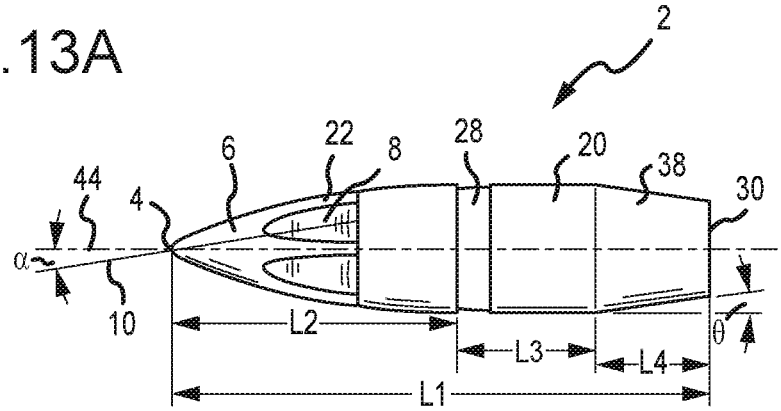
Figure 13C:
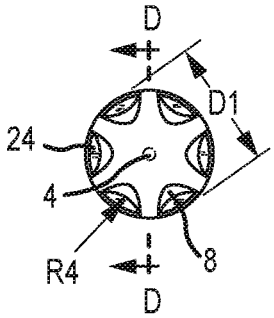
Figure 13D:
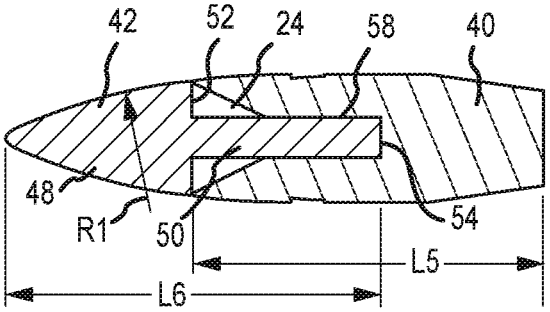

FIGS. 13A-D show a projectile according to a thirteenth embodiment of the invention. FIG. 13A is a perspective view of the projectile 2. FIG. 13B is a side elevation view of the projectile 2. FIG. 13C is a top plan view of the projectile 2. FIG. 13D is a cross section taken at cut D-D of FIG. 13C. Note that FIGS. 13A-D are to scale.

The projectile 2 comprises a tip 4 on one end opposite a base 30 on the other end. The projectile 2 comprises a nose portion, a cylindrical portion 20, and a boat tail 38. The cylindrical portion 20 can comprise one or more relief cuts 28. The cylindrical portion 20 may also comprise at least one driving band. The projectile 2 is two-pieces and includes a housing 40 and an insert 42. The tip 4 is a part of the insert 42. The insert 42 has an arrowhead portion 48 that is wider than its stem 50, which extends from the lower portion 52 of the arrowhead 48 to the underside 54 of the stem 50. The base 30 of the projectile is substantially flat and is part of the housing 40. The housing has a cavity 24 extending down from the opening of the housing 40 in a conical shape that transitions into a cylindrical shape. The lower surface of the cavity 24 is substantially flat and the sides of the cavity 24 form a receiving portion 58 to receive the stem 50 of the insert 42. In some embodiments, the stem 50 has a constant diameter. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the arrowhead 48 of the insert 42 such that they extend into the cavity 24 of the housing 40 creating cavities 24 for tissue and other material to collect when the projectile 2 hits its target. Additional cavities 24 are created by the conical shape of the housing cavity 24 and the flat underside 52 of the arrowhead 48. In one embodiment, the nose depressions are cut using a ⅛ inch ball end mill.

The longitudinal axis 44 of the projectile 2 is shown in FIG. 13B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are left-hand nose depressions 8 because the angle α is positioned to the left of the longitudinal axis 44. In one embodiment, the projectile 2 has at least three nose depressions 8. In another embodiment, the nose portion 6 has six nose depressions 8. However, the projectile 2 can have more or fewer nose depressions 8.

In one embodiment, the radius of curvature R4 of the nose depressions 8 is between about 0.040 inches and about 0.090 inches. In a preferred embodiment, the radius of curvature R4 of the nose depressions 8 is between about 0.050 inches and about 0.070 inches. In a more preferred embodiment, the radius of curvature R4 of the nose depressions 8 is about 0.0625 inches. In one embodiment, the length L1 of the projectile 2 is between about 0.40 inches and about 2.0 inches. In a preferred embodiment, the length L1 of the projectile 2 is between about 0.60 inches and about 1.20 inches. In a more preferred embodiment, the length L1 of the projectile 2 is about 0.912 inches. In one embodiment, the length L2 of the nose portion 6 is between about 0.30 inches and about 0.60 inches. In a preferred embodiment, the length L2 of the nose portion 6 is between about 0.40 inches and about 0.55 inches. In a more preferred embodiment, the length L2 of the nose portion 6 is about 0.485 inches. In one embodiment, the length L3 of the cylindrical portion 20 is between about 0.10 inches and about 0.30 inches. In a preferred embodiment, the length L3 of the cylindrical portion 20 is between about 0.15 inches and about 0.25 inches. In a more preferred embodiment, the length L3 of the cylindrical portion 20 is about 0.20 inches. In one embodiment, the length L4 of the boat tail 38 is between about 0.10 inches and about 0.50 inches. In a preferred embodiment, the length L4 of the boat tail 38 is between about 0.20 inches and about 0.30 inches. In a more preferred embodiment, the length L3 of the cylindrical portion 20 is about 0.225 inches. The diameter D1 of the projectile 2 varies according the various embodiments. In one embodiment, the diameter D1 of the projectile 2 is between about 0.10 inches and about 0.40 inches. In a preferred embodiment, the diameter D1 of the projectile 2 is between about 0.20 inches and about 0.25 inches. In the embodiment shown, the diameter D1 of the projectile 2 is about 0.224 inches. In the embodiment shown, the width of the housing opening is about 0.200 inches. In one embodiment, the angle α of the nose depressions 8 is between about 3.0 degrees and about 8.0 degrees. In a preferred embodiment, the angle α of the nose depressions 8 is between about 4.5 degrees and about 6.5 degrees. In a more preferred embodiment, the angle α of the nose depressions 8 is about 5.5 degrees. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7 degrees.

Figure 14A:
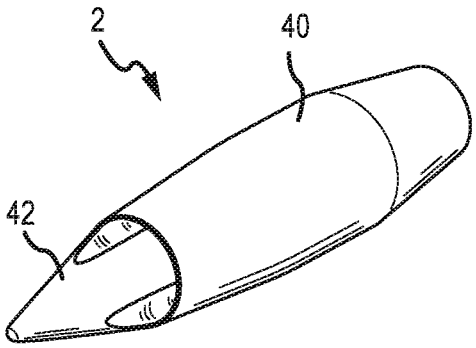
FIGS. 14A-C show a projectile according to a fourteenth embodiment of the invention.
Figure 14B:
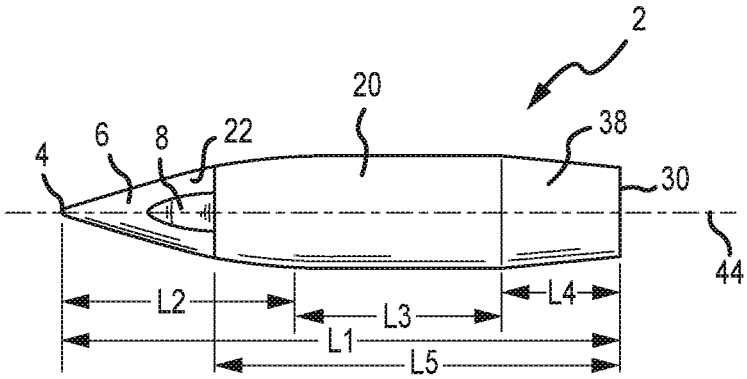
Figure 14C:
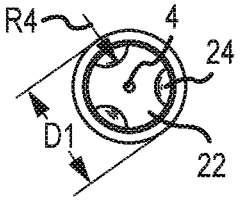

FIGS. 14A-C show a projectile according to a fourteenth embodiment of the invention. FIG. 14A is a perspective view of the projectile 2. FIG. 14B is a side elevation view of the projectile 2. FIG. 14C is a top plan view of the projectile 2. Note that FIGS. 14A-C are to scale.

The projectile 2 comprises a tip 4 on one end opposite a base 30 on the other end. The projectile 2 comprises a nose portion 6, a cylindrical portion 20, and a boat tail 38. The cylindrical portion 20 can comprise at least one relief cut 28. The cylindrical portion may comprise one or more driving bands and relief cuts. The projectile 2 is two-pieces and includes a housing 40 and an insert 42. The tip 4 is a part of the insert 42. The insert 42 is linear. In some embodiments, the cylindrical portion of the insert 42 has a constant diameter. The base 30 of the projectile is substantially flat and is part of the housing 40. The housing 40 has a cavity extending down from the opening of the housing 40. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the insert 42 such that they extend into the cavity of the housing 40 creating cavities 24 for tissue and other material to collect when the projectile 2 hits its target. In one embodiment, the nose depressions 8 are cut using a 3/16 inch flat end mill.

The longitudinal axis 44 of the projectile 2 is shown in FIG. 13B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. In another embodiment, the nose portion has six nose depressions. However, the projectile 2 can have more or fewer nose depressions 8.

In one embodiment, the radius of curvature R4 of the nose depressions 8 is between about 0.040 inches and about 0.080 inches. In a preferred embodiment, the radius of curvature R4 of the nose depressions 8 is between about 0.050 inches and about 0.070 inches. In a more preferred embodiment, the radius of curvature R4 of the nose depressions 8 is about 0.0625 inches. In one embodiment, the length L1 of the projectile 2 is between about 1.0 inch and about 2.5 inches. In a preferred embodiment, the length L1 of the projectile 2 is between about 1.25 inches and about 1.5 inches. In a more preferred embodiment, the length L1 of the projectile 2 is about 1.387 inches. In one embodiment, the length L2 of the nose portion 6 is between about 0.40 inches and about 0.80 inches. In a preferred embodiment, the length L2 of the nose portion 6 is between about 0.60 inches and about 0.70 inches. In a more preferred embodiment, the length L2 of the nose portion 6 is about 0.674 inches. In one embodiment, the length L3 of the cylindrical portion 20 is between about 0.30 inches and about 0.70 inches. In a preferred embodiment, the length L3 of the cylindrical portion 20 is between about 0.40 inches and about 0.45 inches. In a more preferred embodiment, the length L3 of the cylindrical portion 20 is about 0.413 inches. In one embodiment, the length L4 of the boat tail 38 is between about 0.2 inches and about 0.40 inches. In a preferred embodiment, the length L4 of the boat tail 38 is between about 0.25 inches and about 0.35 inches. In a more preferred embodiment, the length L4 of the boat tail 38 is about 0.30 inches. In one embodiment, the length L5 of the projectile 2 is between about 0.8 inches and about 1.4 inches. In a preferred embodiment, the length L5 of the projectile 2 is between about 1.0 inch and about 1.2 inches. In a more preferred embodiment, the length L5 of the projectile 2 is about 1.1 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches. In one embodiment, the angle α of the nose depression 8 is about 0 degrees.

Figure 15A:
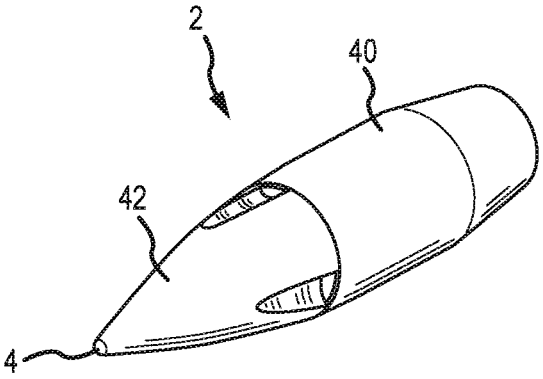
FIGS. 15A-D show a projectile according to a fifteenth embodiment of the invention.
Figure 15B:
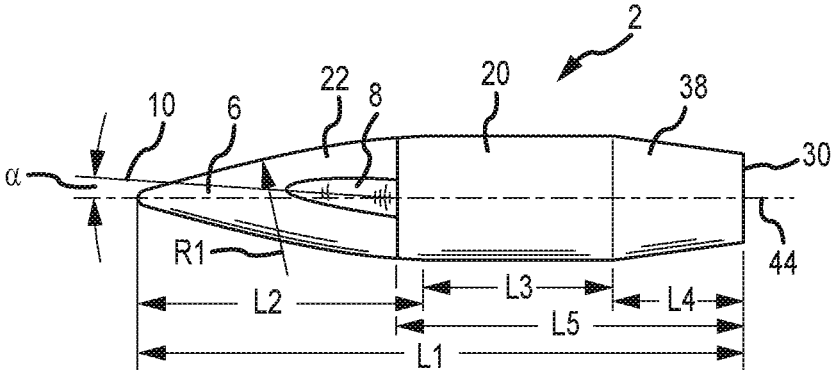
Figure 15C:
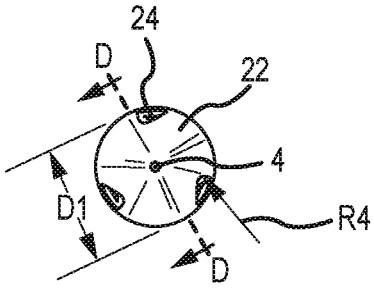
Figure 15D:
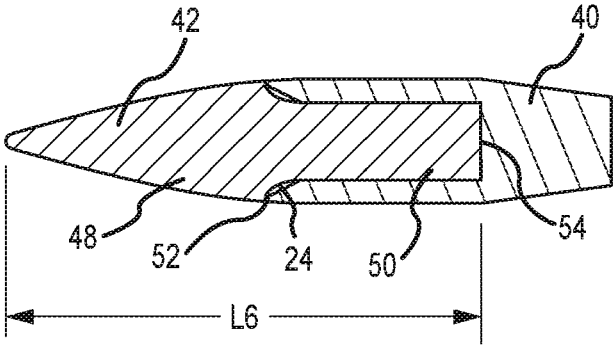

FIGS. 15A-D show a projectile according to a fifteenth embodiment of the invention. FIG. 15A is a perspective view of the projectile 2. FIG. 15B is a side elevation view of the projectile 2. FIG. 15C is a top plan view of the projectile 2. FIG. 15D is a cross sectional view taken along line D-D of FIG. 15C. Note that FIGS. 15A-D are to scale.

The projectile 2 comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and a nose remaining portion 22 between the nose depressions 8, where each nose remaining portion 22 is positioned between two nose depressions 8. The remaining portions 22 are the uncut portions having the projectile's original ogive. In some embodiments, the nose depressions 8 terminate in a substantially flat shoulder 18 (not shown). The nose depressions 8 have a curved shape meaning that the trough or bottom of the nose depression 8 is curved and has a radius of curvature R4. In one embodiment, the nose depressions are cut using a 1/8 inch ball end mill.

The longitudinal axis 44 of the projectile 2 is shown in FIG. 15B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. However, the projectile 2 can have more or fewer nose depressions 8.

In one embodiment, the radius of curvature R4 of the nose depressions 8 is between about 0.06 inches and about 0.20 inches. In a preferred embodiment, the radius of curvature R4 of the nose depressions 8 is between about 0.08 inches and about 0.15 inches. In a more preferred embodiment, the radius of curvature R4 of the nose depressions 8 is about 0.09375 inches. In one embodiment, the length L1 of the projectile 2 is between about 1.206 inches and about 1.606 inches. In a preferred embodiment, the length L1 of the projectile 2 is between about 1.306 inches and about 1.506 inches. In a more preferred embodiment, the length L1 of the projectile 2 is about 1.406 inches. In one embodiment, the length L2 of the nose portion 6 is between about 0.497 inches and about 0.897 inches. In a preferred embodiment, the length L2 of the nose portion 6 is between about 0.597 inches and about 0.797 inches. In a more preferred embodiment, the length L2 of the nose portion 6 is about 0.697 inches. In one embodiment, the length L3 of the cylindrical portion 20 is between about 0.209 inches and about 0.609 inches. In a preferred embodiment, the length L3 of the cylindrical portion 20 is between about 0.309 inches and about 0.509 inches. In a more preferred embodiment, the length L3 of the cylindrical portion 20 is about 0.409 inches. In one embodiment, the length L4 of the boat tail 38 is between about 0.10 inches and about 0.50 inches. In a preferred embodiment, the length L4 of the boat tail 38 is between about 0.20 inches and about 0.40 inches. In a more preferred embodiment, the length L4 of the boat tail 38 is about 0.30 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches. In one embodiment, the angle α of the nose depressions 8 is between about 5 degrees and about 13 degrees. In a preferred embodiment, the angle α of the nose depressions 8 is between about 7 degrees and about 11 degrees. In a more preferred embodiment, the angle α of the nose depressions 8 is about 9.0 degrees.

Figure 16A:
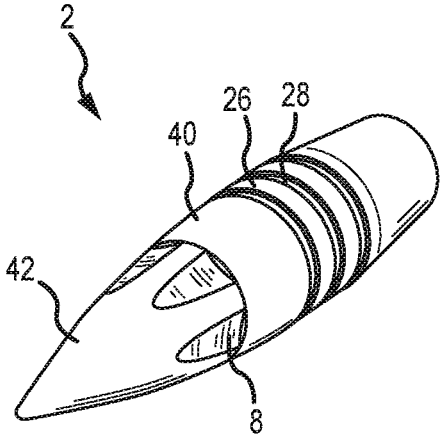
FIGS. 16A-D show a projectile according to a sixteenth embodiment of the invention.
Figure 16B:
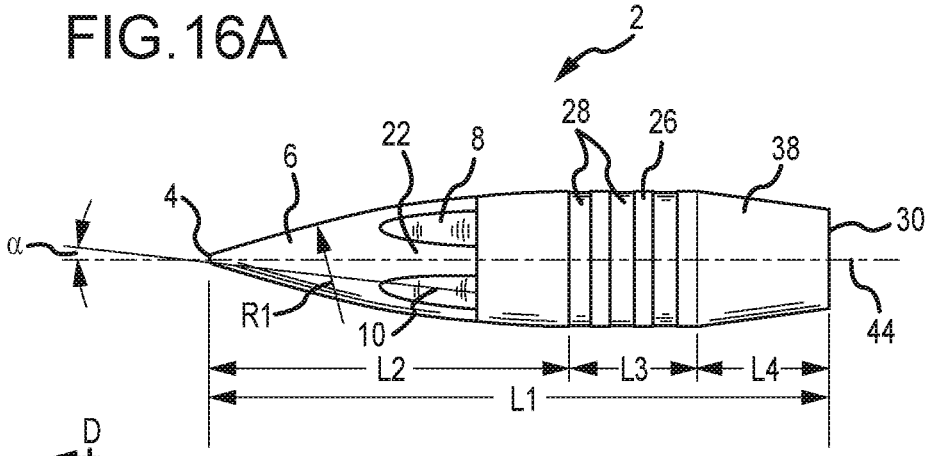
Figure 16C:
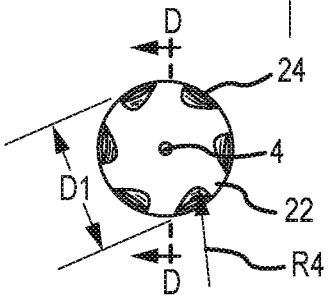
Figure 16D:
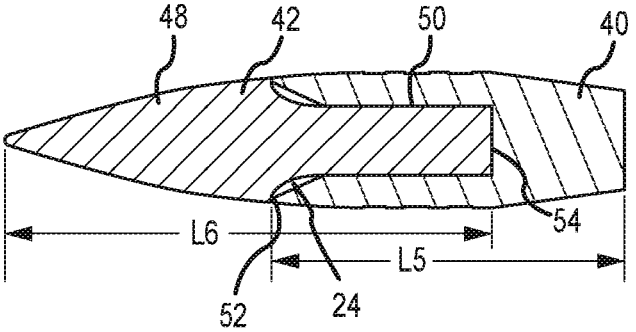

FIGS. 16A-D show a projectile according to a sixteenth embodiment of the invention. FIG. 16A is a perspective view of the projectile 2. FIG. 16B is a side elevation view of the projectile 2. FIG. 16C is a top plan view of the projectile 2. FIG. 16D is a cross section. Note that FIGS. 16A-D are to scale. The projectile 2 comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and a nose remaining portion 22 between the nose depressions 8, where each nose remaining portion 22 is positioned between two nose depressions 8. The remaining portions 22 are the uncut portions having the projectile's original ogive. In some embodiments, the nose depressions 8 terminate in a substantially flat shoulder 18 (not shown). The nose depressions 8 have a curved shape meaning that the trough or bottom of the nose depression 8 is curved and has a radius of curvature R4. In one embodiment, the nose depressions are cut using a 3/16 inch flat end mill.

The longitudinal axis 44 of the projectile 2 is shown in FIG. 16B. Accordingly, the angle α of the nose depressions 8 can be measured relative to the longitudinal axis 44. In some embodiments, the angle α is measured from the centerline 10 of the nose depressions 8 relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8.

In one embodiment, the radius of curvature R4 of the nose depressions 8 is between about 0.06 inches and about 0.20 inches. In a preferred embodiment, the radius of curvature R4 of the nose depressions 8 is between about 0.08 inches and about 0.15 inches. In a more preferred embodiment, the radius of curvature R4 of the nose depressions 8 is about 0.09375 inches. In one embodiment, the length L1 of the projectile 2 is between about 1.206 inches and about 1.606 inches. In a preferred embodiment, the length L1 of the projectile 2 is between about 1.306 inches and about 1.506 inches. In a more preferred embodiment, the length L1 of the projectile 2 is about 1.406 inches. In one embodiment, the length L2 of the nose portion 6 is between about 0.627 inches and about 1.027 inches. In a preferred embodiment, the length L2 of the nose portion 6 is between about 0.727 inches and about 0.927 inches. In a more preferred embodiment, the length L2 of the nose portion 6 is about 0.827 inches. In one embodiment, the length L3 of the cylindrical portion 20 is between about 0.149 inches and about 0.549 inches. In a preferred embodiment, the length L3 of the cylindrical portion 20 is between about 0.249 inches and about 0.449 inches. In a more preferred embodiment, the length L3 of the cylindrical portion 20 is about 0.349 inches. In one embodiment, the length L4 of the boat tail 38 is between about 0.08 inches and about 0.38 inches. In a preferred embodiment, the length L4 of the boat tail 38 is between about 0.18 inches and about 0.28 inches. In a more preferred embodiment, the length L4 of the boat tail 38 is about 0.23 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches. In one embodiment, the angle α of the nose depressions 8 is between about 3.5 degrees and about 7.5 degrees. In a preferred embodiment, the angle α of the nose depressions 8 is between about 4.5 degrees and about 6.5 degrees. In a more preferred embodiment, the angle α of the nose depressions 8 is about 5.5 degrees. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees.

Figure 17A:
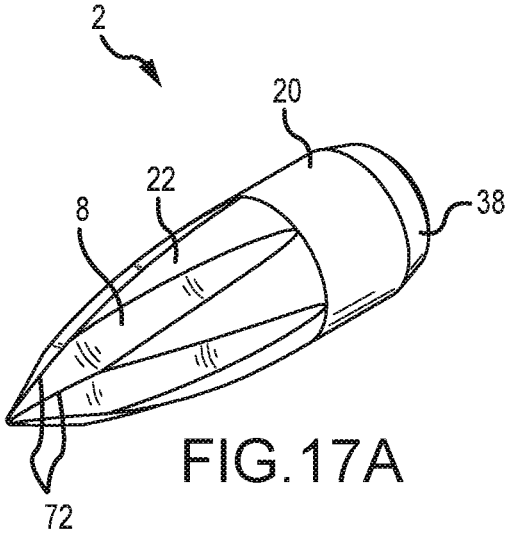
FIGS. 17A-C show a projectile according to a seventeenth embodiment of the invention.
Figure 17B:
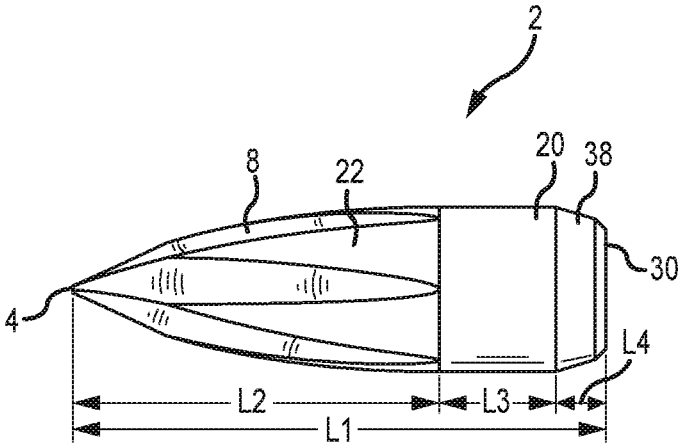
Figure 17C:
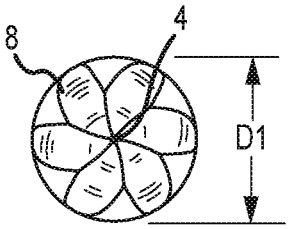

FIGS. 17A-C show a projectile according to a seventeenth embodiment of the invention. FIG. 17A is a perspective view of the projectile 2. FIG. 17B is a side elevation view of the projectile 2. FIG. 17C is a top plan view of the projectile 2. Note that FIGS. 17A-C are to scale.

The projectile 2 comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and a nose remaining portion 22 between two nose depressions 8. The remaining portions 22 are the uncut portions having the projectile's original ogive. The nose depressions 8 have a curved shape meaning that the trough or bottom of the nose depression 8 is curved and has a radius of curvature R4. In one embodiment, the nose depressions are cut using a 1/8 inch ball end mill.

The angle of the nose depressions 8 can be measured relative to the longitudinal axis 44. In some embodiments, the angle is measured from the centerline 10 of the nose depressions 8 relative to the original ogive of the projectile nose portion 6. In some embodiments, all nose depressions 8 have the same angle. In other embodiments, each nose depression 8 has a different angle. In still other embodiments, some nose depressions 8 have the same angle while other nose depressions 8 have different angles. In one embodiment, the projectile 2 has at least three nose depressions 8. However, the projectile 2 can have more or fewer nose depressions 8.

In one embodiment, the length L1 of the projectile 2 is between about 1.20 inches and about 1.60 inches. In a preferred embodiment, the length L1 of the projectile 2 is between about 1.30 inches and about 1.50 inches. In a more preferred embodiment, the length L1 of the projectile 2 is about 1.40 inches. In one embodiment, the length L2 of the nose portion 6 is between about 1 inch and about 1.4 inches. In one embodiment, the length L3 of the cylindrical portion 20 is between about 0.5 inches and about 0.8 inches. In one embodiment, the length L4 of the boat tail 38 is between about 0.2 inches and about 0.5 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches.

This projectile is armor-piercing. The large, long cuts or depressions in the nose ensure the projectile can penetrate and go through metal and other tough or hard material. This projectile is for military and civilian use. Other intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 18A:
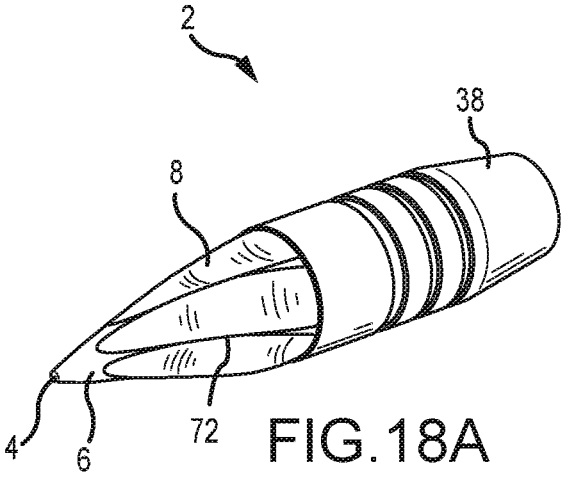
FIGS. 18A-D show a projectile according to an eighteenth embodiment of the invention.
Figure 18B:
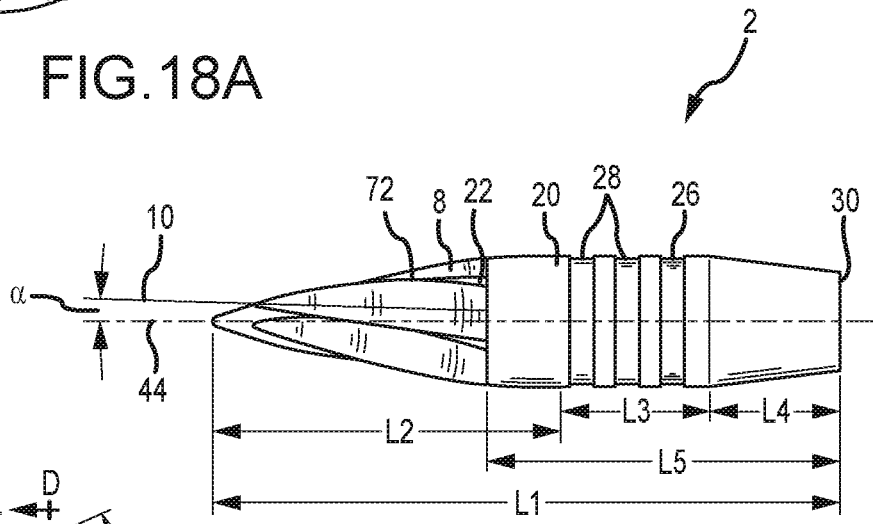
Figure 18C:
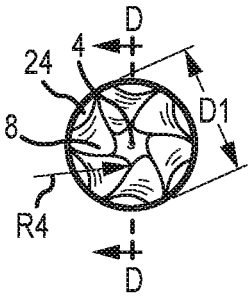
Figure 18D:
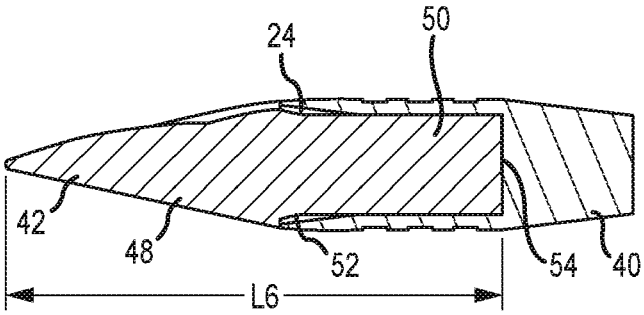

FIGS. 18A-D show a projectile according to an eighteenth embodiment of the invention. FIG. 18A is a perspective view of the projectile 2. FIG. 18B is a side elevation view of the projectile 2. FIG. 18C is a top plan view of the projectile 2. FIG. 18D is a cross section taken along cut D-D of FIG. 18C. Note that FIGS. 18A-D are to scale. This projectile is two pieces and includes a housing 40 and an insert 42.

The projectile 2 comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and nose remaining portions 22 between the nose depressions 8. The remaining portions 22 are the uncut portions having the projectile's original ogive. In some embodiments, the nose depressions 8 terminate in a substantially flat shoulder 18 (not shown). The nose depressions 8 have a curved shape meaning that the trough or bottom of the nose depression 8 is curved and has a radius of curvature R4. In one embodiment, the nose depressions are cut using a 3/16 inch flat end mill.

The longitudinal axis 44 of the projectile 2 is shown in FIG. 18B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. However, the projectile 2 can have more or fewer nose depressions 8.

In one embodiment, the radius of curvature R4 of the nose depressions 8 is between about 0.010 inches and about 0.325 inches. In a preferred embodiment, the radius of curvature R4 of the nose depressions 8 is between about 0.025 inches and about 0.225 inches. In a more preferred embodiment, the radius of curvature R4 of the nose depressions 8 is about 0.125 inches. In one embodiment, the length L1 of the projectile 2 is between about 1.206 inches and about 1.606 inches. In a preferred embodiment, the length L1 of the projectile 2 is between about 1.306 inches and about 1.506 inches. In a more preferred embodiment, the length L1 of the projectile 2 is about 1.406 inches. In one embodiment, the length L2 of the nose portion 6 is between about 0.627 inches and about 1.027 inches. In a preferred embodiment, the length L2 of the nose portion 6 is between about 0.727 inches and about 0.927 inches. In a more preferred embodiment, the length L2 of the nose portion 6 is about 0.827 inches. In one embodiment, the length L3 of the cylindrical portion 20 is between about 0.149 inches and about 0.459 inches. In a preferred embodiment, the length L3 of the cylindrical portion 20 is between about 0.249 inches and about 0.449 inches. In a more preferred embodiment, the length L3 of the cylindrical portion 20 is about 0.349 inches. In one embodiment, the length L4 of the boat tail 38 is between about 0.08 inches and about 0.38 inches. In a preferred embodiment, the length L4 of the boat tail 38 is between about 0.18 inches and about 0.28 inches. In a more preferred embodiment, the length L4 of the boat tail 38 is about 0.23 inches. In one embodiment, the length L5 of the housing 40 is between about 0.627 inches and about 1.027 inches. In a preferred embodiment, the length L5 of the housing 40 is between about 0.727 inches and about 0.927 inches. In a more preferred embodiment, the length L5 of the housing 40 is about 0.827 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches. In one embodiment, the angle α of the nose depressions 8 is between about 3.5 degrees and about 7.5 degrees. In a preferred embodiment, the angle α of the nose depressions 8 is between about 4.5 degrees and about 6.5 degrees. In a more preferred embodiment, the angle α of the nose depressions 8 is about 5.5 degrees.

Figure 19A:
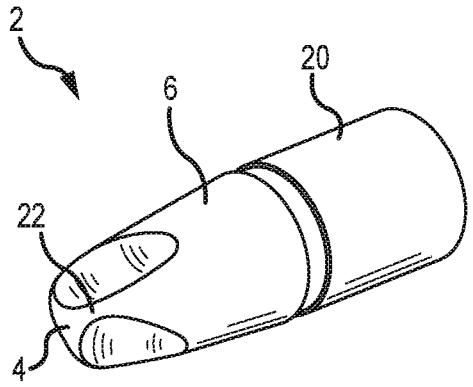
FIGS. 19A-C show a projectile according to a nineteenth embodiment of the invention.
Figure 19B:
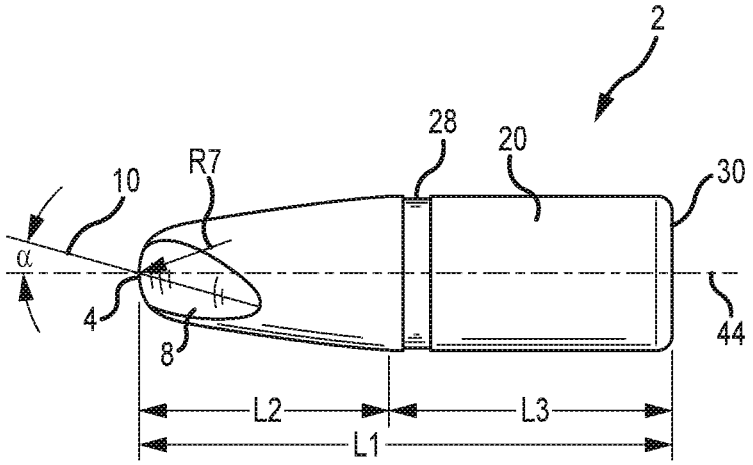
Figure 19C:
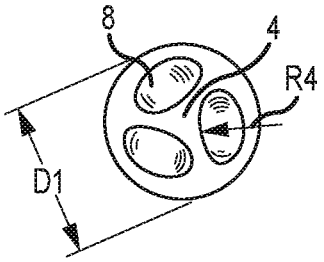

FIGS. 19A-C show a projectile according to a nineteenth embodiment of the invention. FIG. 19A is a perspective view of the projectile 2. FIG. 19B is a side elevation view of the projectile 2. FIG. 19C is a top plan view of the projectile 2. Note that FIGS. 19A-C are to scale.

The projectile 2 comprises a tip 4 on one end opposite a base 30 on the other end. The rounded tip 4 acts like pointed tip due to its aerodynamic properties. The projectile 2 comprises a nose portion 6 and a cylindrical portion 20. The nose portion 6 includes nose depressions 8 and nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. In one embodiment, the nose depressions are cut using a ⅜ inch ball end mill. In the embodiment of FIGS. 19A-C, the projectile 2 has one relief cut 28. In some embodiments, the projectile 2 includes a plurality of relief cuts 28.

The longitudinal axis 44 of the projectile 2 is shown in FIG. 19B. The angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. As shown in FIGS. 19A and 19C, the nose depressions 8 do not extend all the way to the tip 4 and the nose depressions 8 do not intersect one another. Thus, the remaining portions 22 extend to the tip 4. Additionally, the nose depressions 8 do not extend all the way to a forward portion of the cylindrical portion 20.

In one embodiment, the radius of curvature R4 of the nose depressions 8 is between about 0.05 inches and about 0.30 inches. In a preferred embodiment, the radius of curvature R4 of the nose depressions 8 is between about 0.10 inches and about 0.25 inches. In a more preferred embodiment, the radius of curvature R4 of the nose depressions 8 is about 0.1875 inches. In one embodiment, the length L1 of the projectile 2 is between about 0.5 inches and about 1.5 inches. In a preferred embodiment, the length L1 of the projectile 2 is between about 0.75 inches and about 1.25 inches. In a more preferred embodiment, the length L1 of the projectile 2 is about 1.0 inch. In one embodiment, the length L2 of the nose portion 6 is between about 0.25 inches and about 0.75 inches. In a preferred embodiment, the length L2 of the nose portion 6 is between about 0.4 inches and about 0.6 inches. In a more preferred embodiment, the length L2 of the nose portion 6 is about 0.500 inches. In one embodiment, the length L3 of the cylindrical portion 20 is between about 0.30 inches and about 0.70 inches. In a preferred embodiment, the length L3 of the cylindrical portion 20 is between about 0.40 inches and about 0.60 inches. In a more preferred embodiment, the length L3 of the cylindrical portion 20 is about 0.500 inches. The diameter D1 of the projectile 2 (also called the caliber) varies according the various embodiments. In one embodiment, the diameter D1 of the projectile 2 is between about 0.20 inches and about 0.50 inches. In a preferred embodiment, the diameter D1 of the projectile 2 is between about 0.30 inches and about 0.40 inches. In the embodiment shown, the diameter D1 of the projectile 2 is about 0.3075 inches. In one embodiment, the angle α of the nose depressions 8 is between about 3.0 degrees and about 10.0 degrees. In a preferred embodiment, the angle α of the nose depressions 8 is between about 4.5 degrees and about 6.5 degrees. In a more preferred embodiment, the angle α of the nose depressions 8 is about 5.5 degrees.

Figure 20A:
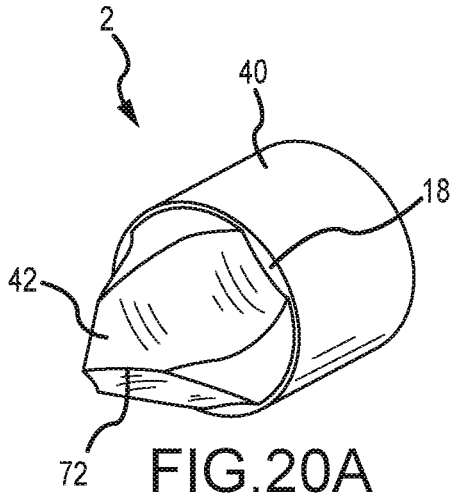
FIGS. 20A-D show a projectile according to a twentieth embodiment of the invention.
Figure 20B:
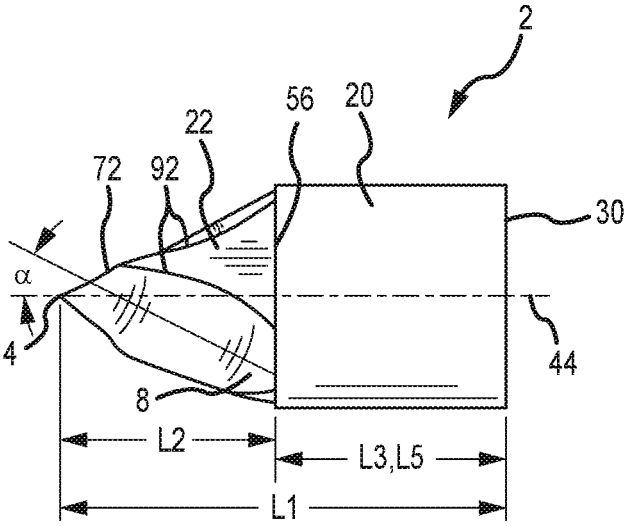
Figure 20C:
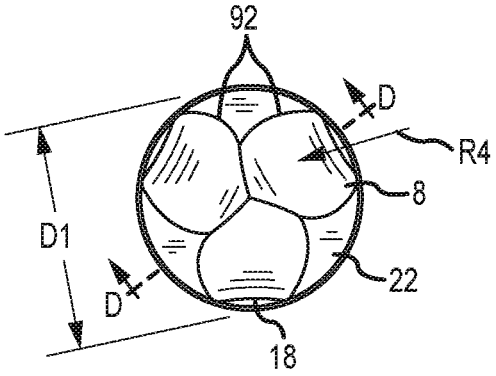
Figure 20D:
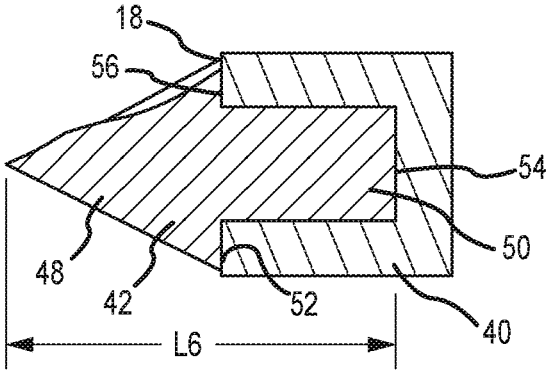

FIGS. 20A-D show a projectile according to a twentieth embodiment of the invention. FIG. 20A is a perspective view of the projectile 2. FIG. 20B is a side elevation view of the projectile 2. FIG. 20C is a top plan view of the projectile 2. FIG. 20D is a cross section taken at cut D-D of FIG. 20C.

The projectile 2 comprises a tip 4 on one end opposite a base 30 on the other end. The projectile 2 comprises a nose portion 6 and a cylindrical portion 20. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive. The remaining portions 22 have a generally triangular shape with the tip of the triangle positioned proximate to the tip 4 of the projectile and the base of the triangle positioned proximate to the rear of the nose 6 and the forward portion of the cylindrical portion 20. A first edge 92 is formed between a nose depression 8 and a remaining portion 22 and a second edge 72 proximate the tip 4 is formed between two nose depressions 8. The first edge 92 and/or the second edge 72 may be referred to as a cutter edge in some embodiments. The nose depressions 8 can terminate in a substantially flat shoulder 18 in some embodiments. In other embodiments, a shoulder is not present between the nose depressions 8 and the front 56 of the housing 40. The nose depressions 8 have a curved shape meaning that the trough or bottom of the nose depression 8 is curved and has a radius of curvature R4. In one embodiment, the nose depressions are cut using a ⅜ inch ball end mill.

The longitudinal axis 44 of the projectile 2 is shown in FIG. 20B. The angle α of the nose depressions 8 can be measured from the centerline 10 of the nose depressions 8 relative to the longitudinal axis 44. In some embodiments, the angle α is measured relative to the original ogive of the projectile nose portion 6 or the remaining portion 22. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8.

In one embodiment, the radius of curvature R4 of the nose depressions 8 is between about 1/32 inches and about 0.50 inches. In a preferred embodiment, the radius of curvature R4 of the nose depressions 8 is between about 3/32 inches and about ⅜ inches. In a more preferred embodiment, the radius of curvature R4 of the nose depressions 8 is about 0.1875 inches. In one embodiment, the length L1 of the projectile 2 is between about 0.400 inches and about 1.00 inch. In a preferred embodiment, the length L1 of the projectile 2 is between about 0.550 inches and about 0.850 inches. In a more preferred embodiment, the length L1 of the projectile 2 is about 0.710 inches. In one embodiment, the length L2 of the nose portion 6 is between about 0.150 inches and about 0.500 inches. In a preferred embodiment, the length L2 of the nose portion 6 is between about 0.350 inches and about 0.450 inches. In a more preferred embodiment, the length L2 of the nose portion 6 is about 0.400 inches. In one embodiment, the length L3 of the cylindrical portion 20 is between about 0.100 inches and about 0.500 inches. In a preferred embodiment, the length L3 of the cylindrical portion 20 is between about 0.200 inches and about 0.400 inches. In a more preferred embodiment, the length L3 of the cylindrical portion 20 is about 0.310 inches. The diameter D1 of the projectile 2 (also called the caliber) varies according the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 15 degrees. In a preferred embodiment, the angle α of the nose depressions 8 is between about 6 degrees and about 9 degrees. In a more preferred embodiment, the angle α of the nose depressions 8 is about 7.5 degrees.

The advantage of this projectile is that it can shoot through armor. This projectile 2 is different from the prior art because it can pierce armor and stop in soft tissue. The sharp tip 4 and sharp cutter edges 72 allow this projectile 2 to cut through armor, including Kevlar. Additionally, the shoulders 18 of the projectile enable the projectile 2 to stop in soft tissue because the shoulders 18 slow the projectile down once it hits soft tissue. This projectile 2 is likely for military use only.

The construction of this projectile 2 may be accomplished using a press or mill and lathe. One unique and innovative feature is the shape of the front of the projectile 2, which has a slight radius coming off the bearing surface 20 (the cylindrical portion or the shaft) but is largely formed by angled or slightly twisting depressions 8 pointed to the front. The depressions 8 form troughs and ridges 22 (or remaining portions between the depressions 8) that possess an angle or a slight radius off the centerline 44 (longitudinal axis) of the projectile. In some embodiments, the twist angle α of the depressions 8 corresponds to (i.e., is equal to) or is greater than the barrel twist rate (i.e., the twist rate of the rifling in the barrel) and turns in the same direction as the barrel's rifling. In other embodiments, the twist angle α of the depressions 8 is equal to or greater than the barrel twist rate and turns in the opposite direction as the barrel's rifling. These depressions 8 do not affect the projectile during internal ballistics but they greatly enhance the performance during external and/or terminal ballistics. In some embodiments, at the center of the tip 4 or a portion of the nose 6 proximate the tip 4, the ridges 92 meet to form a cutting surface or cutting edge 72. These edges 72 initiate a cut in the target, greatly reducing resistance through media such as sheet metal, fabrics, and soft armor. The twisting troughs 8 move media away from the projectile 2 further reducing resistance and promote and maintain the spin to ensure the projectile 2 penetrates deep and straight. The troughs 8 may rapidly move liquids and soft tissue away from the path of the projectile 2 and therefore increase the wound channel.

Referring to FIGS. 21A-23E, which are pistol projectile embodiments that, among other things, provide deep straight penetration. These pistol projectiles 2 are homogenous in nature and intended for deep, straight penetration. In one embodiment, the pistol projectile 2 is comprised of brass. These projectiles 2 are different from the prior art because they can pierce armor and stop in soft tissue. The sharp tip 4 and sharp cutter edges 72 allow these projectiles 2 to cut through armor, including Kevlar. Further, these projectiles 2 create a lot of cavitation in soft tissue, thus making a wound larger than it would be with a projectile of the prior art. Intended users of these projectiles 2 comprise military and law enforcement.

The construction of these projectiles 2 may be accomplished using a press or mill and lathe. One unique and innovative feature is the shape of the front of the projectile 2, which has a slight radius coming off the bearing surface 20 (the cylindrical portion or the shaft) but is largely formed by angled or slightly twisting depressions 8 pointed to the front. The depressions 8 form troughs and ridges 22 (or remaining portions between the depressions) that possess an angle or a slight radius off the centerline 44 (longitudinal axis) of the projectile 2. In some embodiments, the twist angle α of the depressions 8 corresponds to (i.e., is equal to) or is greater than the barrel twist rate (i.e., the twist rate of the rifling in the barrel) and turns in the same direction as the barrel's rifling. In other embodiments, the twist angle α of the depressions 8 is equal to or greater than the barrel twist rate and turns in the opposite direction as the barrel's rifling. These depressions 8 do not affect the projectile 2 during internal ballistics but they greatly enhance the performance during external and/or terminal ballistics. In some embodiments, at the center of the tip 4 or a portion of the nose 6 proximate the tip 4, the ridges 92 meet to form a cutting surface or cutting edge 72. These edges 72 initiate a cut in the target, greatly reducing resistance through media such as sheet metal, fabrics, and soft armor. The twisting troughs 8 move media away from the projectile 2 further reducing resistance and promote and maintain the spin to ensure the projectile 2 penetrates deep and straight. The troughs 8 may rapidly move liquids and soft tissue away from the path of the projectile 2 and therefore increase the wound channel.

In one embodiment, the pistol projectile 2 is manufactured via a Swiss Turn machine or the combination of a lathe and mill. Alternatively, the pistol projectile 2 is manufactured via a powdered or gilding metal that is then pressed into a die at high pressure. Due to the direct interface with the barrel, a softer metal may be used. The sharp edges 72 in the front create the ability to penetrate armor (hard and soft) and metal. Testing has revealed that the 78 grain 9 mm projectile moving at 1550 fps will penetrate the following materials: 16 sheets of 22-gauge steel and Level IIIA soft Kevlar. This same projectile fired from a 380 moving 830 fps will penetrate Level IIIA soft armor. If the twist (angle α from centerline 44) of the trough 8 is in the same direction of the rifling, it will increase the penetration in tissue. The angle α is to be equal to or greater than the angle of the rifling.

The angle of the rifling is subject to change by barrel twist rate and caliber. For example, a 9 mm (0.355") with a 1 in 10" rate of twist will have a different alpha (α) angle than the same rate of twist in a 45 ACP (0.451"). Different barrels will have different rates of twist and can differ in the direction of the twist. In FIGS. 21-23, all the alpha angles are set to 15 degrees or 25 degrees. When this projectile 2 is fired from a barrel that twists in the opposing direction of the alpha angle, the penetration lessens but the tissue damage increases. A lower alpha angle or thicker/fatter front to the projectile 2 will have greater tissue damage and a lesser ability to penetrate armor. A higher alpha angle or sharper projectile will penetrate better but do less tissue damage.

In one embodiment of the pistol projectile, terminal ballistics traits are emphasized. The tip 4 of the projectile 2 is formed such that the trough 8 is at an angle α relative to the longitudinal axis 44 of the projectile 2. Due to magazine and chamber constraints, projectiles have a maximum length. The density of the material will determine this alpha angle because a steeper alpha angle cuts better, but has a lower weight.

In some embodiments, the twist rate a of the ridges 92 can equal to or exceeds, by up to double, the twist rate of the barrel. In one embodiment, the projectile 2 would increase the rate of twist once it struck the terminal media. In one embodiment, a projectile 2 with a counter twist to (i.e., in the opposite direction of) the rifling is provided, therefore limiting penetration once it cuts through the outer layer of its target. Twist rates in most handguns, run from 4-7 degrees, but could be between 2-10 degrees.

In general, the non-congruent twist penetrates less into the target and larger end mill cuts penetrate less into the target. These projectiles 2 create cavitation and slow down in soft tissue. The advantages generally include the ease of manufacturing and the non-expanding bullet (i.e., no housing and cavities). Further, the projectile 2 does not deflect in auto glass, it shoots through sheet metal and body armor using its cutting edges 72, and it creates a cavitation in tissue to help the projectile 2 slow down in the soft tissue. A congruent twist will increase the depth of the projectile's penetration in soft media. The shorter the distance the projectile travels in the target, the more energy is released in a shorter distance. Thus, a wider tissue area is affected in order to absorb the energy.

This projectile 2 is different from the prior art because it can pierce armor and stop in soft tissue. The sharp tip 4 and sharp cutter edges 72 allow this projectile 2 to cut through armor, including Kevlar. Additionally, the nose depressions 8 positioned at an angle α greater than about 10 degrees create cavitation to collect the target medium such that the projectile 2 stops in soft tissue. This projectile is likely for military and civilian use. The density of the projectiles may be about 7 g/cm$^3$.

Figure 21A:
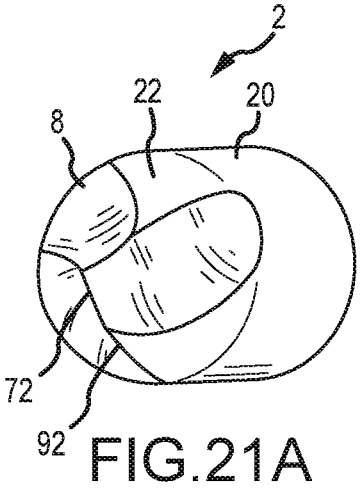
FIGS. 21A-C show a projectile according to a twenty-first embodiment of the invention.
Figure 21B:
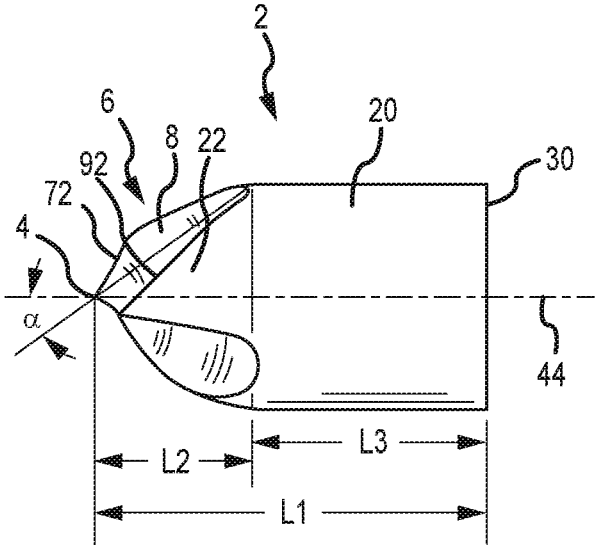
Figure 21C:
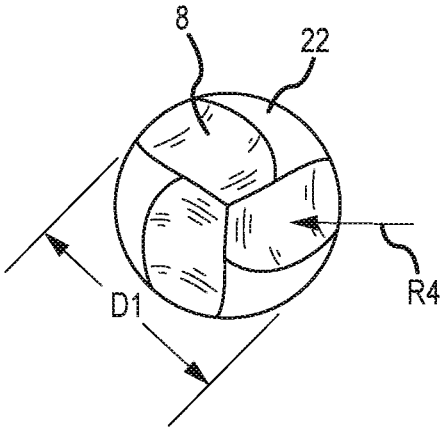

FIGS. 21A-C show a projectile according to a twenty-first embodiment of the invention. FIG. 21A is a perspective view of the projectile 2. FIG. 21B is a side elevation view of the projectile 2. FIG. 21C is a top plan view of the projectile 2. Note that FIGS. 21A-C are to scale.

The projectile 2 comprises a tip 4 on one end opposite a base 30 on the other end. The projectile 2 comprises a nose portion 6 and a cylindrical portion 20. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. In one embodiment, the nose depressions are cut using a 3/16 inch ball end mill. The nose depressions 8 extend from a front portion of the cylindrical portion 20 to the tip 4 of the projectile.

The longitudinal axis 44 of the projectile 2 is shown in FIG. 21B. The angle α of the nose depressions 8 can be measured from the centerline 10 of the nose depressions 8 relative to the longitudinal axis 44. As with all embodiments described herein, the nose depressions 8 can be right or left-hand depressions 8. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are left-hand nose depressions 8 because the angle α is positioned to the left of the longitudinal axis 44. In one embodiment, the projectile 2 has at least three nose depressions 8. However, the projectile 2 can have more or fewer nose depressions 8.

In one embodiment, the radius of curvature R4 of the nose depressions 8 is between about 0.05 inches and about 0.15 inches. In a preferred embodiment, the radius of curvature R4 of the nose depressions 8 is between about 0.075 inches and about 0.11 inches. In a more preferred embodiment, the radius of curvature R4 of the nose depressions 8 is about 0.09375 inches. In one embodiment, the length L1 of the projectile 2 is between about 0.40 inches and about 0.80 inches. In a preferred embodiment, the length L1 of the projectile 2 is between about 0.50 inches and about 0.60 inches. In a more preferred embodiment, the length L1 of the projectile 2 is about 0.600 inches. In one embodiment, the length L2 of the nose portion 6 is between about 0.20 inches and about 0.40 inches. In a preferred embodiment, the length L2 of the nose portion 6 is between about 0.25 inches and about 0.35 inches. In a more preferred embodiment, the length L2 of the nose portion 6 is about 0.315 inches. In one embodiment, the length L3 of the cylindrical portion 20 is between about 0.20 inches and about 0.50 inches. In a preferred embodiment, the length L3 of the cylindrical portion 20 is between about 0.25 inches and about 0.35 inches. In a more preferred embodiment, the length L3 of the cylindrical portion 20 is about 0.285 inches. The diameter D1 of the projectile 2 varies according the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 45 degrees. In a preferred embodiment, the angle α of the nose depressions 8 is between about 20 degrees and about 30 degrees. In a more preferred embodiment, the angle α of the nose depressions 8 is about 25 degrees.

Figure 22A:
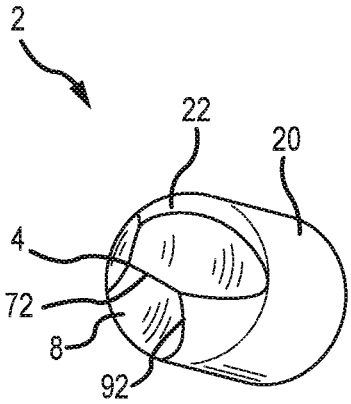
FIGS. 22A-C show a projectile according to a twenty-second embodiment of the invention.
Figure 22B:
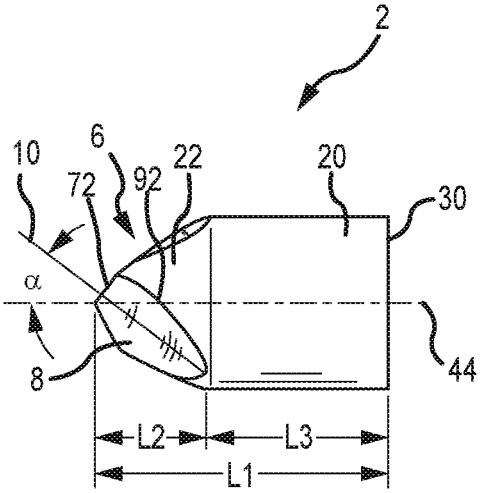
Figure 22C:
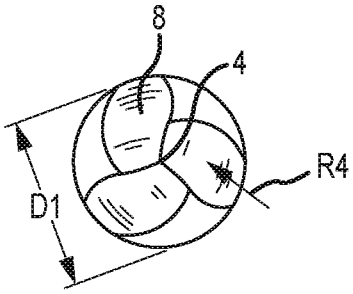

FIGS. 22A-C show a projectile according to a twenty-second embodiment of the invention. FIG. 22A is a perspective view of the projectile 2. FIG. 22B is a side elevation view of the projectile 2. FIG. 22C is a top plan view of the projectile 2. Note that FIGS. 22A-C are to scale.

FIGS. 22A-C are the same as FIGS. 21A-C except that the nose depressions 8 are right-hand nose depressions 8 because the angle α is positioned to the right of the longitudinal axis 44. Further, the nose depressions 8 are cut using a 3/8 inch ball end mill. The nose depressions 8 in FIG. 22A-C may be shorter and deeper than the nose depression 8 of FIGS. 21A-C. In one embodiment, the radius of curvature R4 of the nose depressions 8 is between about 0.10 inches and about 0.30 inches. In a preferred embodiment, the radius of curvature R4 of the nose depressions 8 is between about 0.15 inches and about 0.25 inches. In a more preferred embodiment, the radius of curvature R4 of the nose depressions 8 is about 0.1875 inches.

Figure 23A:
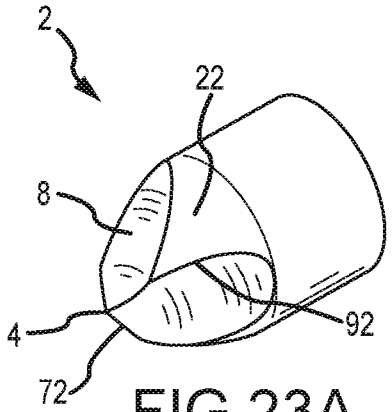
FIGS. 23A-E show a projectile according to a twenty-third embodiment of the invention.
Figure 23B:
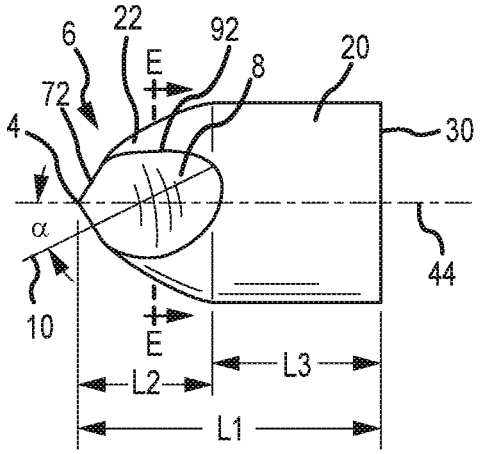
Figure 23C:
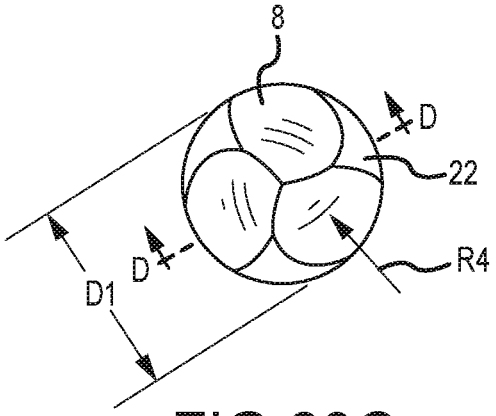
Figure 23D:
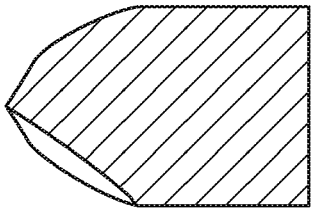
Figure 23E:
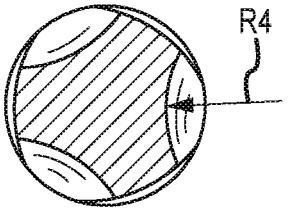

FIGS. 23A-E show a projectile according to a twenty-third embodiment of the invention. FIG. 23A is a perspective view of the projectile 2. FIG. 23B is a side elevation view of the projectile 2. FIG. 23C is a top plan view of the projectile 2. FIG. 23D is a cross section taken at cut D-D. FIG. 23E is a cross section taken at cut E-E. Note that FIGS. 23A-E are to scale.

FIGS. 23A-E are the same as FIGS. 21A-C except that the nose depressions 8 are cut using a 0.50 inch ball end mill. Each nose depression 8 has a radius of curvature R4 because it has a curved or rounded bottom. The radius of curvature R4 of the depression 8 is shown in FIGS. 23C and 23E. In one embodiment, the radius of curvature R4 of the nose depressions 8 is between about 0.10 inches and about 0.50 inches. In a preferred embodiment, the radius of curvature R4 of the nose depressions 8 is between about 0.20 inches and about 0.30 inches. In a more preferred embodiment, the radius of curvature R4 of the nose depressions 8 is about 0.25 inches. Further, the diameter D1 of the projectile 2 varies according the various embodiments. In one embodiment, the diameter D1 of the projectile 2 is between about 0.200 inches and about 0.600 inches. In a preferred embodiment, the diameter D1 of the projectile 2 is between about 0.300 inches and about 0.50 inches. In the embodiment shown, the diameter D1 of the projectile 2 is about 0.400 inches. In another preferred embodiment, the diameter D1 of the projectile 2 is about 0.450 inches.

Figure 24A:
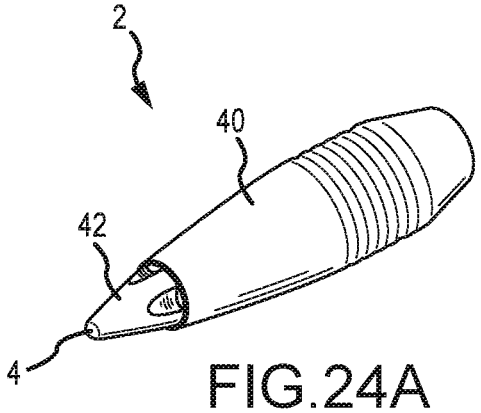
FIGS. 24A-D show a projectile according to a twenty-fourth embodiment of the invention.
Figure 24B:
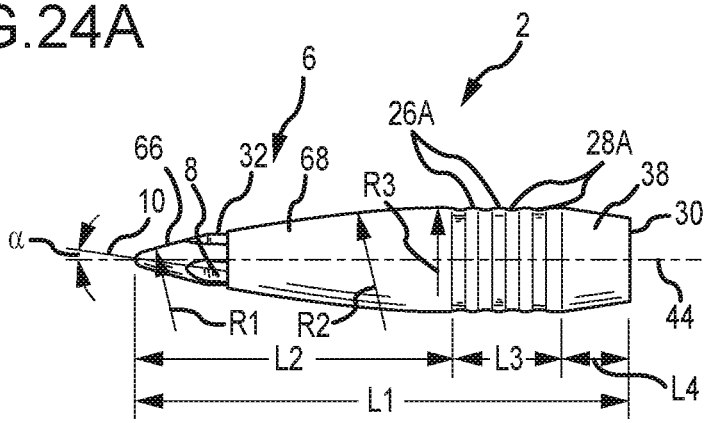
Figure 24C:
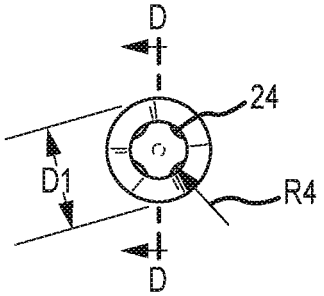
Figure 24D:
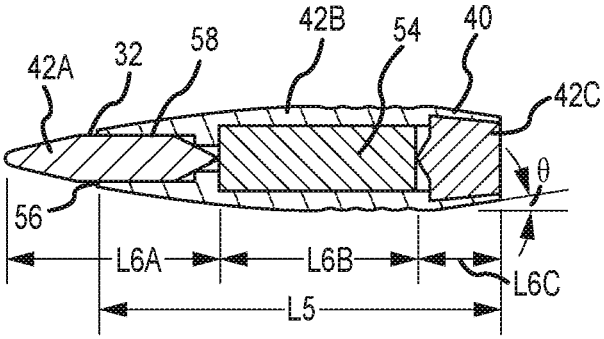

FIGS. 24A-D show a projectile according to a twenty-fourth embodiment of the invention. FIG. 24A is a perspective view of the projectile 2. FIG. 24B is a side elevation view of the projectile 2. FIG. 24C is a top plan view of the projectile 2. FIG. 24D shows a cross section of the projectile 2 taken along cut D-D of FIG. 24B. Note that FIGS. 24A-D are to scale. FIG. 24 is the same as FIG. 35 except that the projectile of FIG. 24 has three inserts, 42A, 42B, 42C. Further, the first insert 42A is metal, for example, steel, Inconel, or another hard metal. The second insert 42B is aluminum or other soft metal. The third insert 42C is tungsten or another hard metal. Cavities 24 are positioned between the inserts 42A, 42B, 42C and the housing 40.

The longitudinal axis 44 of the projectile 2 is shown in FIG. 24B. Accordingly, the angle $\alpha$ of the nose depressions 8 can be measured from the centerline 10 of the nose depressions 8 relative to the longitudinal axis 44. In the embodiment shown, the nose depressions 8 are right-hand nose depressions 8 because the angle $\alpha$ is positioned to the right of the longitudinal axis 44. In one embodiment, the projectile 2 has at least three nose depressions 8. The depressions 8 create cavities 24 between the inserts 42A, 42B, 42C, and the housing 40 such that when the projectile 2 hits a soft medium target, the cavities 24 fill with the soft medium and the projectile slows down. The steeper (i.e., greater) alpha angle will also transfer media at a greater rate into the housing for a faster opening and expansion of the housing 40 upon impact with the terminal media.

The cylindrical portion 20 comprises angled drive bands 26A and angled relief cuts 28A. The angled drive bands 26A and angled relief cuts 28A create air disturbances that stabilize the projectile 2 in flight allowing the projectile 2 to fly straighter and be less affected by cross winds than projectiles of the prior art.

Figure 25A:
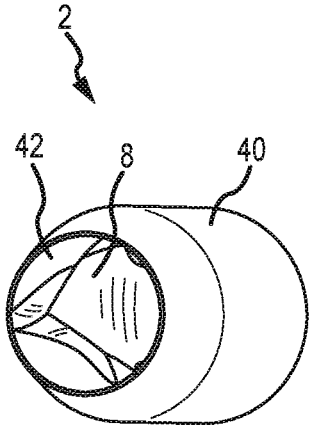
FIGS. 25A-C show a projectile according to a twenty-fifth embodiment of the invention.
Figure 25B:
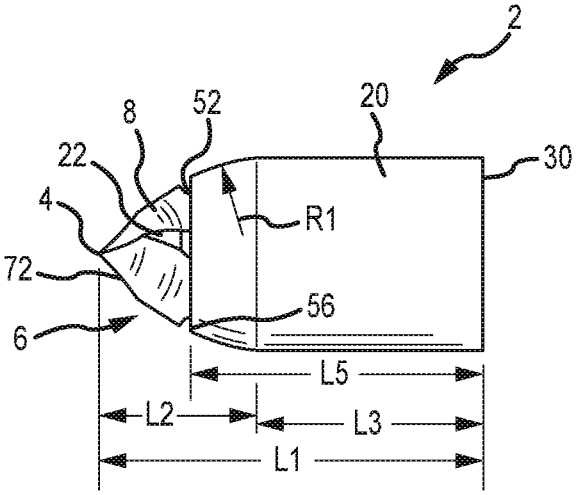
Figure 25C:
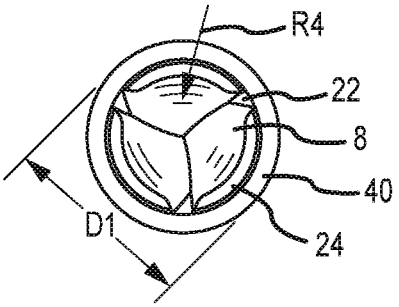
Figure 30A:
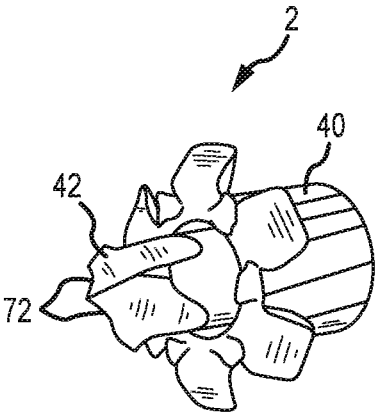
FIGS. 30A-C show the projectile of FIGS. 25A-C after being fired.

FIGS. 25A-C show a projectile 2 according to a twenty-fifth embodiment of the invention. This projectile 2 creates large cavitations and giant wounds. When the projectile 2 hits soft tissue, the housing 40 flowers and peels backward as shown in FIG. 30. This projectile 2 can also be accurately shot through glass because it maintains its original flight path. The projectile 2 keeps its shape through hard material (e.g., glass or steel) and it keeps its trajectory: tip forward flight. It can also penetrate body armor and stop in soft tissue because when it hits soft tissue it opens up (see FIGS. 30A-31C). FIG. 25A is a perspective view of the projectile 2. FIG. 25B is a side elevation view of the projectile 2. FIG. 25C is a top plan view of the projectile 2. Note that FIGS. 25A-C are to scale.

Figure 26A:
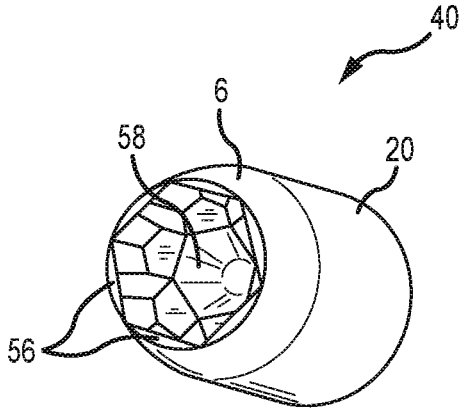
FIGS. 26A-B show the projectile housing of FIGS. 25A-C.
Figure 26B:
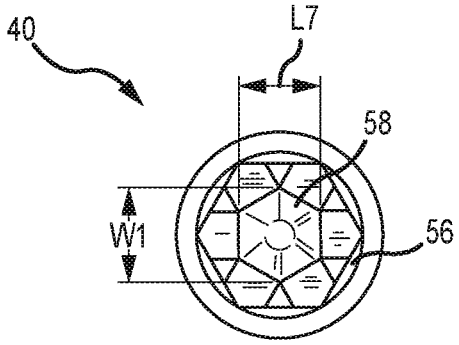
Figure 27A:
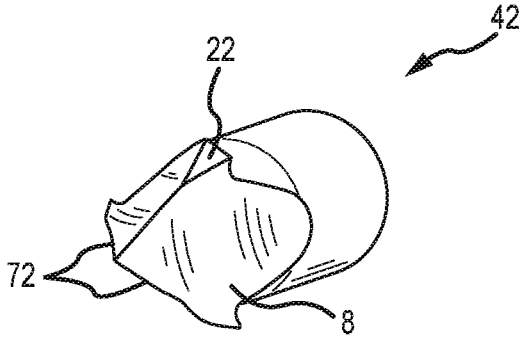
FIGS. 27A-C show the projectile insert of FIGS. 25A-C.
Figure 27B:
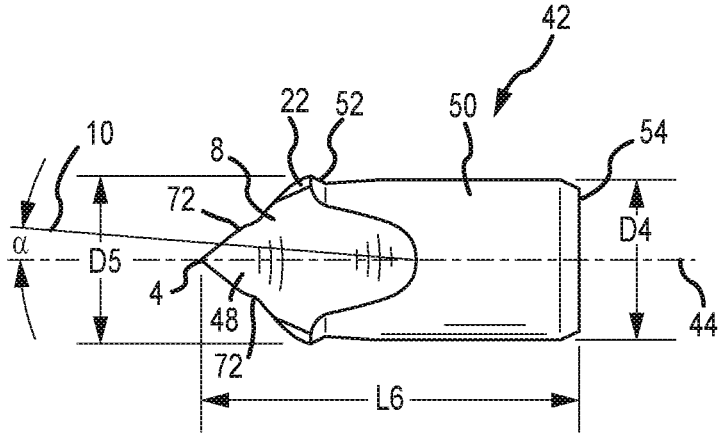
Figure 27C:
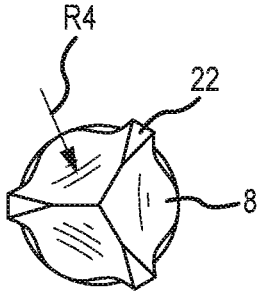

FIGS. 27A-C show the insert 42 used in the projectile 2 of FIGS. 25A-C. FIGS. 26A-B show the housing 40 used in the projectile 2 of FIG. 25A-C. FIGS. 25A-C depict a two-piece bullet embodiment. Intended users comprise military, law enforcement, and private citizens. Among other things, these embodiments provide deep straight penetration in, for example, sheet metal, clothing, soft armor, and fabrics, but may provide limited penetration in tissue. These embodiments may be manufactured of materials comprising brass, copper, aluminum, tungsten-carbide, or alloys to form the insert 42 and copper or brass, for example, to form the housing 40.

The construction of these projectiles 2 may be accomplished using a press or mill and lathe. One feature is the shape of the insert 42 of the projectile 2, largely formed by slightly twisting depressions 8 pointed to the front of the insert 42. The depressions 8 form troughs and ridges that form the point 4 of the insert 42. The tip 4 of the insert is positioned forward of the housing 40 and the terminal ends of the troughs 8 and ridges 22 extend into the housing 40. Proximate the tip 4, the depressions 8 intersect forming cutting edges 72. The cutting edges 72 initiate a cut in the target to promote the penetration through the outer layer and because a portion of the troughs 8 are inside the housing 40 results in rapid and violent expansion of the housing 40 upon impact with the projectile's target. The twist of the depressions 8 corresponds to or is greater than the twist rate of the rifling in the barrel and the depressions 8 turn in the same direction or the opposite direction of the barrel. The projectile can also have a cut perpendicular to the radius line which would generate a zero twist degree. At the center of the tip 4, the ridges 72 join together to form a cutting surface. These edges 72 initiate a cut, greatly reducing resistance through media such as sheet metal, fabrics, and soft armor. The twisting troughs 8 move media away from the projectile 2 and rapidly open the housing 40 to create greater frontal surface area of the projectile 2 during terminal ballistics. In one embodiment, a cap is pressed into place that covers the insert and is held by the housing, which provides a first media to initiate the opening of the housing during the first stages of terminal ballistics.

One advantage of the housing is the ability to make the insert 42 out of almost any material (e.g., brass, aluminum, steel, polymers, etc.). The insert 42 does not interface with the barrel so the use of hard materials or even steel is also feasible. Both steel and aluminum in both similar and opposed twist directions have been tested and are further embodiments. When the twist rate is opposed to the rifling, in particular with the aluminum insert, the tissue destruction is immense. All testing has shown that all these designs will penetrate in similar fashion on both hard and soft armor. The steeper (i.e., greater) alpha angle will also transfer media at a greater rate into the housing for a faster opening and expansion of the housing 40 upon impact with the terminal media.

The projectile 2 comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4.

The longitudinal axis 44 of the projectile 2 is shown in FIG. 27B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. However, the projectile 2 can have more or fewer nose depressions 8.

In one embodiment, the radius of curvature R4 of the nose depressions 8 is between about ¼ and ¾ inch. In a preferred embodiment, the radius of curvature R4 of the nose depressions 8 is between about ⅜ and ½ inch. In one embodiment, the length L1 of the projectile 2 is between about 0.5 inches and about 0.8 inches. In a preferred embodiment, the length L1 of the projectile 2 is between about 0.69 inches and about 0.71 inches. In a more preferred embodiment, the length L1 of the projectile 2 is about 0.670 inches. In one embodiment, the length L2 of the nose portion 6 is between about 0.35 inches and about 0.39 inches. In a preferred embodiment, the length L2 of the nose portion 6 is between about 0.36 inches and about 0.38 inches. In a more preferred embodiment, the length L2 of the nose portion 6 is about 0.37 inches. In one embodiment, the length L5 of the housing 40 is between about 0.316 inches and about 0.716 inches. In a preferred embodiment, the length L5 of the housing 40 is between about 0.416 inches and about 0.616 inches. In a more preferred embodiment, the length L5 of the housing 40 is about 0.516 inches. The diameter D1 of the projectile 2 (also called the caliber) varies according the various embodiments. In one embodiment, the diameter D1 of the projectile 2 is between about 11 mm and about 7 mm. In a preferred embodiment, the diameter D1 of the projectile 2 is between about 10 mm and about 8 mm. In the embodiment shown, the diameter D1 of the projectile 2 is about 9 mm.

FIGS. 26A-B show the projectile housing 40 of FIGS. 25A-C. FIG. 26A is a perspective view of the housing 40. FIG. 26B is a top plan view of the housing 40. Note that FIGS. 26A-B are to scale.

In a preferred embodiment, the dimension W1 of the projectile 2 is between about 0.070 inches and about 0.470 inches. In a more preferred embodiment, the dimension W1 of the projectile 2 is about 0.270 inches. In one embodiment, the length L7 is between about 0.145 inches and about 0.345 inches. In a preferred embodiment, the length L7 is about 0.245 inches.

FIGS. 27A-29C detail the insert 42 mounted inside a housing 40. These housings can be formed on a lathe or press and may be made from copper or brass. Any material that will not harm a barrel would be also be acceptable and form alternative embodiments of the housing 40. The addition of the housing 40 lessens the penetration in tissue by creating greater frontal surface area and therefore increases trauma. FIGS. 27A-29C detail the insert 42 mounted inside a housing 40. By varying the alpha and beta angles of the insert 42, one can control the penetration in armor and the destruction in tissue.

The tip of the insert is formed such that the depression or trough 8 is at an angle α relative to the longitudinal axis 44 of the insert 42. Due to magazine and chamber constraints, projectiles have a maximum length. The density of the material used and the size of the insert 42 and projectile will determine this alpha angle because a steeper alpha angle cuts better, but has a lower weight. The steeper alpha angle will also transfer media at a greater rate into the housing for a faster opening and expansion upon impact with the terminal media.

In some embodiments, the twist rate of the depressions 8 can equal or exceed, by up to double, the twist rate of the gun barrel. In one embodiment, the projectile would increase the rate of twist once it struck the terminal media. In one embodiment, an insert 42 with a counter twist to (i.e., in the opposite direction of) the rifling is provided, therefore limiting penetration once it cuts through the outer layer of its target. The twist rate of the depressions 8 of the insert 42 may also be reversed (i.e., in the opposite direction to the barrel twist). Twist rates in most handguns run from about 4-7 degrees, but could be between about 2-10 degrees.

FIGS. 27A-C show the projectile insert 42 of FIGS. 25A-C. FIG. 27A is a perspective view of the insert 42. FIG. 27B is a side elevation view of the insert 42. FIG. 27C is a top plan view of the insert 42. Note that FIGS. 27A-C are to scale.

The insert 42 comprises a tip 4 on one end opposite a lower portion 54 on the other end. The insert 42 comprises an arrowhead portion 48 and a stem portion 50. The underside 52 of the arrowhead 48 can be flat, angled, or rounded. The insert 42 includes nose depressions 8 (also called cutouts or troughs) and a nose remaining portion 22 between the nose depressions 8, where each nose remaining portion 22 is positioned between two nose depressions 8. The remaining portions 22 are the uncut portions having the insert's original ogive and radius of curvature R1. The nose depressions 8 have a curved shape meaning that the trough or bottom of the nose depression 8 is curved and has a radius of curvature R4. In one embodiment, the nose depressions are cut using a ⅜ inch flat end mill.

The longitudinal axis 44 of the insert 42 is shown in FIG. 27B. Accordingly, the angle α of the nose depressions 8 can be measured from the centerline 10 of the nose depressions 8 relative to the longitudinal axis 44. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. However, the projectile 2 can have more or fewer nose depressions 8. The nose depressions 8 intersect one another to form cutter edges 72 extending to the tip 4 of the insert 42.

In one embodiment, the radius of curvature R4 of the nose depressions 8 is between about 0.05 inches and about 0.75 inches. In a preferred embodiment, the radius of curvature R4 of the nose depressions 8 is between about 0.10 inches and about 0.5 inches. In a more preferred embodiment, the radius of curvature R4 of the nose depressions 8 is about 0.4 inches. In one embodiment, the length L6 of the insert 42 is between about 0.513 inches and about 0.713 inches. In a preferred embodiment, the length L6 of the insert 42 is between about 0.413 inches and about 0.613 inches. In a more preferred embodiment, the length L6 of the insert 422 is about 0.513 inches. However, the length L6 varies with the embodiment and with the caliber of the projectile. The diameter D4 of the stem 50 of the insert 42 varies according the various embodiments. In one embodiment, the diameter D4 of the projectile 2 is between about 0.1 inches and about 0.4 inches. In a preferred embodiment, the diameter D4 of the stem 50 of the insert 42 is between about 0.2 inches and about 0.28 inches. In the embodiment shown, the diameter D4 of the stem 50 of the insert 42 is about 0.225 inches. In one embodiment, the diameter D5 of the arrowhead 48 of the insert 42 is between about 0.1 inches and about 0.4 inches. In a preferred embodiment, the diameter D5 of the arrowhead 48 is between about 0.2 inches and about 0.3 inches. In the embodiment shown, the diameter D5 of the arrowhead 48 is about 0.25 inches. In one embodiment, the angle α of the nose depressions 8 is between about 5 degrees and about 25 degrees. In a preferred embodiment, the angle α of the nose depressions 8 is between about 8 degrees and about 12 degrees. In a more preferred embodiment, the angle α of the nose depressions 8 is about 10 degrees.

This insert 42 is different from the prior art because it can pierce armor and the projectile stops in soft tissue. The sharp tip 4 and sharp cutter edges 72 allow this insert 42 to cut through armor, including Kevlar.

Figure 28A:
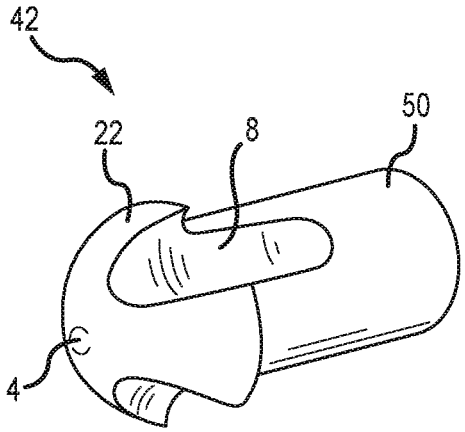
FIGS. 28A-C show a projectile insert according to another embodiment of the invention.
Figure 28B:
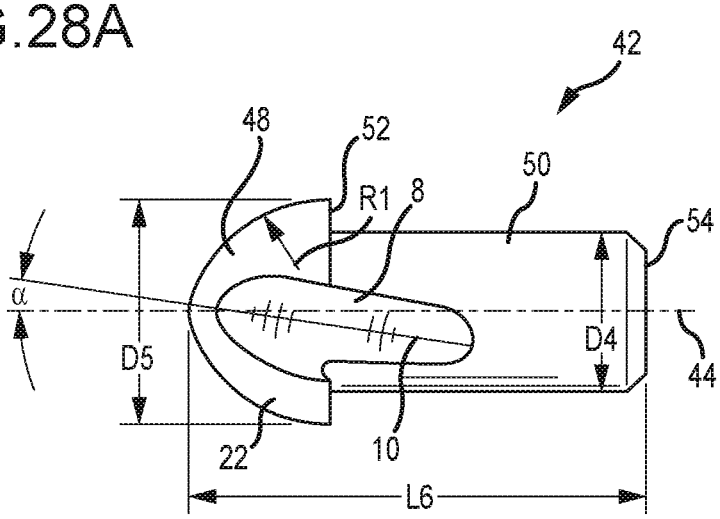
Figure 28C:
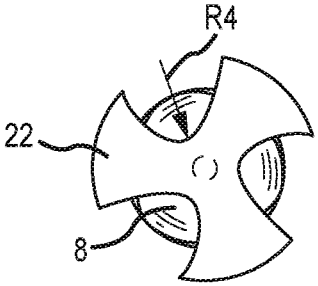

FIGS. 28A-C show a projectile insert 42 according to another embodiment of the invention. This is the civilian insert of FIG. 27. FIG. 28A is a perspective view of the insert 42. FIG. 28B is a side elevation view of the insert 42. FIG. 28C is a top plan view of the insert 42. Note that FIGS. 28A-C are to scale.

The insert 42 comprises a tip 4 on one end opposite a lower portion 54 on the other end. The insert 42 comprises an arrowhead portion 48 and a stem portion 50. The underside 52 of the arrowhead 48 can be angled, flat, or curved. The insert 42 includes nose depressions 8 (also called cutouts or troughs) and nose remaining portions 22 between the nose depressions 8, where each nose remaining portion 22 is positioned between two nose depressions 8. The remaining portions 22 are the uncut portions having the insert's original ogive and radius of curvature R1. The nose depression 8 has a curved shape meaning that the trough or bottom of the nose depression 8 is curved and has a radius of curvature R4. In one embodiment, the nose depressions 8 are cut using a 3/32 inch flat end mill.

The longitudinal axis 44 of the insert 42 is shown in FIG. 28B. Accordingly, the angle α of the nose depressions 8 can be measured from the centerline 10 of the nose depressions 8 relative to the longitudinal axis 44. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the insert 42 has at least three nose depressions 8. However, the insert 42 can have more or fewer nose depressions 8. In this embodiment, the depressions 8 do not extend all the way to the tip 4 and do not intersect. Rather, the remaining portions 22 extend to the tip 4.

In one embodiment, the radius of curvature R4 of the nose depressions 8 is between about 0.01 and about 0.5 inches. In a preferred embodiment, the radius of curvature R4 of the nose depressions 8 is between about 0.03 inches and about 0.375 inches. In a more preferred embodiment, the radius of curvature R4 of the nose depressions 8 is about 0.25 inches. In one embodiment, the length L6 of the insert 42 is between about 0.426 inches and about 0.826 inches. In a preferred embodiment, the length L6 of the insert 42 is between about 0.526 inches and about 0.726 inches. In a more preferred embodiment, the length L6 of the insert 42 is about 0.626 inches. The diameter D4 of the projectile 2 varies according the various embodiments. In one embodiment, the diameter D4 of the stem 50 is between about 0.1 inches and about 0.4 inches. In a preferred embodiment, the diameter D4 of the stem 50 is between about 0.2 inches and about 0.3 inches. In the embodiment shown, the diameter D4 of the stem 50 is about 0.225 inches. In one embodiment, the diameter D5 of the arrowhead 48 of the insert 42 is between about 0.1 inches and about 0.5 inches. In a preferred embodiment, the diameter D5 of the arrowhead 48 is between about 0.2 inches and about 0.4 inches. In the embodiment shown, the diameter D5 of the arrowhead 48 is about 0.30 inches. In one embodiment, the angle α of the nose depressions 8 is between about 5 degrees and about 25 degrees. In a preferred embodiment, the angle α of the nose depressions 8 is between about 8 degrees and about 12 degrees. In a more preferred embodiment, the angle α of the nose depressions 8 is about 10 degrees.

Figure 29A:
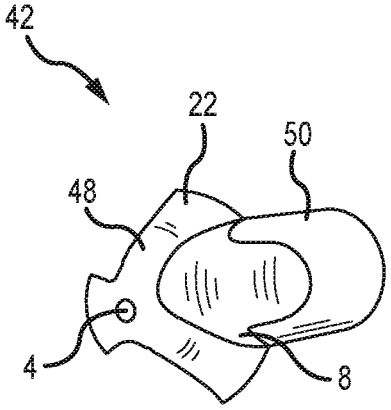
FIGS. 29A-C show a projectile insert according to alternate embodiment of the invention.
Figure 29B:
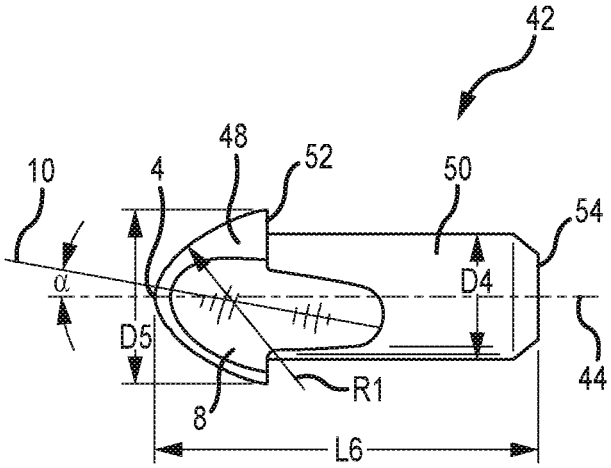
Figure 29C:
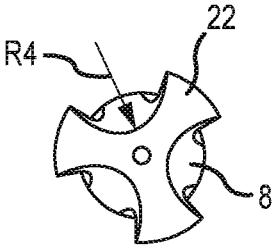

FIGS. 29A-C show a projectile insert 42 according to an alternate embodiment of the invention. The insert 42 can be made of any projectile or bullet material, such as brass or steel. FIG. 29A is a perspective view of the insert 42. FIG. 29B is a side elevation view of the insert 42. FIG. 29C is a top plan view of the insert 42. Note that FIGS. 29A-C are to scale.

The insert 42 comprises a tip 4 on one end opposite a lower portion 54 on the other end. The insert 42 comprises an arrowhead portion 48 and a stem portion 50. The insert 42 includes nose depressions 8 (also called cutouts or troughs) and nose remaining portion 22 between the nose depressions 8, where each nose remaining portion 22 is positioned between two nose depressions 8. The remaining portions 22 are the uncut portions having the insert's original ogive and radius of curvature R1. The nose depressions 8 have a curved shape meaning that the trough or bottom of the nose depression 8 is curved and has a radius of curvature R4. In one embodiment, the nose depressions 8 are cut using a 3/16 inch flat end mill.

The longitudinal axis 44 of the projectile 2 is shown in FIG. 29B. The angle α of the nose depressions 8 can be measured from the centerline 10 of the nose depressions 8 relative to the longitudinal axis 44. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the insert 42 has at least three nose depressions 8. However, the insert 42 can have more or fewer nose depressions 8. Also, like FIGS. 28A-C, the depressions 8 do not intersect. Rather, the nose remaining portions 22 extend to the tip 4 of the insert 42.

In one embodiment, the radius of curvature R4 of the nose depressions 8 is between about 0.05 inches and about 0.5 inches. In a preferred embodiment, the radius of curvature R4 of the nose depressions 8 is between about 0.08 inches and about 0.375 inches. In a more preferred embodiment, the radius of curvature R4 of the nose depressions 8 is about 0.25 inches. In another more preferred embodiment, the radius of curvature of the depression 8 is about 0.09375 inches. In one embodiment, the length L6 of the insert 42 is between about 0.436 inches and about 0.836 inches. In a preferred embodiment, the length L6 of the insert 42 is between about 0.536 inches and about 0.736 inches. In a more preferred embodiment, the length L6 of the insert 42 is about 0.636 inches. The diameter D4 of the stem 50 of the insert varies according the various embodiments. In one embodiment, the diameter D4 of the stem 50 is between about 0.025 inches and about 0.425 inches. In a preferred embodiment, the diameter D4 of the stem 50 is between about 0.125 inches and about 0.325 inches. In the embodiment shown, the diameter D4 of the stem 50 is about 0.225 inches. In one embodiment, the diameter D5 of the arrowhead 48 of the insert 42 is between about 0.1 inches and about 0.5 inches. In a preferred embodiment, the diameter D5 of the arrowhead 48 is between about 0.2 inches and about 0.4 inches. In the embodiment shown, the diameter D5 of the arrowhead 48 is about 0.3 inches. In one embodiment, the angle α of the nose depressions 8 is between about 5 degrees and about 25 degrees. In a preferred embodiment, the angle α of the nose depressions 8 is between about 8 degrees and about 12 degrees. In a more preferred embodiment, the angle α of the nose depressions 8 is about 10 degrees.

Figure 30B:
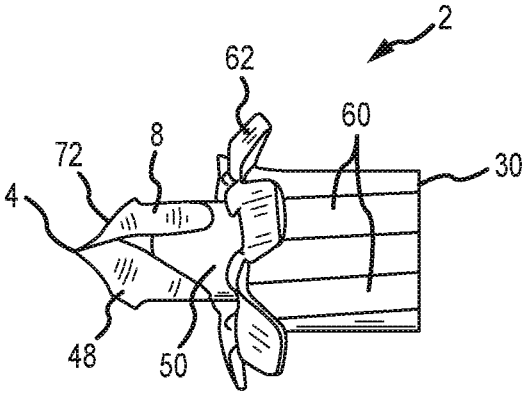
Figure 30C:
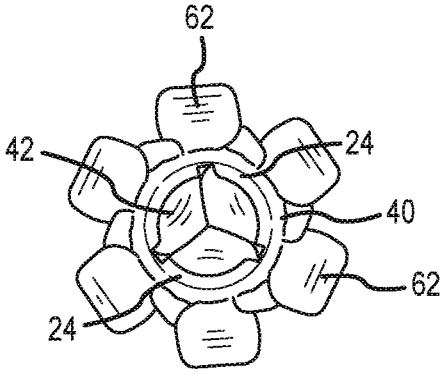

FIGS. 30A-C show the projectile 2 of FIGS. 25A-C after being fired and after hitting the target. FIG. 30A is a perspective view of the projectile 2. FIG. 30B is a side elevation view of the projectile 2. FIG. 30C is a top plan view of the projectile 2. Rifling marks 60 from the gun barrel are shown on the projectile 2.

Figure 31A:
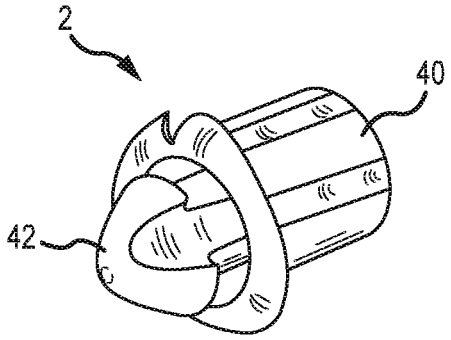
FIGS. 31A-C show a projectile according to a twenty-sixth embodiment of the invention after being fired.
Figure 31B:
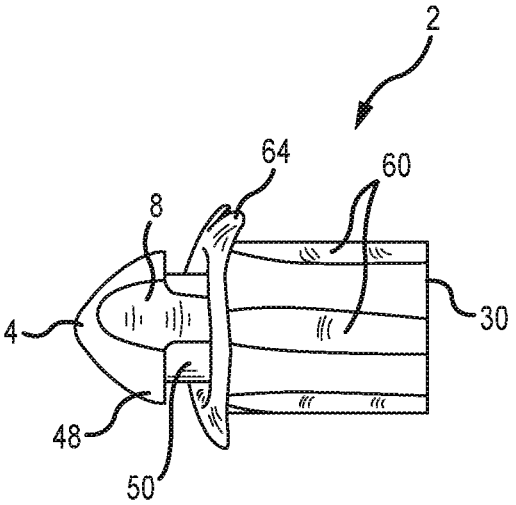
Figure 31C:
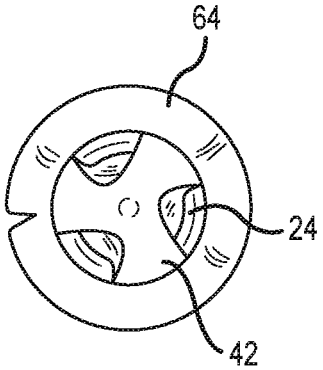

FIGS. 31A-C show a projectile 2 according to a twenty-sixth embodiment of the invention after being fired and after hitting the target. FIG. 31A is a perspective view of the projectile 2. FIG. 31B is a side elevation view of the projectile 2. FIG. 31C is a top plan view of the projectile 2. This insert 42 is the insert shown in FIGS. 28A-C. The projectile 2 of FIGS. 30A-C has perforations on the housing 40 whereas the projectile 2 of FIGS. 31A-C does not have perforations. The perforations cause the housing 40 to flower upon impact as shown in FIG. 30, whereas the housing 40 of FIGS. 31A-C rolls backward in one piece upon impact.

Figure 32A:
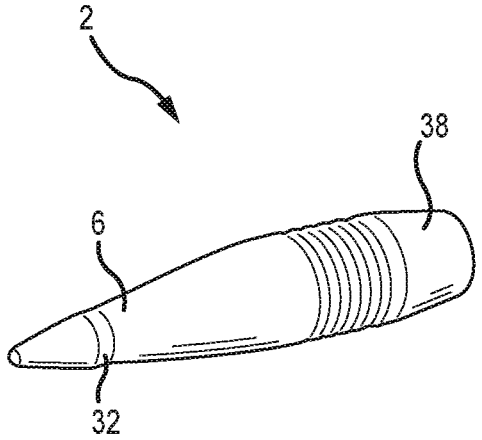
FIGS. 32A-D show a projectile according to a twenty-seventh embodiment of the invention.
Figure 32B:
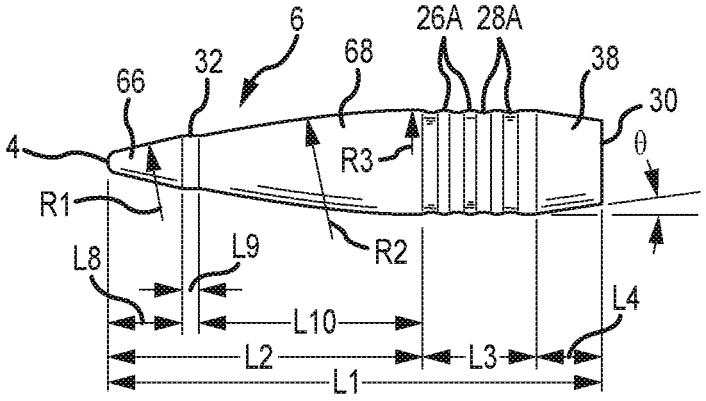
Figure 32C:
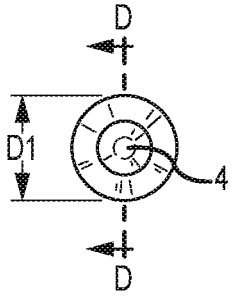
Figure 32D:
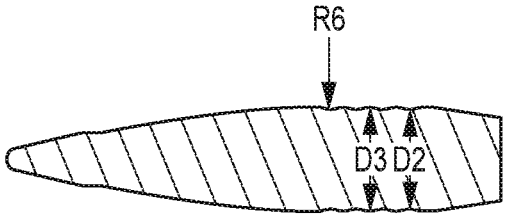

FIGS. 32A-D show a projectile according to a twenty-seventh embodiment of the invention. FIG. 32A is a perspective view of the projectile 2. FIG. 32B is a side elevation view of the projectile 2. FIG. 32C is a top plan view of the projectile 2. FIG. 32D is a cross-sectional view of the projectile 2 taken along cut D-D of FIG. 32C. Note that FIGS. 32A-32D are to scale.

The projectile 2 comprises a tip 4 on one end opposite a base 30 on the other end. In one embodiment, the length L1 of the projectile 2 is between about 1.125 inches and about 1.725 inches. In a preferred embodiment, the length L1 of the projectile 2 is between about 1.225 inches and about 1.625 inches. In a more preferred embodiment, the length L1 of the projectile 2 is about 1.425 inches. In one embodiment, the length L2 of the nose portion 6 is between about 0.699 inches and about 1.099 inches. In a preferred embodiment, the length L2 of the nose portion 6 is between about 0.799 inches and about 0.999 inches. In a more preferred embodiment, the length L2 of the nose portion 6 is about 0.899 inches. In one embodiment, the length L3 of the cylindrical portion 20 is between about 0.522 inches and about 0.122 inches. In a preferred embodiment, the length L3 of the cylindrical portion 20 is between about 0.422 inches and about 0.222 inches. In a more preferred embodiment, the length L3 of the cylindrical portion 20 is about 0.322 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches.

The projectile 2 also has a boat tail 38 with an angle θ proximate the base 30. The cylindrical portion 30 has angled driving bands 26A and angled relief cuts 28A. The projectile 2 also has a flat or linear portion 32 between the first nose portion 66 and the second nose portion 68.

Referring to FIGS. 33-36, these projectiles are "smart bullets" because they penetrate armor and slow down in soft tissue. Like other embodiments with a housing 40 and an insert 42, these projectiles 2 have cavities 24 to receive soft tissue to slow the projectile down in soft tissue. These projectiles 2 have a hardened steel tip insert 42. Further, the different angle of the front or first ogive of the first nose portion 66 from the second ogive of the second nose portion 68 means that a minimal amount of surface area is in contact with the wind, making the projectile's BC higher. Thus, there are two ogive angles: a front or first ogive and rear or second ogive.

Figure 33A:
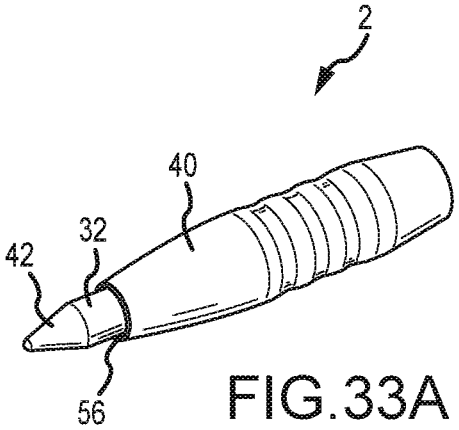
FIGS. 33A-C show a projectile according to a twenty-eighth embodiment of the invention.
Figure 33B:
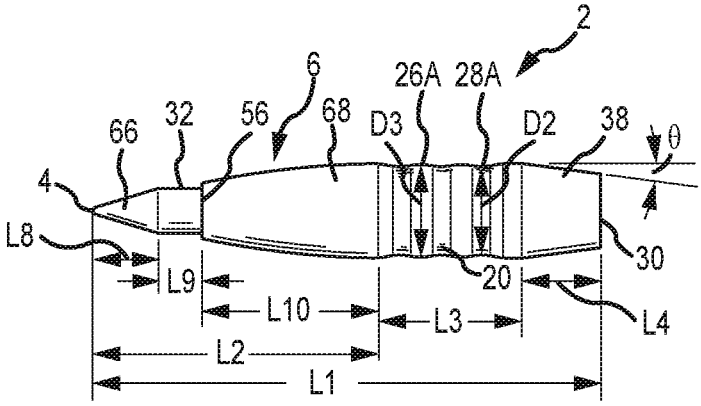
Figure 33C:
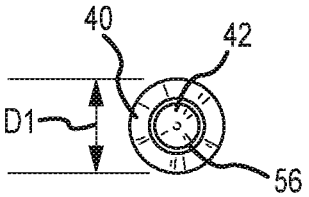
Figure 34A:
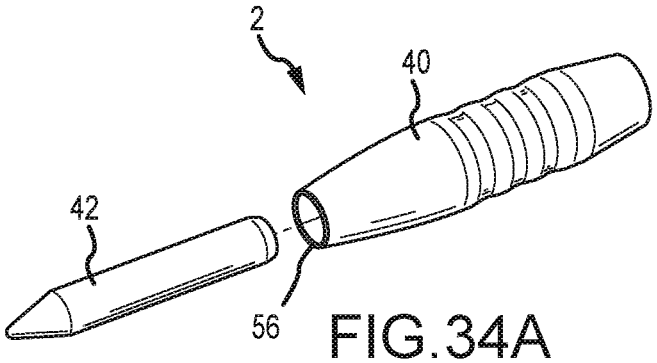
FIGS. 34A-D are exploded views of the projectile housing and insert of FIGS. 33A-C.
Figure 34B:
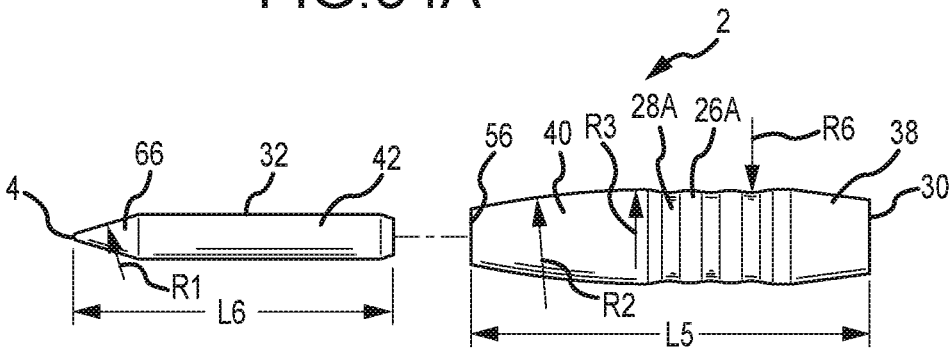
Figure 34C:
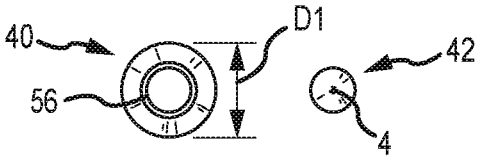
Figure 34D:
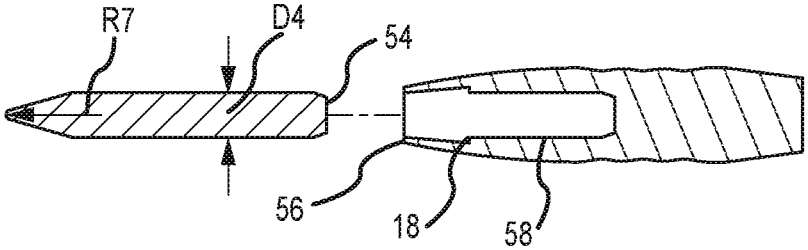

FIGS. 33A-C show a projectile according to a twenty-eighth embodiment of the invention. FIG. 33A is a perspective view of the projectile 2. FIG. 33B is a side elevation view of the projectile 2. FIG. 33C is a top plan view of the projectile 2. Note that FIGS. 33A-33C are to scale. FIGS. 34A-D are exploded views of the projectile housing 40 and insert 42 of FIGS. 33A-C. FIG. 34A is a perspective view of the projectile 2. FIG. 34B is a side elevation view of the projectile 2. FIG. 34C is a top plan view of the projectile 2. FIG. 34D is a cross-sectional view. Note that FIGS. 34A-34D are to scale.

The projectile 2 comprises a tip 4 on one end opposite a base 30 on the other end. The projectile includes an insert 42 that fits into a housing 40. The projectile 2 comprises a nose portion 6 and a cylindrical portion 20 (also called a shank). The nose portion 6 includes a first nose portion 66 and a second nose portion 68. A linear portion 32 is positioned between the first nose portion 66 and second nose portion 68. In one embodiment, the projectile 2 has a hardened steel tip 4. The cylindrical portion 20 includes angled driving bands 26A with diameter D3 and angled relief cuts 28A with diameter D2 and radius of curvature R6. See FIG. 35E for detail on the angled driving bands 26A and angled relief cuts 28A. The projectile also has a boat tail 38 at an angle θ.

In one embodiment, the length L1 of the projectile 2 is between about 1.125 inches and about 1.725 inches. In a preferred embodiment, the length L1 of the projectile 2 is between about 1.225 inches and about 1.625 inches. In a more preferred embodiment, the length L1 of the projectile 2 is about 1.425 inches. In one embodiment, the length L2 of the nose portion 6 is between about 0.699 inches and about 1.099 inches. In a preferred embodiment, the length L2 of the nose portion 6 is between about 0.799 inches and about 0.999 inches. In a more preferred embodiment, the length L2 of the nose portion 6 is about 0.899 inches. In one embodiment, the length L3 of the cylindrical portion 20 is between about 0.522 inches and about 0.122 inches. In a preferred embodiment, the length L3 of the cylindrical portion 20 is between about 0.422 inches and about 0.222 inches. In a more preferred embodiment, the length L3 of the cylindrical portion 20 is about 0.322 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches.

As shown in FIG. 34D, the receiving portion 58 of the housing 40 has a step or shoulder 18. Additionally, the front 56 of the housing 40 is substantially flat and parallel to the base 30.

Figure 35A:
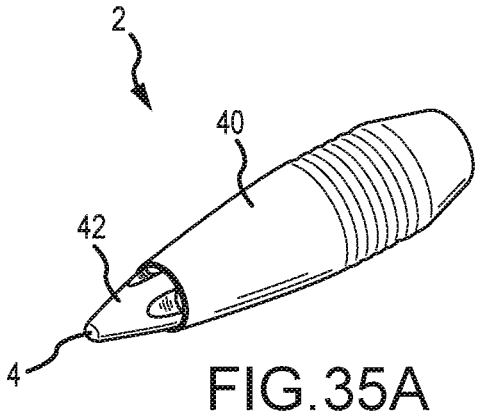
FIGS. 35A-E show a projectile according to a twenty-ninth embodiment of the invention.
Figure 35B:
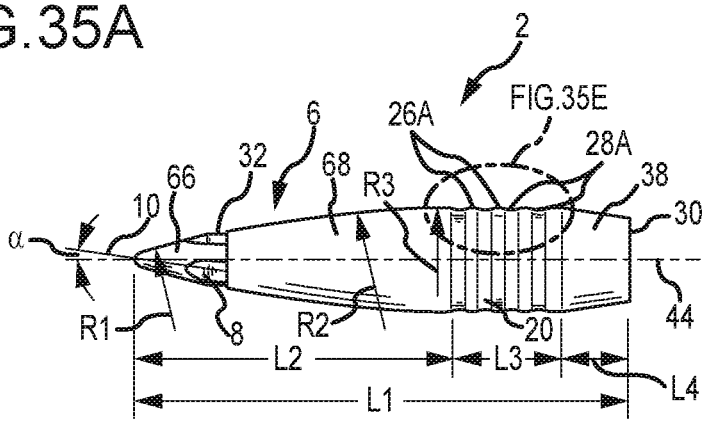
Figure 35C:
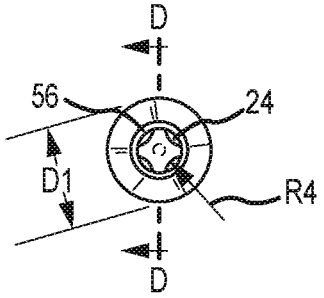
Figure 35D:
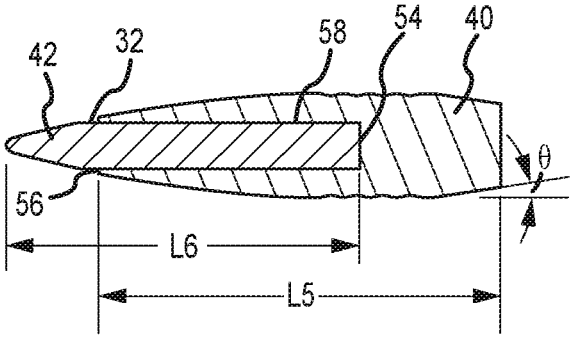
Figure 35E:
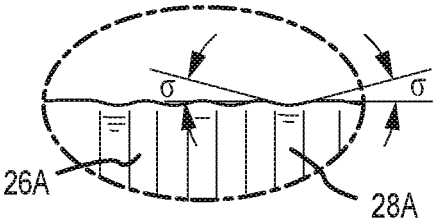

FIGS. 35A-E show a projectile according to a twenty-ninth embodiment of the invention. FIG. 35A is a perspective view of the projectile 2. FIG. 35B is a side elevation view of the projectile 2. FIG. 35C is a top plan view of the projectile 2. FIG. 35D is a cross-sectional view. FIG. 35E is a close-up view. Note that FIGS. 35A-E are to scale. The projectile of FIG. 35 is the same as the projectile of FIG. 24 except that the projectile of FIG. 35 has one insert 42 and the projectile of FIG. 24 has three inserts. This projectile 2 is also similar to the projectile 2 of FIGS. 33A-34D, but the linear portion 32 is shorter in FIGS. 35A-D. Additionally, the projectile 2 of FIGS. 35A-E has depressions 8 on the insert 42. The depressions 8 create a high-pressure area in the depressions 8 to move air around the depression 8 and not into the cavity 24 when traveling through air or in hard media.

The longitudinal axis 44 of the projectile 2 is shown in FIG. 35B. The angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. Further, when looking at the projectile from a top plan view (FIG. 35C), the nose depressions 8 appear to turn in a counter-clockwise direction. In one embodiment, the projectile 2 has at least four nose depressions 8. However, the projectile 2 can have more or fewer nose depressions 8. The depressions 8 create cavities 24 between the insert 42 and the housing 40 such that when the projectile 2 hits a soft medium target, the cavities 24 fill with the soft medium and the projectile 2 slows down. The steeper (i.e., greater) alpha angle will also transfer media at a greater rate into the housing for a faster opening and expansion of the housing 40 upon impact with the terminal media.

The nose portion 6 comprises a first nose portion 66 with a radius of curvature R1 and a second nose portion 66 with a radius of curvature R2. The projectile 2 also has a boat tail 38 with an angle θ.

In one embodiment, the length L1 of the projectile 2 is between about 1.0 inch and about 2.0 inches. In a preferred embodiment, the length L1 of the projectile 2 is between about 1.3 inches and about 1.6 inches. In a more preferred embodiment, the length L1 of the projectile 2 is about 1.405 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches. In one embodiment, the length of the first nose portion 66 extending from the tip 4 to the linear portion 32 is between about 0.10 inches and about 0.30 inches. In a preferred embodiment, the length of the first nose portion 66 extending from the tip 4 to the linear portion 32 is between about 0.14 inches and about 0.20 inches. In a more preferred embodiment, the length of the first nose portion 66 extending from the tip 4 to the linear portion 32 is about 0.17 inches. In one embodiment, the length L5 of the housing 40 is between about 1.0 inch and about 1.3 inches. In a preferred embodiment, the length L5 of the housing 40 is about 1.145 inches. In one embodiment, the length L6 of the insert 42 is between about 1.0 inch and about 1.3 inches. In a preferred embodiment, the length L6 of the insert 42 is about 1.175 inches. In one embodiment, the length of the linear portion 32 is between about 0.10 and 0.15 inches. In one embodiment, the length of the second nose portion 68 extending from the front 56 of the housing 40 to the cylindrical portion 20 is between about 0.55 and about 0.70 inches. In a preferred embodiment, the length of the second nose portion 68 extending from the front 56 of the housing 40 to the cylindrical portion 20 is about 0.62 inches.

In one embodiment, the length L4 of the boat tail 38 is between about 0.10 inches and about 0.40 inches. In a preferred embodiment, the length L4 of the boat tail 38 is between about 0.15 inches and about 0.35 inches. In a more preferred embodiment, the length L4 of the boat tail 38 is about 0.23 inches. In another more preferred embodiment, the length L4 of the boat tail 38 is about 0.30 inches.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees.

The cylindrical portion 20 comprises angled drive bands 26A and angled relief cuts 28A. In one embodiment, the angled drive bands 26A and angled relief cuts 28A are positioned at an angle σ relative to a horizontal line or the longitudinal axis 44 between about 5 degrees and about 10 degrees. In a preferred embodiment, the angled drive bands 26A and angled relief cuts 28A are positioned at an angle σ relative to a horizontal line or the longitudinal axis 44 between about 6 degrees and about 9 degrees. In a more preferred embodiment, the angled drive bands 26A and angled relief cuts 28A are positioned at an angle σ relative to a horizontal line or the longitudinal axis 44 about 7.5 degrees. In another preferred embodiment, the angled drive bands 26A and angled relief cuts 28A are positioned at an angle σ relative to a horizontal line or the longitudinal axis 44 about 8.5 degrees. In alternate embodiments, the driving bands 26A vary in number, comprising one driving band 26A, a plurality of driving bands 26A, two driving bands 26A, three driving bands 26A, and four or more driving bands 26A. The angled drive bands 26A and angled relief cuts 28A create air disturbances that stabilize the projectile 2 in flight allowing the projectile 2 to fly straighter and be less affected by cross winds than projectiles of the prior art.

Figure 36A:
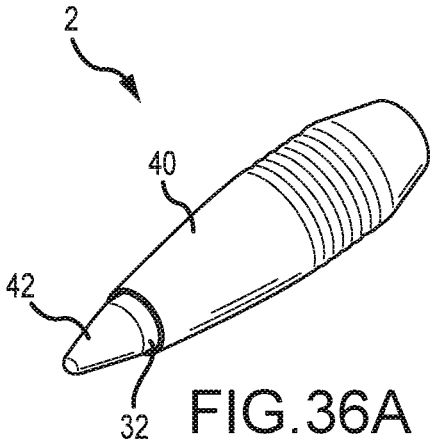
FIGS. 36A-D show a projectile according to a thirtieth embodiment of the invention.
Figure 36B:
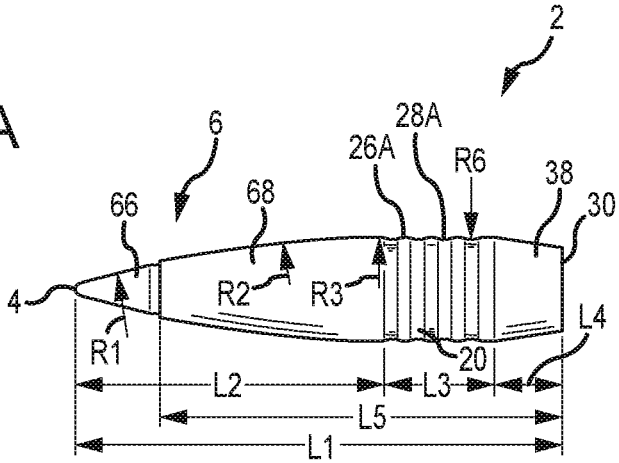
Figure 36C:
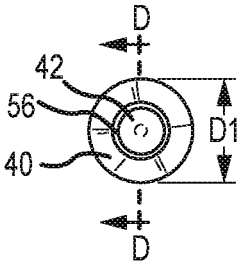
Figure 36D:
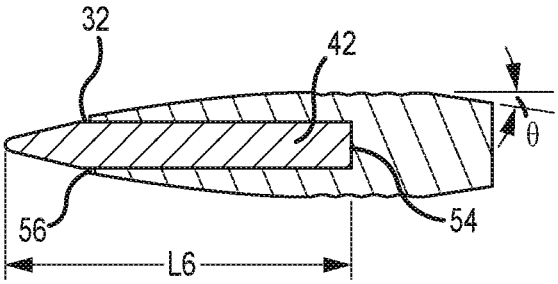

FIGS. 36A-D show a projectile according to a thirtieth embodiment of the invention. FIG. 36A is a perspective view of the projectile 2. FIG. 36B is a side elevation view of the projectile 2. FIG. 36C is a top plan view of the projectile 2. FIG. 36D is a cross-sectional view of the projectile 2. Note that FIGS. 36A-D are to scale.

The projectile 2 comprises a tip 4 on one end opposite a base 30 on the other end. The projectile 2 comprises a nose portion 6 interconnected to a cylindrical portion 20 interconnected to a boat tail 38. The nose portion 6 includes a first nose portion 66, a second nose portion 68, and a linear portion 32 positioned between the first nose portion 66 and the second nose portion 68. The cylindrical portion 20 includes angled driving bands 26A and angled relief cuts 28A. In one embodiment, the length L1 of the projectile 2 is between about 1.0 inch and about 2.0 inches. In a preferred embodiment, the length L1 of the projectile 2 is between about 1.3 inches and about 1.6 inches. In a more preferred embodiment, the length L1 of the projectile 2 is about 1.405 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches. In one embodiment, the length of the first nose portion 66 is between 0.10 inches and about 0.30 inches, or preferably 0.23 inches. In one embodiment, the length of the housing is between about 1.0 inch and about 1.3 inches. In a preferred embodiment, the length of the housing is about 1.145 inches. In one embodiment, the length of the linear portion 32 is between about 0.04 and 0.06 inches. In one embodiment, the length of the second nose portion 68 is between about 0.55 and about 0.70 inches.

The projectiles of FIGS. 37A-38E are designed for high-speed silent flight.

Figure 37A:
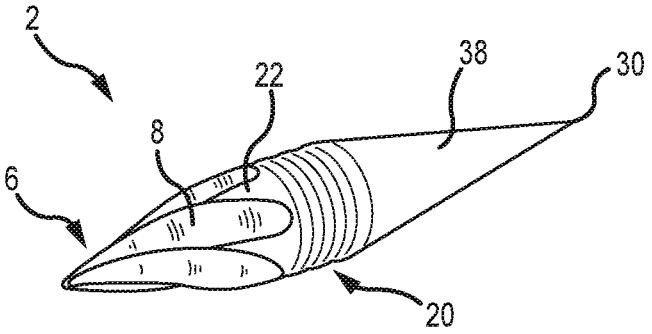
FIGS. 37A-D show a projectile according to a thirty-first embodiment of the invention.
Figure 37B:
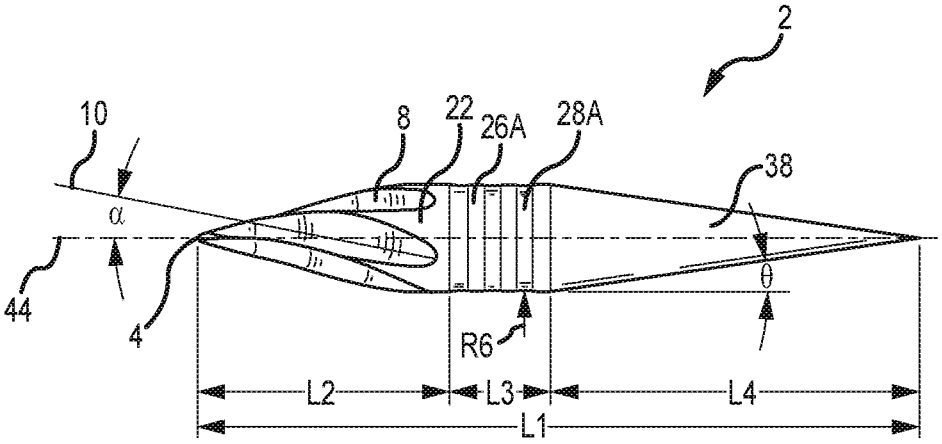
Figure 37C:
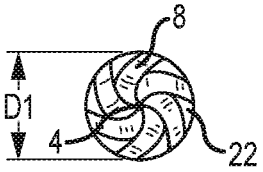
Figure 37D:
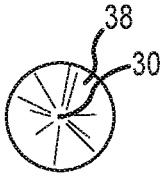

FIGS. 37A-D show a projectile according to a thirty-first embodiment of the invention. FIG. 37A is a perspective view of the projectile 2. FIG. 37B is a side elevation view of the projectile 2. FIG. 37C is a top plan view of the projectile 2. FIG. 37D is a bottom plan view of the projectile 2. Note that FIGS. 37A-D are to scale.

The projectile 2 comprises a tip 4 on one end opposite a base 30 on the other end. The projectile 2 comprises a nose portion 6 interconnected to a cylindrical portion 20 (also called a shank) interconnected to a boat tail 38 with an angle θ. The nose portion 6 includes nose depressions 8 (also called cutouts or troughs) and nose remaining portions 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4.

The longitudinal axis 44 of the projectile 2 is shown in FIG. 37B. The angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. Further, when looking at the projectile 2 from a top plan view (FIG. 37C), the nose depressions 8 appear to turn in a counter-clockwise direction. In one embodiment, the projectile 2 has at least six nose depressions 8. However, the projectile 2 can have more or fewer nose depressions 8.

In one embodiment, the length L1 of the projectile 2 is between about 1.0 inch and about 3.0 inches. In a preferred embodiment, the length L1 of the projectile 2 is between about 1.5 inches and about 2.5 inches. In a more preferred embodiment, the length L1 of the projectile 2 is about 1.96 inches. In one embodiment, the length L2 of the nose portion 6 is between about 1.00 inch and about 0.600 inches. In a preferred embodiment, the length L2 of the nose portion 6 is between about 0.900 inches and about 0.700 inches. In a more preferred embodiment, the length L2 of the nose portion 6 is about 0.800 inches. In one embodiment, the length L3 of the cylindrical portion 20 is between about 0.550 inches and about 0.150 inches. In a preferred embodiment, the length L3 of the cylindrical portion 20 is between about 0.450 inches and about 0.250 inches. In a more preferred embodiment, the length L3 of the cylindrical portion 20 is about 0.350 inches. In a more preferred embodiment, the length L4 is about 1.2 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches.

Figure 38A:
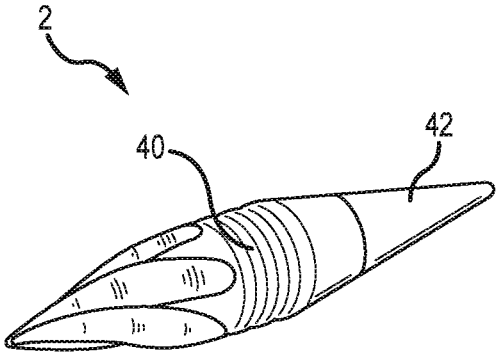
FIGS. 38A-E show a projectile according to a thirty-second embodiment of the invention.
Figure 38B:
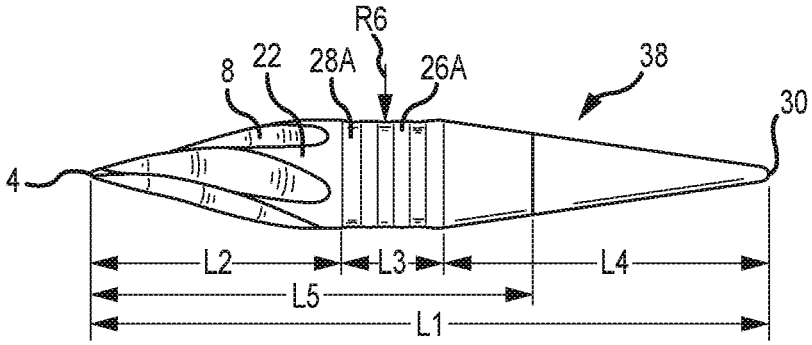
Figure 38C:
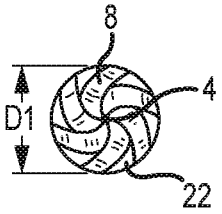
Figure 38D:
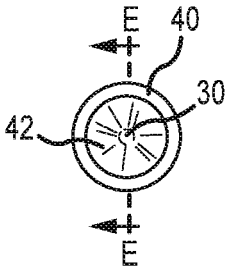
Figure 38E:
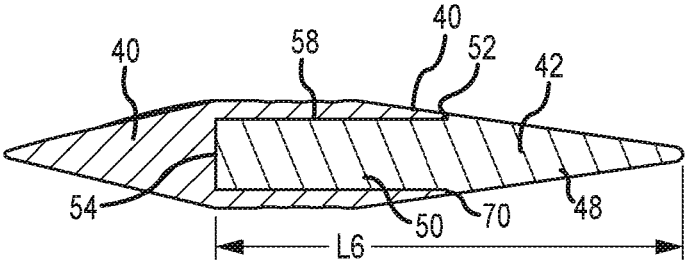

FIGS. 38A-E show a projectile according to a thirty-second embodiment of the invention. FIG. 38A is a perspective view of the projectile 2. FIG. 38B is a side elevation view of the projectile 2. FIG. 38C is a top plan view of the projectile 2. FIG. 38D is a bottom plan view. FIG. 38E is a cross-sectional view. Note that FIGS. 38A-E are to scale. The projectile 2 comprises a housing 40 and an insert 42. The projectile 2 comprises a tip 4 on one end opposite a base 30 on the other end. The projectile 2 comprises a nose portion 6 interconnected to a cylindrical portion 20 interconnected to a boat tail 38. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive.

The nose depressions 8 are right-hand depressions 8 because when looking at the projectile from a top plan view (FIG. 38C), the nose depressions 8 appear to turn in a clockwise direction. In one embodiment, the projectile 2 has at least six nose depressions 8. However, the projectile 2 can have more or fewer nose depressions 8.

In one embodiment, the length L1 of the projectile 2 is between about 1.0 inch and about 2.0 inches. In a preferred embodiment, the length L1 of the projectile 2 is between about 1.5 inches and about 2.5 inches. In a more preferred embodiment, the length L1 of the projectile 2 is about 1.88 inches. In one embodiment, the length L5 of the housing 40 is about 1.2 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches.

Figure 39A:
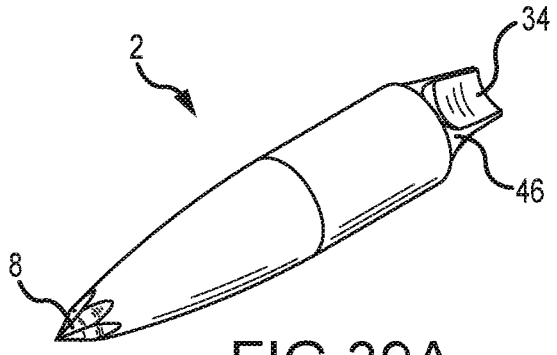
FIGS. 39A-C show a projectile according to a thirty-third embodiment of the invention.
Figure 39B:
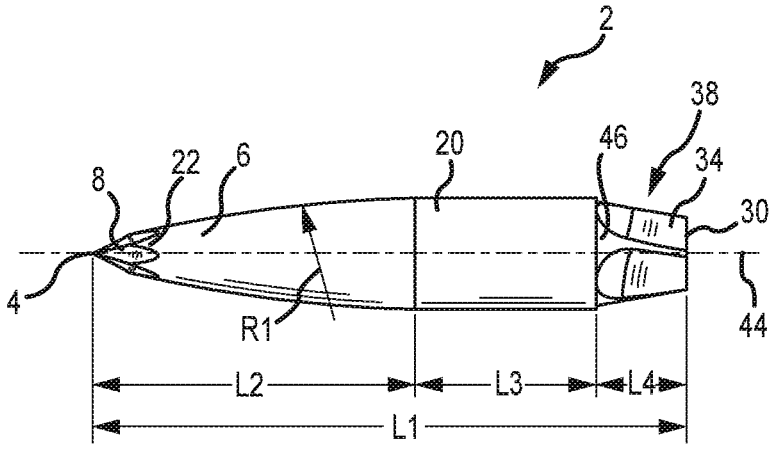
Figure 39C:
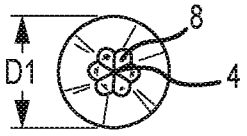

FIGS. 39A-C show a projectile according to a thirty-third embodiment of the invention. FIG. 39A is a perspective view of the projectile 2. FIG. 39B is a side elevation view of the projectile 2. FIG. 39C is a top plan view of the projectile 2. Note that FIGS. 39A-C are to scale.

The projectile 2 comprises a tip 4 on one end opposite a base 30 on the other end. The projectile 2 comprises a nose portion 6 interconnected to a cylindrical portion 20 interconnected to a boat tail 38. The nose portion 6 includes nose depressions 8 (also called cutouts or troughs) and nose remaining portions 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. In one embodiment, the projectile 2 further comprises a tungsten or Inconel insert.

The longitudinal axis 44 of the projectile 2 is shown in FIG. 39B. In one embodiment, the projectile 2 has at least six nose depressions 8. However, the projectile 2 can have more or fewer nose depressions 8.

The diameter D1 of the projectile 2 (also called the caliber) varies according the various embodiments. In one embodiment, the diameter D1 of the projectile 2 is between about 0.508 inches and about 0.108 inches. In a preferred embodiment, the diameter D1 of the projectile 2 is between about 0.408 inches and about 0.208 inches. In the embodiment shown, the diameter D1 of the projectile 2 is about 0.308 inches.

The intended users of the projectile 2 are African big game hunters. The attributes of this projectile 2 are deep straight penetration with transfer of energy. The projectile 2 is comprised of brass, copper, bronze, tungsten-carbide, alloys of these metals, or any material known in the art, including plastics and ceramics. In some embodiments, this projectile 2 will be two pieces and will have a tungsten or Inconel insert. This projectile 2 is armor penetrating. This projectile 2 is designed to go and never quit. Further, the tip 4 is designed to relieve material as it penetrates its target.

Figure 40A:
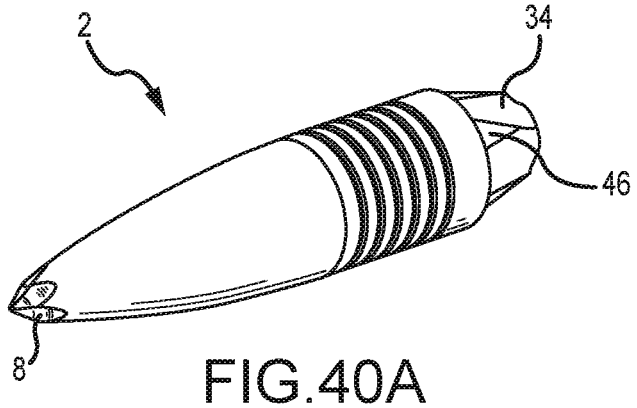
FIGS. 40A-C show a projectile according to a thirty-fourth embodiment of the invention.
Figure 40B:
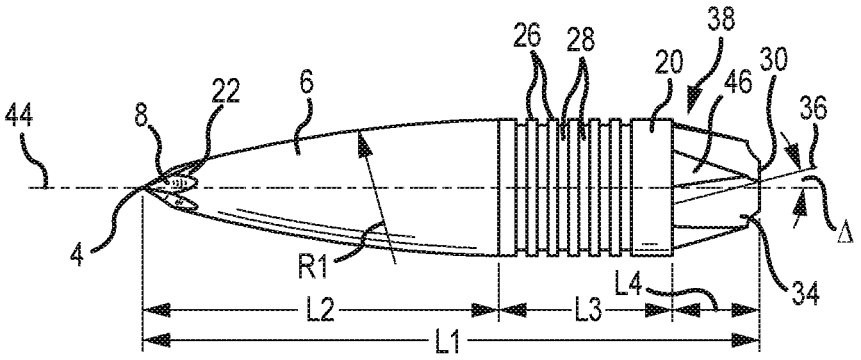
Figure 40C:
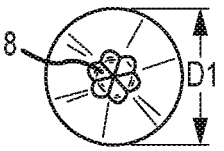

FIGS. 40A-C show a projectile according to a thirty-fourth embodiment of the invention. FIG. 40A is a perspective view of the projectile 2. FIG. 40B is a side elevation view of the projectile 2. FIG. 40C is a top plan view of the projectile 2. Note that FIGS. 40A-C are to scale. Some embodiments may also have angled driving bands and angled relief bands.

The projectile 2 comprises a tip 4 on one end opposite a base 30 on the other end. The projectile 2 comprises a nose portion 6 interconnected to a cylindrical portion 20 interconnected to a boat tail 38. The nose portion 6 includes nose depressions 8 (also called cutouts or troughs) and nose remaining portions 22 between the nose depressions 8, where each nose remaining portion 22 is positioned between two nose depressions 8. The remaining portions 22 are the uncut portions having the projectile's original ogive.

The longitudinal axis 44 of the projectile 2 is shown in FIG. 40B. In one embodiment, the projectile 2 has at least six nose depressions 8. However, the projectile 2 can have more or fewer nose depressions 8.

The diameter D1 of the projectile 2 (also called the caliber) varies according the various embodiments. In one embodiment, the diameter D1 of the projectile 2 is between about 0.138 inches and about 0.538 inches. In a preferred embodiment, the diameter D1 of the projectile 2 is between about 0.238 inches and about 0.438 inches. In the embodiment shown, the diameter D1 of the projectile 2 is about 0.338 inches.

The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

The projectiles described herein can be comprised of brass, copper, bronze, tungsten-carbide, alloys of these metals, or any material known in the art, including plastics and ceramics.

In some embodiments, the angle of the depressions, troughs, or cutout portions can be oriented or measured with respect to the longitudinal axis of the projectile or the ogive of the remaining portion. In various embodiments, the angle of the depression's centerline or the lowest point of the trough relative to the projectile's ogive is constant. Thus, the angle of the depression's centerline or the lowest point of the trough relative to the projectile's centerline may not be a constant angle; rather the angle may actually be a multitude of angles because the line of the trough follows the ogive and, therefore, is parabolic relative to the projectile's centerline.

The cylindrical portion can comprise sections that are equal to the diameter of the rifle barrel's grooves (driving bands) and alternate with a diameter equal to the diameter of lands in the rifle's bore (relief cuts). The angle of transition between these driving bands and relief cuts is 7.5-8.5 degrees in one embodiment.

Figure 41:
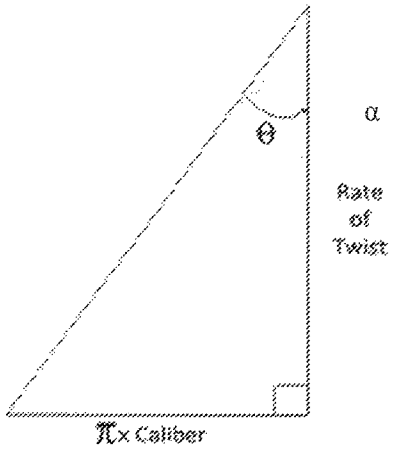
FIG. 41 shows a table for alpha angles corresponding to the rate of twist and the caliber.

FIG. 41 shows Table 1, which is a design chart for alpha angles for given barrel rates of twist and calibers. For example, for a 0.308 caliber bullet fired from a barrel having a barrel rate of twist of 10 (i.e., 1 bullet rotation every 10 inches of barrel travel), the alpha angle is 5.526794 degrees. The alpha angle designs provided are representative of embodiments that have a perfect correlation to the rate of twist.

Experimental Results

The rifled projectiles have exhibited excessive velocity with no apparent gain in pressure. This is an unexpected result, as under normal circumstances this should be impossible. This unexpected result may be due to less friction within the barrel. The twisting depressions are twisting the bullet in the barrel and reducing friction when the projectile engages with the rifling. This occurs when pressures exceed roughly 50,000 PSI. As the barrel warms slightly and pressures increase, the velocity increases exponentially. The greatest increase recorded was 1,400 ft/s over the standard rifle projectile. This is substantial because it represents a 40% increase over normal velocity.

Also, the barrel heats at a slower rate and heats differently than with traditional bullets, lending further evidence of reduced friction in the barrel. Under normal circumstances, the greatest heat in a barrel is experienced an inch or two after the chamber. In contrast, with respect to the projectiles disclosed herein, the barrel gets hottest near the muzzle. The high pressures are helping to twist the projectile through the rifling and thus lowering friction. When the pressures drop near the muzzle, the heat and the friction return to the barrel.

There are many benefits of these results. With lower friction and less heating, barrels will last substantially longer. A lower rate of heating would have an impact on the manufacturing of machine guns, e.g., they could have lighter barrels that would last longer. Cyclic rates could be raised; longer bursts and sustained fire would be possible. Greater velocities mean flatter trajectories with the same case and similar weight projectiles. For a given projectile weight and caliber, a much smaller case could be employed. This means smaller lighter actions and more ammunition could be supplied for a given weight weapon system.

The functional aspects of the projectile may eliminate the sound of the bullet in flight, i.e., the whistle associated with a projectile in flight. The supersonic crack of the bullet passing is still audible but lessened. In one series of tests, a bullet flew at supersonic velocity without a supersonic crack until destabilizing, after which a yaw resulted and whistling began. Thus, a lower sound signature is provided.

These projectiles fly flatter than traditional ones, i.e., they have a higher ballistic coefficient. The fact they do not make a whistle means there is less friction as they slide through the atmosphere.

The penetration exhibited by these projectiles is greater than standard projectiles, and penetrate straighter than normal. Also, the projectiles of the invention have righted themselves after glancing off an object. The shape lends itself to reestablishing the spin after the projectile has struck an object. When a normal projectile begins to yaw, penetration decreases rapidly. With the subject projectiles, the spin ensures that yaw does not result.

The shape of the front of the projectile provides the capability to produce secondaries and enlarging wound channels. This will increase the size cavity of a wound inflicted by this projectile. The rapid sideways movement of media upon impact with this projectile may also explain the extra penetration that has been shown.

In one embodiment of a method of manufacture, a projectile is manufactured comprising steps as follows: the basic projectile shape, i.e. the nose and profile, is cut using a lathe; depressions are cut using a combination CNC Swiss screw machine (broadly, a combination CNC and lathe machine), Swiss screw machine and/or CNC turning machine. The projectile is rotated as the mill machine is cutting the material (one turns the front half or the back half of the projectile as appropriate, that is, depending on which portion of projectile is being worked). The forward-most portion of the projectile is contacted while the projectile is rotating. A mill is used to cut depressions in a straight line while the projectile turns. Then, cut any required driving bands; cut a radius on the back of the projectile as required; cut off back of projectile at base as required; and cut tail depression(s) as required (alternately, one can start tail portion of projectile and end with the nose portion of the projectile).

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

The invention claimed is:

1. A projectile for use in a handheld weapon, comprising:
- a housing with a longitudinal axis and a forward end and a rear end which define a first length therebetween, the housing comprising:
  - a nose portion proximate the forward end;
  - a base positioned at the rear end;
  - a cylindrical portion interconnected to the nose portion on a first end of the cylindrical portion and interconnected to the base on a second end opposite the first end;
  - an opening at the forward end; and
  - a cavity extending from the opening and inward into the housing; and
- an insert with a longitudinal axis and an insert forward end and an insert rear end which define a second length therebetween, the insert comprising:
  - a head portion with a solid substantially flat tip at the insert forward end;
  - a stem interconnected to the head portion opposite the tip;
  - a nose portion extending from the tip at the insert forward end, wherein the nose portion tapers outwardly from the tip; and
  - a plurality of cutout portions originating at the tip and extending along sides of the head portion, wherein each cutout portion in the plurality of cutout portions forms a curved trough with a radius of curvature;
- wherein the insert is positioned in the cavity of the housing, and wherein the longitudinal axis of the insert is positioned along the longitudinal axis of the housing, wherein the plurality of cutout portions in the insert extend from the tip of the insert positioned outside of the housing and extend into the housing.

2. The projectile of claim 1, wherein the projectile is sized in at least one of a .380 inch, a 9 mm, a .40 inch, and a .45 inch caliber and is adapted for use with a handgun.

3. The projectile of claim 1, wherein the insert further comprises a plurality of non-distorted nose portions, wherein each non-distorted nose portion is positioned between two cutout portions in the plurality of cutout portions.

4. The projectile of claim 1, wherein the housing is made of a first metallic material and the insert is made of a second metallic material.

5. The projectile of claim 4, wherein the first metallic material is the same as the second metallic material.

6. The projectile of claim 4, wherein the first metallic material is different than the second metallic material.

7. The projectile of claim 1, wherein the radius of curvature of each curved trough is between 0.10 inches and 0.30 inches.

8. The projectile of claim 1, wherein the insert is compression fit into the housing.

9. The projectile of claim 1, wherein the insert does not fill the entire cavity of the housing such that there is space between a side surface of the cavity and a side surface of the stem of the insert.

10. The projectile of claim 1, wherein the nose portion of the housing tapers outwardly from the forward end of the housing and aligns with the outwardly taping nose portion of the insert.

11. A projectile for use in a handheld weapon, comprising:
- a housing with a longitudinal axis and a forward end and a rear end which define a first length therebetween, the housing comprising:
  - a nose portion proximate the forward end;
  - a substantially flat base positioned at the rear end;
  - a cylindrical portion interconnected to the nose portion on a first end of the cylindrical portion and interconnected to the base on a second end opposite the first end, wherein the nose portion extends outwardly from the forward end to the first end of the cylindrical portion;
  - an opening at the forward end; and
  - a cavity extending from the opening and inward into the housing; and
- an insert with a longitudinal axis and an insert forward end and an insert rear end which define a second length therebetween, the insert comprising:
  - a head portion with a tip at the insert forward end;
  - a stem interconnected to the head portion opposite the tip;
  - a nose portion extending from the tip at the insert forward end, wherein the nose portion tapers outwardly from the tip; and a plurality of cutout portions originating at the tip and extending along the head portion, wherein each cutout portion in the plurality of cutout portions forms a curved trough with a radius of curvature;

wherein the insert is positioned in the cavity of the housing, wherein the longitudinal axis of the insert is positioned along the longitudinal axis of the housing, wherein the housing and the insert are constructed of metal materials, and wherein the plurality of cutout portions in the insert extend from the tip of the insert positioned outside of the housing and extend into the housing.

12. The projectile of claim 11, wherein the insert further comprises a plurality of non-distorted nose portions, wherein each non-distorted nose portion is positioned between two cutout portions in the plurality of cutout portions, and wherein the radius of curvature of each curved trough is between 0.10 inches and 0.30 inches.

13. The projectile of claim 11, wherein the housing is made of a first metallic material and the insert is made of a second metallic material, and wherein the first metallic material is different than the second metallic material.

14. The projectile of claim 11, wherein the housing is made of a first metallic material and the insert is made of a second metallic material, and wherein the first metallic material is the same as the second metallic material.

15. The projectile of claim 11, where in the tip of the insert is substantially flat and substantially parallel to the base of the housing.

16. The projectile of claim 11, wherein the stem of the insert has a smaller diameter than the head portion of the insert, and wherein a portion of the head portion is positioned outside of the housing and a portion of the head portion is positioned inside the housing.

17. A method of providing a projectile for use in a handheld weapon, the method comprising:

providing a housing with a longitudinal axis and a forward end and a rear end which define a first length therebetween, the housing comprising:

a nose portion proximate the forward end;

a base positioned at the rear end;

a cylindrical portion interconnected to the nose portion on a first end of the cylindrical portion and interconnected to the base on a second end opposite the first end;

an opening at the forward end; and a cavity extending from the opening and inward into the housing;

providing an insert with a longitudinal axis and an insert forward end and an insert rear end which define a second length therebetween, the insert comprising:

a head portion with a solid substantially flat tip at the insert forward end;

a stem interconnected to the head portion opposite the tip;

a nose portion extending from the tip at the insert forward end, wherein the nose portion tapers outwardly from the tip; and a plurality of cutout portions originating at the tip and extending along sides of the head portion, wherein each cutout portion in the plurality of cutout portions forms a curved trough with a radius of curvature; and positioning the insert in the cavity of the housing such that the longitudinal axis of the insert is positioned along the longitudinal axis of the housing, wherein the plurality of cutout portions in the insert extend from the tip of the insert positioned outside of the housing and extend into the housing.

* * * * *